US009904189B2

(12) United States Patent
Ota

(10) Patent No.: US 9,904,189 B2
(45) Date of Patent: Feb. 27, 2018

(54) ELECTROSTATIC IMAGE DEVELOPING TONER

(71) Applicant: MITSUBISHI CHEMICAL CORPORATION, Tokyo (JP)

(72) Inventor: Masaya Ota, Niigata (JP)

(73) Assignee: MITSUBISHI CHEMCICAL CORPORATION, Tokyo (JP)

( * ) Notice: Subject to any disclaimer, the term of this patent is extended or adjusted under 35 U.S.C. 154(b) by 0 days.

(21) Appl. No.: 14/858,739

(22) Filed: Sep. 18, 2015

(65) Prior Publication Data

US 2016/0097985 A1 Apr. 7, 2016

Related U.S. Application Data

(63) Continuation of application No. PCT/JP2014/057611, filed on Mar. 19, 2014.

(30) Foreign Application Priority Data

Mar. 21, 2013 (JP) ..... 2013-058378

(51) Int. Cl.
*G03G 9/08* (2006.01)
*G03G 9/087* (2006.01)
(Continued)

(52) U.S. Cl.
CPC ..... *G03G 9/0821* (2013.01); *G03G 9/08795* (2013.01); *G03G 9/08797* (2013.01);
(Continued)

(58) Field of Classification Search
CPC ..... G03G 9/0821; G03G 9/09733; G03G 9/09335; G03G 9/08797; G03G 9/09378
See application file for complete search history.

(56) References Cited

U.S. PATENT DOCUMENTS 5,880,244 A * 3/1999 Dowlen ..... C08G 77/12 399/106
5,908,726 A * 6/1999 Inoue ..... G03G 9/0837 430/106.2
(Continued)

FOREIGN PATENT DOCUMENTS

EP 1 688 799 A1 8/2006
JP 2001-75305 A 3/2001
(Continued)

OTHER PUBLICATIONS

Diamond, Arthur S (editor) Handbook of Imaging Materials. New York: Marcel-Dekker, Inc. (2002) pp. 145-164.*
(Continued)

*Primary Examiner* — Christopher D Rodee
(74) *Attorney, Agent, or Firm* — Oblon, McClelland, Maier & Neustadt, L.L.P.

(57) ABSTRACT

The present invention provides an electrostatic image developing toner containing a binder resin, a colorant and a wax, wherein at least one specific peak or shoulder attributable to a melting point of the wax is present at 55 to 90° C., a dust emission (Dt) of said electrostatic image developing toner satisfies the specific formula, another specific peak or shoulder relating to an endothermic quantity is present at 65.6 to 70.8° C., and an average value of tan δ in a range of an angular velocity of 20 to 100 rad/sec in a dynamic viscoelasticity measurement at 140° C. is from 1.62 to 2.20.

14 Claims, 15 Drawing Sheets

(51) Int. Cl.
*G03G 9/093* (2006.01)
*G03G 9/097* (2006.01)

(52) U.S. Cl.
CPC ..... *G03G 9/09328* (2013.01); *G03G 9/09378* (2013.01); *G03G 9/09392* (2013.01); *G03G 9/09733* (2013.01)

(56) References Cited

U.S. PATENT DOCUMENTS

| | | | | |
|---|---|---|---|---|
| 6,967,070 | B2 * | 11/2005 | Nakamura | G03G 9/08704 430/108.4 |
| 9,411,275 | B2 * | 8/2016 | Sugiyama | G03G 15/2028 |
| 2003/0049552 | A1 * | 3/2003 | Fields | G03G 9/0819 430/108.8 |
| 2004/0191661 | A1 * | 9/2004 | Ohno | G03G 9/0819 430/108.24 |
| 2013/0202332 | A1 * | 8/2013 | Kishimoto | G03G 15/2007 399/327 |
| 2015/0017583 | A1 * | 1/2015 | Ota | G03G 9/0821 430/109.1 |

FOREIGN PATENT DOCUMENTS

| | | | | |
|---|---|---|---|---|
| JP | 2005-91706 | A | 4/2005 | |
| JP | 2006-91168 | A | 4/2006 | |
| JP | 2011-081042 | | 4/2011 | |
| JP | 2011-215502 | A | 10/2011 | |
| JP | 2012-88440 | A | 5/2012 | |
| JP | 2012-181263 | | 9/2012 | |
| JP | 2012-212132 | A | 11/2012 | |
| JP | 2012-215859 | | 11/2012 | |
| WO | WO 2013/146234 | | 10/2013 | |
| WO | WO 2013146234 | A1 * | 10/2013 | G03G 9/0821 |

OTHER PUBLICATIONS

Notification of Information dated Jan. 12, 2016 in Japanese Patent Application No. 2013-058378 (with English translation).
Extended European Search Report dated Mar. 8, 2016 in Patent Application No. 14769816.1.
Office Action dated Jul. 19, 2016 in Japanese Patent Application No. 2013-058378 (with unedited computer generated English language translation).
Decision of Refusal dated Dec. 20, 2016, in corresponding Japanese Patent Application No. 2013-058378 (with English-language Machine Translation).
Office Action dated May 16, 2017 in Japanese Patent Application No. 2013-058378 (with English language translation).
Office Action dated Oct. 2, 2017, in corresponding European Patent Application No. 14769816.1.

* cited by examiner

FIG. 11

Table 1

| Item | Unit | Example 1 | Example 2 | Example 3 | Example 4 | Example 5 | Comparative Example 1 | Comparative Example 2 |
|---|---|---|---|---|---|---|---|---|
| Toner for development | | D1 | D2 | D3 | D4 | D5 | D6 | D7 |
| Sketch of structure<br>● Wax A1<br>● Wax A2 | - | 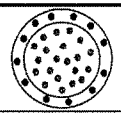 | 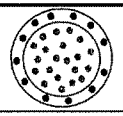 | 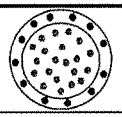 | 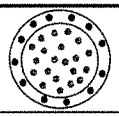 | 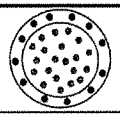 | 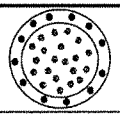 | 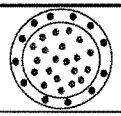 |
| Core component primary polymer particle | - | B1 | B3 | B4 | B5 | B6 | B7 | B8 |
| Shell component primary polymer particle | - | B2 | B2 | B2 | B2 | B2 | B2 | B2 |
| DwA1, Dust emission of Wax A1 | CPM | 26,723 | 26,723 | 26,723 | 26,723 | 26,723 | 26,723 | 26,723 |
| DwA2, Dust emission of Wax A2 | CPM | 155,631 | 155,631 | 155,631 | 155,631 | 155,631 | 155,631 | 155,631 |
| CwA1, Mass% of Wax A1 in electrostatic image developing toner | mass% | 8.3 | 8.3 | 8.3 | 8.3 | 8.3 | 8.3 | 8.3 |
| CwA2, Mass% of Wax A2 in electrostatic image developing toner | mass% | 0.9 | 0.9 | 0.9 | 0.9 | 0.9 | 0.9 | 0.9 |
| Ratio of Wax A2 in all waxes | mass% | 9.8% | 9.8% | 9.8% | 9.8% | 9.8% | 9.8% | 9.8% |
| DwAll, Wax-derived dust emission | CPM | 3,619 | 3,619 | 3,619 | 3,619 | 3,619 | 3,619 | 3,619 |
| Dv50 | μm | 7.09 | 7.17 | 7.08 | 7.13 | 7.17 | 7.06 | 7.24 |
| Dn50 | μm | 6.52 | 6.53 | 6.53 | 6.51 | 6.58 | 6.43 | 6.56 |
| Average circularity | - | 0.967 | 0.967 | 0.967 | 0.968 | 0.967 | 0.968 | 0.967 |
| HFW1 | °C | 77.2 | 77.7 | 77.0 | 77.3 | 77.3 | 77.7 | 76.9 |
| HFW2 | °C | 66.0 | 66.1 | 65.8 | 66.0 | 65.9 | 66.1 | 66.0 |

FIG. 11
(continued)

| Item | Unit | Comparative Example 3 | Comparative Example 4 | Reference Example 1 | Reference Example 2 | Reference Example 3 | Reference Example 4 |
|---|---|---|---|---|---|---|---|
| Toner for development | | D8 | D9 | D10 | D11 | D12 | D13 |
| Sketch of structure<br>● Wax A1<br>● Wax A2 | - | 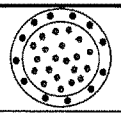 | 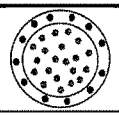 | 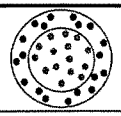 | 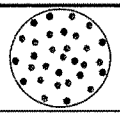 | 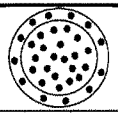 | 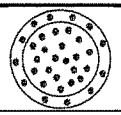 |
| Core component primary polymer particle | - | B9 | B10 | B1 | B1 | B2 | B1 |
| Shell component primary polymer particle | - | B2 | B2 | B2 | B2 | B2 | B2 |
| DwA1, Dust emission of Wax A1 | CPM | 26,723 | 26,723 | 26,723 | 26,723 | 26,723 | 26,723 |
| DwA2, Dust emission of Wax A2 | CPM | 155,631 | 155,631 | 155,631 | 155,631 | 155,631 | 155,631 |
| CwA1, Mass% of Wax A1 in electrostatic image developing toner | mass% | 8.3 | 8.3 | 7.4 | 8.3 | 0 | 9.2 |
| CwA2, Mass% of Wax A2 in electrostatic image developing toner | mass% | 0.9 | 0.9 | 1.8 | 0.9 | 9.2 | 0 |
| Ratio of Wax A2 in all waxes | mass% | 9.8% | 9.8% | 19.6% | 9.8% | 100.0% | 0.0% |
| DwAll, Wax-derived dust emission | CPM | 3,619 | 3,619 | 4,779 | 3,619 | 14,318 | 2,459 |
| Dv50 | μm | 7.07 | 7.20 | 7.25 | 7.14 | 7.02 | 7.15 |
| Dn50 | μm | 6.45 | 6.59 | 6.65 | 6.51 | 6.51 | 6.49 |
| Average circularity | - | 0.967 | 0.967 | 0.966 | 0.968 | 0.967 | 0.968 |
| HFW1 | °C | 77.9 | 77.2 | 76.3 | 77.9 | 76.1 | 82.0 |
| HFW2 | °C | 66.0 | 66.0 | 66.0 | 65.8 | 73.2 | 66.0 |

FIG. 12

Table 2

| Item | Unit | Example 1 | Example 2 | Example 3 | Example 4 | Example 5 | Comparative Example 1 | Comparative Example 2 |
|---|---|---|---|---|---|---|---|---|
| Toner for development | | D1 | D2 | D3 | D4 | D5 | D6 | D7 |
| TT1, peak temperature observed at 65.6 to 70.8°C in first temperature rise in DSC | °C | 68.6 | 66.3 | 69.7 | 67.7 | 67.8 | 65.4 | 71.1 |
| HF1_50°C, Heat Flow value at 50°C in first temperature rise in DSC | W/g | 0.036 | 0.033 | 0.034 | 0.039 | 0.042 | 0.037 | 0.036 |
| HF1_P, Heat Flow value at temperature T1 in first temperature rise in DSC | W/g | -0.204 | -0.209 | -0.192 | -0.180 | -0.193 | -0.199 | -0.196 |
| HF1_T1, HF1_P-HF1_50°C | W/g | -0.240 | -0.242 | -0.226 | -0.219 | -0.234 | -0.236 | -0.232 |
| HF2_50°C, Heat Flow value at 50°C in second temperature rise in DSC | W/g | 0.036 | 0.039 | 0.036 | 0.037 | 0.041 | 0.032 | 0.034 |
| HF2_P, Heat Flow value at temperature T1 in second temperature rise in DSC | W/g | -0.099 | -0.096 | -0.101 | -0.090 | -0.098 | -0.103 | -0.097 |
| HF2_T1, HF2_P-HF2_50°C | W/g | -0.135 | -0.135 | -0.136 | -0.127 | -0.139 | -0.136 | -0.131 |
| RTT1, <HF2_T1/HF1_T2> | % | 56% | 56% | 60% | 58% | 59% | 58% | 56% |
| tanδAve, Average value of phase difference in the high strain rate region | - | 2.08 | 1.96 | 2.04 | 2.14 | 1.79 | 1.91 | 2.05 |
| TPR, Plasticization initiating temperature | °C | 77.3 | 74.5 | 79.4 | 77.3 | 77.3 | 73.1 | 80.8 |
| Dt, Toner dust emission | CPM | 118 | 119 | 114 | 117 | 119 | 156 | 103 |
| Vd, Dust emission rate | mg/hr | 0.6 | (0.6) | (0.6) | (0.6) | (0.6) | (0.6) | (0.6) |
| | - | AA | (AA) | (AA) | (AA) | (AA) | (AA) | (AA) |
| High adhesion-amount HOS property | - | AA | - | - | - | - | - | - |
| Storability (50°C 40% 24 Hr) | g | 0 | 60 | 0 | 0 | 0 | 120 | 0 |
| | - | AA | A | AA | AA | AA | C | AA |
| COS Property at high-speed printing (@162 ppm) | °C | 160 | 155 | 170 | 155 | 160 | 150 | 175 |
| | - | AA | AA | A | AA | AA | AA | C |
| HOS Property at low-speed printing (@195°C 82 rpm) | - | A | A | A | A | A | A | A |
| Gloss at high-speed printing (@185°C 162 ppm) | % | 20 | 23 | 23 | 24 | 20 | 25 | 20 |
| | - | A | A | A | A | A | AA | A |

FIG. 12

(continued)

| Item | Unit | Comparative Example 3 | Comparative Example 4 | Reference Example 1 | Reference Example 2 | Reference Example 3 | Reference Example 4 |
|---|---|---|---|---|---|---|---|
| Toner for development | | D8 | D9 | D10 | D11 | D12 | D13 |
| TT1, peak temperature observed at 65.6 to 70.8°C in first temperature rise in DSC | °C | 67.8 | 68.0 | 67.0 | 69.2 | 69.1 | 68.0 |
| HF1_50°C, Heat Flow value at 50°C in first temperature rise in DSC | W/g | 0.044 | 0.037 | 0.036 | 0.045 | 0.049 | 0.042 |
| HF1_P, Heat Flow value at temperature T1 in first temperature rise in DSC | W/g | -0.184 | -0.190 | -0.148 | -0.214 | -0.173 | -0.171 |
| HF1_T1, HF1_P-HF1_50°C | W/g | -0.228 | -0.227 | -0.184 | -0.259 | -0.223 | -0.213 |
| HF2_50°C, Heat Flow value at 50°C in second temperature rise in DSC | W/g | 0.039 | 0.041 | 0.039 | 0.039 | 0.036 | 0.037 |
| HF2_P, Heat Flow value at temperature T1 in second temperature rise in DSC | W/g | -0.110 | -0.120 | -0.098 | -0.101 | -0.103 | -0.101 |
| HF2_T1, HF2_P-HF2_50°C | W/g | -0.149 | -0.161 | -0.137 | -0.140 | -0.139 | -0.138 |
| RTT1, <HF2_T1/HF1_T2> | % | 65% | 71% | 74% | 54% | 62% | 65% |
| tanδAve, Average value of phase difference in the high strain rate region | - | 2.22 | 1.56 | 2.04 | 1.94 | 1.96 | 1.98 |
| TPR, Plasticization initiating temperature | °C | 77.3 | 77.3 | 76.6 | 76.6 | 75.9 | 76.6 |
| Dt, Toner dust emission | CPM | 118 | 98 | 444 | 112 | 5.665 | 21 |
| Vd, Dust emission rate | mg/hr | (0.6) | (0.6) | 0.9 | 0.6 | 3.7 | less than 0.6 |
| | - | (AA) | (AA) | A | AA | C | AA |
| High adhesion-amount HOS property | - | - | - | AA | A | AA | C |
| Storability (50°C 40% 24 Hr) | g | 0 | 0 | 0 | 0 | 0 | 0 |
| | - | AA | AA | AA | AA | AA | AA |
| COS Property at high-speed printing (@162 ppm) | °C | 160 | 165 | 160 | 160 | 160 | 160 |
| | - | AA | A | AA | AA | AA | AA |
| HOS Property at low-speed printing (@195°C 82 rpm) | | C | A | A | A | A | A |
| Gloss at high-speed printing (@185°C 162 ppm) | % | 27 | 17 | 20 | 21 | 24 | 21 |
| | - | AA | C | A | A | A | A |

ELECTROSTATIC IMAGE DEVELOPING TONER

TECHNICAL FIELD

The present invention relates to an electrostatic image developing toner, which is used in a copying machine and an image forming device each employing an electrophotographic system.

BACKGROUND ART

With the recent popularization of a copying machine, a printer, etc., environmental standards relevant to the effect on human body in the office environment are being established mainly in Europe. Furthermore, at the time of high-speed printing, the amount of the electrostatic image developing toner consumed per unit time increases and in turn, a larger amount of a volatile organic component or powder dust diffuses. In addition, the electrophotographic process is expanding its activity area not only to letter printing, e.g., in the past office use but also to graphic use such as photographic printing, and the amount of the electrostatic image developing toner used per sheet is also increasing exponentially. Such a change in the need is accompanied by an yearly increasing requirement for an electrostatic image developing toner ensuring that even when the amount of the electrostatic image developing toner consumed per unit time is large, i.e., at the time of high-speed/mass-volume printing, a volatile organic compound or powder dust is less likely to diffuse.

In recent years, an image forming device certified by the most stringent environmental standards, "The Blue Angel", is increasing, and in an electrophotographic fixing system, it is required that a substance generated at the time of high-temperature fixing and dispersed out of the system, specifically, sublimation substance-derived powder dust (dust) and volatile organic compound, are reduced to be not more than the regulatory level specified by ECMA-328/RAL_UZ122. In Japan, the regulatory levels of RAL_UZ122 after re-revision in 2008 are directly employed as the certification standards for eco-mark on a copying machine, a complex machine, etc., and conformation to these standards is demanded.

In such a movement, for example, Patent Document 1 has proposed an electrostatic image developing toner capable of balancing the low-temperature fixability and the blocking resistance while suppressing generation of dust at the time of fixing.

PRIOR ART LITERATURE

Patent Document

Patent Document 1: JP-A-2011-81042 (the term "JP-A" as used herein means an "unexamined published Japanese patent application")

SUMMARY OF THE INVENTION

Problems that the Invention is to Solve

The electrostatic image developing toner proposed in Patent Document 1 provides a toner excellent in the low-temperature fixability and blocking resistance with suppressed dust emission at the time of fixing but cannot satisfy the hot offset resistance (high-temperature fixability). The hot offset resistance as used herein means the performance of preventing a phenomenon that when the toner is melted by heat received from the fixing device and is reduced in the viscosity, the toner attaches to the fixing roller side due to the lack of release force or internal cohesive force of toner or the toner partially spread between the fixing roller and paper returns back to the paper side, thereby generating gloss unevenness called blister and causing image deterioration. Among others, when the amount of electrostatic image developing toner attached to paper is increased in graphic use, the hot offset resistance is not practical. That is, in order to solve this problem, it is important to control the amount of a sublimable substance released from the electrostatic image developing toner (dust emission (Dt) of the electrostatic image developing toner) to fall in a specific range according to the printing speed of an image forming device in which the electrostatic image developing toner is loaded. Since the substance mainly responsible for dust emission from the toner is a wax contained in the toner, in the case of the electrostatic image developing toner with too low Dt described in Patent Document 1, wax transfer to the fixing roller or wax transfer to the belt surface is not smoothly performed, as a result, the release performance is significantly deteriorated, giving rise to occurrence of hot offset. In addition, if Dt is too large, the amount of dust dispersed per unit time exceeds the allowable limit, particularly, in a high-speed machine, as a result, the dust emission rate (Vd) exceeds the upper limit of the Blue Angel standards above.

Accordingly, it is important to control the amount of a sublimable substance released from the electrostatic image developing toner (dust emission (Dt) of the electrostatic image developing toner) to fall in a specific range according to the printing speed of an image forming device in which the electrostatic image developing toner is loaded.

However, in order to satisfy the Blue Angel standards, the dust emission (Dt) of the toner must be set generally to be low compared with the conventional electrostatic image developing toner and thereby reduce the dust emission rate (Vd).

Therefore, qualitatively, decrease in the amount of the wax component or selection of a hardly sublimable wax, compared with the conventional electrostatic image developing toner, is forced at present. In this case, for the reason above, the release force of the electrostatic image developing toner decays at the time of fixing, and this needs to be improved by other techniques.

Generally, to compensate for the decay of release force, the molecular weight of the binder resin is increased so as to raise the viscosity of the electrostatic image developing toner when heated by a fixing device or enhance the storage modulus, but in the case of a high-speed machine, the time required for sufficient heat conduction is short and since the resin particle is hardly melted, the shape of the electrostatic image developing toner remains as-is on a medium, resulting in a defect that the gloss is lost due to diffused reflection. That is, there is a dilemma that when entangling of molecules of the resin is increased to compensate for the release performance, the gloss is reduced.

In addition, a wax component with a low dust emission is generally a substance with low sublimability and for such a wax with low sublimability, a wax of a high molecular weight type (high melting point type) must be selected as the main component. However, the wax having a too high melting point is, due to its low mobility, poor in bleeding and subliming properties from the electrostatic image developing toner when the electrostatic image developing toner is heated, and this eventually causes deterioration of the hot offset performance. Furthermore, the compatibility with resin is poor due to the high molecular weight, and the plasticization performance of the resin is deteriorated, giving rise to significant reduction in, the cold offset resistance (low-temperature fixability) reformed by a rapid plasticization. Conversely, in the case of a wax having a too low melting point, for the opposite reason, the hot offset resistance may be enhanced, but the low melting point gives rise to deterioration of the storability. Accordingly, the melting point of the wax component in the state of being compatibilized with another wax or a binder resin component must be limited to a specific range.

However, even if the melting point of the wax in the state of being compatibilized with a binder resin component is limited to a specific range, qualitatively, a wax of a high molecular weight type (high melting point type) must be selected as the main component of the wax with low sublimability and therefore, the plasticization performance of the resin is deteriorated. As a result, the cold offset resistance (low-temperature fixability) is reduced and if the primary molecular chain length of the binder resin is decreased to compensate for the reduction, the hot offset performance may be deteriorated or furthermore, if Tg (glass transition temperature) of the resin is too lowered, the heat resistance and in turn, storability of the electrostatic image developing toner are deteriorated. Thus, these properties are not successfully balanced.

As described above, if Dt is too low, wax transfer to the fixing roller or wax transfer to the belt surface is not smoothly performed and since significant deterioration of the release performance results, a wax component for increasing Dt must be somewhat introduced. Many of these easily sublimable waxes generally have a small molecular weight and thanks to their high mobility, may increase the plasticization performance of resin and enhance the low-temperature fixing but may disadvantageously give rise to deterioration of the storability.

An object of the present invention is to provide an electrostatic image developing toner suitable for applications in a wide range from graphic use to normal printing use and moreover, from low-speed printing to high-speed printing, which is an electrostatic image developing toner ensuring high hot offset resistance in graphic use involving an increase in the amount of electrostatic image developing toner attached to paper while reducing the amount of dust generated during fixing, wherein the low-temperature fixability at normal (low adhesion amount) high-speed printing is improved while maintaining the storability and furthermore, the gloss at the time of high-speed printing, which is hard to achieve due to a short time of exposure to heat, is enhanced while maintaining the hot offset resistance at the time of low-speed printing where heat is applied for a long time and the hot offset resistance is thereby difficult to maintain.

Means for Solving the Problems

The present inventors have found that for reducing the amount of dust generated during printing and improving the hot offset resistance in the case of a large adhesion amount, e.g., in graphic use, it is important to control the dust emission (Dt) of the electrostatic image developing toner to fall in a specific range. The present inventors have continued intensive studies to solve the task of not only reducing the amount of dust generated during printing and improving the hot offset resistance in the case of a large adhesion amount, e.g., in graphic use, but also improving the hot offset resistance at the time of low-speed printing while keeping good storability and maintaining the low-temperature fixability at the time of normal (low adhesion amount) high-speed printing and the gloss at the time of high-speed printing. As a result, it has been newly found that in a toner capable of successfully reducing the amount of dust generated during printing and ensuring good hot offset resistance in the case of a large adhesion amount, e.g., in graphic use, namely, an electrostatic image developing toner where the dust emission (Dt) of the electrostatic image developing toner is in a specific range, when an endothermic peak or shoulder temperature of the electrostatic image developing toner, derived from, for example, enthalpy relaxation or partial crystallization of the binder resin at the time of heating, is kept in a specific very narrow range and the average value in the plateau region of tan δ (phase difference) observed only in a high frequency region of 20 rad/sec or more in the viscoelasticity measurement of the electrostatic image developing toner is kept in a specific narrow range, the task above can be solved. The present invention has been accomplished based on these findings.

That is, the gist of the present invention resides in the following [1] to [16].

[1] An electrostatic image developing toner containing a binder resin, a colorant and a wax, wherein:

at least one peak or shoulder attributable to a melting point of the wax in the state of being contained in said electrostatic image developing toner is present at 55 to 90° C. in the second elevated temperature process in thermal analysis (DSC), a dust emission (Dt) of said electrostatic image developing toner satisfies the following formula (1):

$$60 \leq Dt \leq 195{,}449/Vp - 1{,}040 \quad (1)$$

a peak or shoulder where an endothermic quantity in the second elevated temperature process in thermal analysis (DSC) decays to 80% or less of an endothermic quantity in the first elevated temperature process in thermal analysis (DSC) is present at 65.6 to 70.8° C., and an average value of tan δ in a range of an angular velocity of 20 to 100 rad/sec in a dynamic viscoelasticity measurement at 140° C. is from 1.62 to 2.20,

[in formula (1), Dt indicates a dust emission per minute (CPM) when said electrostatic image developing toner is heated, and Vp indicates a printing speed (sheets/min) in terms of A4 short side feed in an image forming device, provided that Vp is 177 or less].

[2] The electrostatic image developing toner as described in the [1] above, wherein the dust emission (Dt) of the electrostatic image developing toner satisfies the following formula (2):

$$60 \leq Dt \leq 117{,}262/Vp - 1{,}039 \quad (2)$$

[in formula (2), Dt indicates a dust emission per minute (CPM) when said electrostatic image developing toner is heated, and Vp indicates a printing speed (sheets/min) in terms of A4 short side feed in an image forming device, provided that Vp is 106 or less].

[3] The electrostatic image developing toner as described in the [1] or [2] above, wherein the dust emission (Dt) of the electrostatic image developing toner satisfies the following formula (3):

$$60 \leq Dt \leq 71{,}653/Vp - 1{,}039 \quad (3)$$

[in formula (3), Dt indicates a dust emission per minute (CPM) when said electrostatic image developing toner is heated, and Vp indicates a printing speed (sheets/min) in terms of A4 short side feed in an image forming device, provided that Vp is 65 or less].

[4] The electrostatic image developing toner as described in the [1] to [3] above, wherein the dust emission (Dt) of the electrostatic image developing toner satisfies the following formula (4):

$$60 \leq Dt \leq 52{,}104/Vp - 1{,}039 \quad (4)$$

[in formula (4), Dt indicates a dust emission per minute (CPM) when said electrostatic image developing toner is heated, and Vp indicates a printing speed (sheets/min) in terms of A4 short side feed in an image forming device, provided that Vp is 47 or less].

[5] The electrostatic image developing toner as described in any one of the [1] to [4] above, wherein a peak or shoulder where an endothermic quantity in the second elevated temperature process in thermal analysis (DSC) decays to 80% or less of an endothermic quantity in the first elevated temperature process in thermal analysis (DSC) is present at 66.5 to 69.6° C.

[6] The electrostatic image developing toner as described in any one of the [1] to [5] above, wherein the average value of tan δ in a range of an angular velocity of 20 to 100 rad/sec in a dynamic viscoelasticity measurement at 140° C. is from 1.82 to 2.13.

[7] The electrostatic image developing toner as described in any one of the [1] to [6] above, wherein the plasticization initiating temperature determined by dynamic viscoelasticity measurement is from 73.5 to 80.5° C.

[8] The electrostatic image developing toner as described in the [7] above, wherein the plasticization initiating temperature determined by dynamic viscoelasticity measurement is from 74.8 to 79.2° C.

[9] The electrostatic image developing toner as described in any one of the [1] to [8] above, wherein said printing speed Vp in terms of A4 short side feed in an image forming device is 20 or more.

[10] The electrostatic image developing toner as described in the [9] above, wherein said printing speed Vp in terms of A4 short side feed in an image forming device is 30 or more.

[11] The electrostatic image developing toner as described in any one of the [1] to [10] above, which comprises two or more waxes, wherein one or more peaks or shoulders attributable to a melting point of a wax in the state of being contained in said electrostatic image developing toner are present in each of a range from 55 to 73° C. and a range from 77 to 90° C.

[12] The electrostatic image developing toner as described in any one of the [1] to [11] above, wherein said electrostatic image developing toner satisfies the following requirements (a) to (c):

(a) said electrostatic image developing toner contains at least two kinds of waxes of a wax component X and a wax component Y, (b) a dust emission of said wax component Y is larger than a dust emission of said wax component X, and (c) a content of said wax component X is larger than a content of said wax component Y.

[13] The electrostatic image developing toner as described in the [12] above, wherein a ratio of said wax component Y in all wax components is from 0.1 mass % to less than 10 mass %.

[14] The electrostatic image developing toner as described in any one of the [1] to [13] above, wherein said electrostatic image developing toner satisfies the following requirements (a), (b) and (d):

(a) said electrostatic image developing toner contains at least two kinds of waxes of a wax component X and a wax component Y, (b) a dust emission of said wax component Y is larger than a dust emission of said wax component X, and (d) a dust emission of said wax component X is 50,000 CPM or less and a dust emission of said wax component Y is 100,000 CPM or more.

[15] The electrostatic image developing toner as described in any one of the [12] to [14] above, wherein said electrostatic image developing toner has a region in which an abundance ratio of the wax component Y is higher than that of the wax component X, and said region in the outer wall side of said electrostatic image developing toner is larger than in the center side of said electrostatic image developing toner.

[16] The electrostatic image developing toner as c described in any one of the [12] to [15] above, wherein said electrostatic image developing toner has a shell-core structure, said wax contained in the shell material of said shell-core structure contains substantially only said wax component Y, and said wax contained in the core material of said shell-core structure contains substantially only said wax component X.

Advantage of the Invention

According to the present invention, there can be provided an electrostatic image developing toner suitable for applications in a wide range from graphic use to normal printing use and moreover, from low-speed printing to high-speed printing, wherein not only the hot offset resistance in graphic use involving an increase in the amount of electrostatic image developing toner attached to paper is improved while reducing the amount of dust generated during printing and furthermore, the low-temperature fixability at normal (low adhesion amount) high-speed printing is improved while maintaining the storability, but also the hot offset resistance at the time of low-speed printing where heat is applied for a long time and the hotoffset resistance is thereby difficult to maintain, is enhanced while maintaining the gloss at the time of high-speed printing, which is hard to achieve due to a short time of exposure to heat.

BRIEF DESCRIPTION OF THE DRAWINGS

FIG. 11 shows measurement results of various toners for development (D1-D13) (Table 1).

FIG. 12 shows measurement results of various toners for development (D1-D13) (Table 2)

MODE FOR CARRYING OUT THE INVENTION

Figure 1:
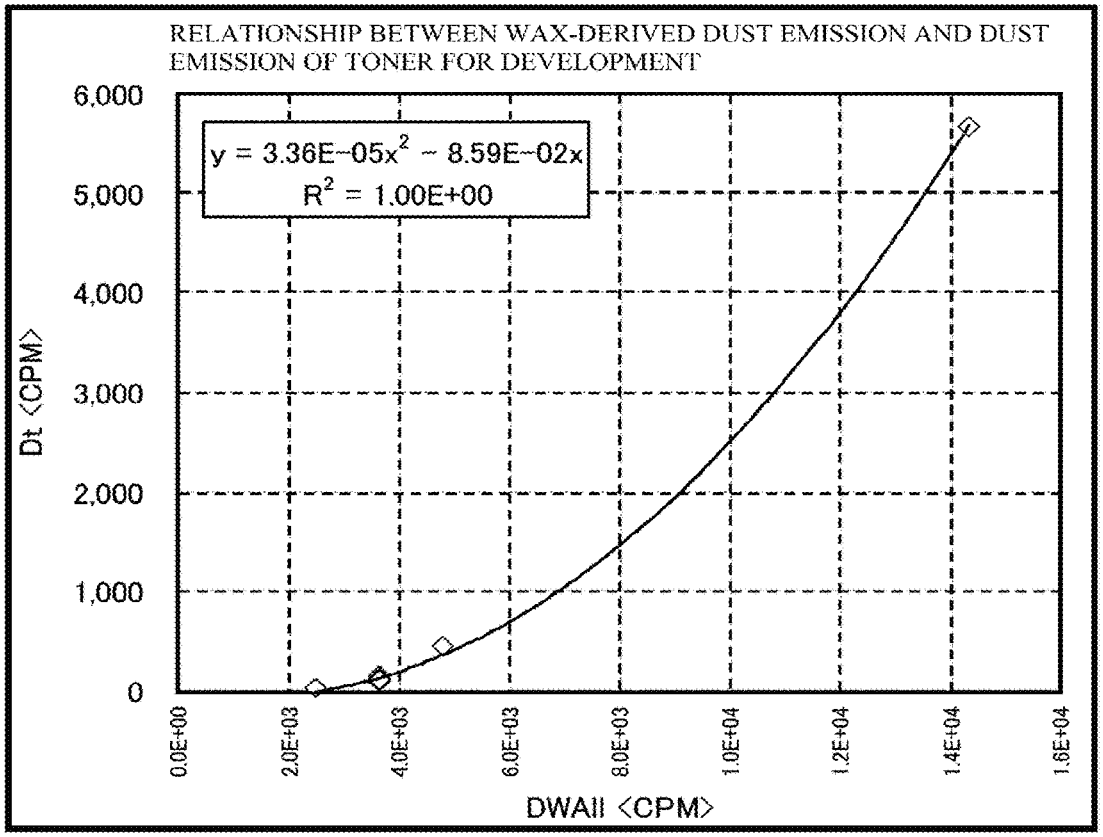
FIG. 1 is a graph showing the relationship between wax-derived dust emission ($Dw_{All}$) and dust emission (Dt) of the electrostatic image developing toner.

The present invention is described below, but the present invention is not limited to the following embodiments and can be carried out by making arbitrary modifications therein. Here, "wt %" and "parts by weight" have the same meanings as "mass %" and "parts by mass", respectively.

The method for producing the electrostatic image developing toner (hereinafter, sometimes simply referred to as "developing toner" or "toner") of the present invention is not particularly limited, and it may be sufficient if the configuration described below is employed in the production method of a wet-process toner or a pulverization toner.

The toner of the present invention is, as a premise, a toner where at least one peak or shoulder attributable to the melting point of the wax in the state of being contained in the toner is present at 55 to 90° C. in the second elevated temperature process in thermal analysis (DSC) and the dust emission (Dt) of the toner satisfies the range described in detail below, and among toners satisfying these conditions, the toner of the present invention is obtained by a toner having a configuration where a peak or shoulder exhibiting a decay of the endothermic quantity in the second elevated temperature process in DSC to 80% or less of the endothermic quantity in the first elevated temperature process in DSC appears at 65.6 to 70.8° C. and the average value of tan δ in the range of an angular velocity of 20 to 100 rad/sec in the dynamic viscoelasticity measurement at 140° C. is from 1.62 to 2.20.

<1. Toner Dust Emission (Dt) and Method for Controlling Toner Dust Emission (Dt)>

The toner dust emission (Dt) as a premise of the present invention and the method for controlling the toner dust emission (Dt) at the time of production of a toner are described in detail below.

(1-1. Re: Toner Dust Emission (Dt))

The present invention is an electrostatic image developing toner containing a binder resin, a colorant and a wax, on the premise that at least one melting point of the wax in the state of being contained in the electrostatic image developing toner is present at 55 to 90° C. and the dust emission (Dt) of the electrostatic image developing toner satisfies the following formula (1):

$$60 \leq Dt \leq 195{,}449/Vp - 1{,}040 \quad (1)$$

[wherein Dt indicates a dust emission (CPM (measured value in 1 minute: Counter Per Minute)) when the toner is heated in a static environment, and Vp indicates a printing speed (sheets/min) in terms of A4 short side feed in an image forming device, provided that Vp is 177 or less]. Substituting in the above formula, when Vp=20, 60≤Dt≤8732, when Vp=36, 60≤Dt≤4389, when Vp=30, 60≤Dt≤5475, and when Vp=177, 60≤Dt≤64.

Here, the toner dust means a substance to be released and generated from the toner when the toner is heated, and the toner dust emission (Dt) is a value obtained by measuring the electrostatic image developing toner by means of a dust counter (Digital Dust Monitor LD-3K2 manufactured by SIBATA Scientific Technology Ltd.) according to the method described in Examples later.

The image forming device at Vp indicates a printer, a copying machine, a facsimile, etc.

The printing speed (sheets/min) in terms of A4 short side feed for standardizing Vp indicates the number of sheets that can be printed per minute by an image forming device having loaded therein the electrostatic image developing toner of the present invention when printing is performed on paper with a sheet size of A4 in the short axis direction. Since the A4 size is 297 mm×210 mm, the A4 short side is 210 mm long.

As the wax, it is essential to contain a wax having a melting point of 90° C. or less in the state of being contained in the toner (hereinafter, simply referred to as the melting point of wax) so as to impart satisfactory fixability to the electrostatic image developing toner. This is because no matter how the sublimation energy is low, a wax having a too high melting point diffuses at a low speed from the toner when the toner is melted in a fixing device, and the wax is eventually not transferred to the toner surface, making it impossible to impart sufficient release performance.

Furthermore, a wax having a too low melting point gives rise to reduction in the heat resistance of the toner and cannot be used due to a fear of causing a problem of blocking, etc. during transportation, and for this reason, it is essential to contain a wax having a melting point 55° C. or more.

The melting point of the wax itself is from 55 to 90° C. Here, the melting point of the wax in the state of being contained in the electrostatic image developing toner is a value measured by the method described in Examples later, i.e., a method of measuring the wax by means of a thermal analyzer (DSC) in the state where a peak (heat history) derived from the enthalpy relaxation at the glass transition point of the resin in the toner is caused to disappear.

The value 60 on the left-hand side of formula (1) is the lower limit of the toner dust emission (Dt), that hot offset is not caused. In other words, if the dust emission (Dt) of the electrostatic image developing toner is less than 60, the absolute amount of the releasing component mainly composed of a wax undergoing sublimation on the fixing roller surface from the electrostatic image developing toner electrostatically attached to paper is too small to impart a sufficient release performance and therefore, hot offset occurs.

The left-hand side of formula (1) is the lower limit of the toner dust emission (Dt), that hot offset is not caused.

For example, in Reference Examples described later, the lower limit of the toner Dt satisfying the high adhesion-amount HOS property is 112 that is shown in Reference Example 2. Furthermore, Dt failing in satisfying the high adhesion-amount HOS property is 21 that is shown in Reference Example 4. The intermediate value of these two values is (112+21)/2=66.5.

On the other hand, since the measurement accuracy of the dust counter (Digital Dust Monitor LD-3K2 manufactured by SHIBATA Scientific Technology Ltd.) with which the toner dust emission is measured in Examples and Comparative Examples in the present invention is ±10%, the numerical value, i.e., 66.5×0.9=60, obtained by multiplying 66.5 by 0.9 that is a possible value in view of measurement accuracy, is taken as the lower limit of the toner dust emission.

In the present invention, for example, the dust detection/measuring device disclosed in JP-A-2010-2338 is used, and the amount of dust dispersed by means of the dust detection/measuring device is measured using a dust counter (Digital Dust Monitor LD-3K2 manufactured by SIBATA Scientific Technology Ltd.), whereby the toner dust emission (Dt) can be determined.

The right-hand side of formula (1) is determined from the toner dust emission upper limit (DtL) necessary to reduce the amount of dust generated per hour (dust emission rate: Vd) at the time of continuous printing in an image forming device to 3.0 or less. The numerical expression 195,449/Vp−1,040 on the right-hand side is a function necessarily determined from the measured values of dust emission (Dt) and dust emission rate (Vd) of the electrostatic image developing toner as measured under the condition described in Examples.

The lower limit on the left-hand side of formula (1) differs depending on the environment of dust dispersion from the toner and on the dust detection/measuring device, and the numerical value on the right-hand side of formula (1) varies according to the preset value of the amount of dust generated per hour (dust emission rate: Vd) at the time of continuous printing in an image forming device. In the case where the environment of dust dispersion from the toner or the dust detection/measuring device are set to the same conditions, even in an image forming device differing in the printing speed (Vp), as long as the conditions of formula (1) are satisfied, occurrence of hot offset can be prevented while suppressing generation of dust at the time of fixing.

The function on the right-hand side is described below.

Figure 4:
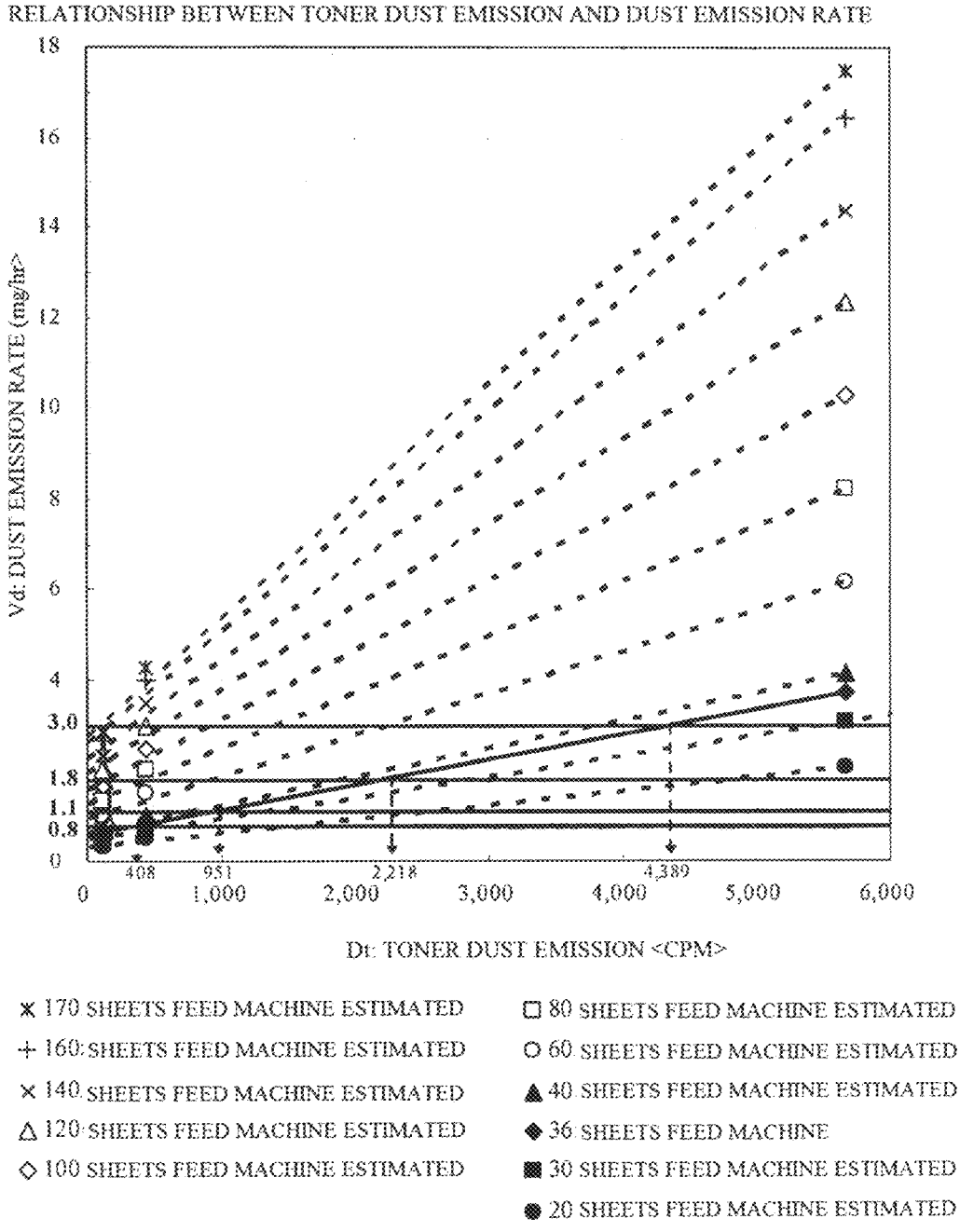
FIG. 4 is a graph showing the relationship between dust emission (Dt) of the electrostatic image developing toner and dust emission rate (Vd) from an image forming device, where the abscissa indicates the dust emission (Dt) when the toner is heated in a static environment and the ordinate indicates the amount of dust generated per hour (dust emission rate: Vd) at the time of continuous printing in an image forming device.

FIG. 4 is a graph showing the relationship between dust emission (Dt) of the electrostatic image developing toner and dust emission rate (Vd) from an image forming device. The abscissa indicates the dust emission (Dt) when the toner is heated in a static environment, and the ordinate indicates the amount of dust generated per hour (dust emission rate: Vd) at the time of continuous printing in an image forming device. The rightward rising diagonal solid line in the drawing is drawn by connecting measured values at four points (Example 1 and Reference Examples 1 to 3) in continuously printing at a printing speed of 36 sheets in terms of A4 short side feed per minute (Vp=36) by a straight line in a primarily linear fashion using the least-squares method. The primary linear expression is $Vd=5.53\times10^{-4}\times Dt+0.574$, and the square of the correlation coefficient thereof is 0.999. Accordingly, it is understood that the amount of dust generated from an image forming device (dust emission rate: Vd) is proportional in primarily linear fashion to the toner dust emission (Dt). Here, as for the amount of dust (dust emission rate: Vd), the dust collected according to the measurement method certified by Blue Angel Mark (RAL UZ122 2006) is measured by the method described in Examples later.

Furthermore, as described above, an image forming device of printing a large number of sheets per unit time consumes a large amount of the electrostatic image developing toner, leading to an increase in the amount of dust per unit time, and the amount of dust (dust emission rate: Vd) is proportional to the printing speed.

For example, in a device of printing one sheet in one minute and a device of printing two sheets in one minute, the amount of toner consumed by the latter is doubled, and this means that the amount of dust generated from the image forming device is also doubled. In other words, when proportional calculation of the amount of dust generated from the image forming device (dust emission rate: Vd) that is increased or decreased in the printing speed is performed using the measured values of the dust emission (Dt) of the electrostatic image developing toner subjected to continuous printing at a printing speed of 36 sheets/min and the amount of dust generated from the image forming device (dust emission rate: Vd) using this electrostatic image developing toner and the calculated values are connected in a primary linear fashion by the least-squares method, the drawn line is the dotted line in FIG. 4.

Giving more detailed description, in FIG. 4, in the case of an electrostatic image developing toner configured such that the dust emission rate (Vd) of the image forming device at a printing speed of 36 sheets/min in terms of A4 short side feed shown by the solid line becomes 3.7 (mg/hr), the measured value of the dust emission (Dt) of the electrostatic image developing toner is 5,665 (CPM). Assuming that this electrostatic image developing toner is used and the printing speed in terms of A4 short side feed is increased to 120 sheets/min, the amount of dust generated from the image forming device (dust emission rate: Vd) using this toner for development is proportional to the increased printing speed and therefore, is (120/36)×3.7=12.3 (mg/hr). Since the dust emission (Dt) of the electrostatic image developing toner is 5,665 (CPM), in FIG. 4, a Δ (triangle) dot is marked on the point where the abscissa (toner dust emission: Dt) is 5,665 and the ordinate (dust emission rate: Vd) is 12.3.

In this way, the solid line in FIG. 4 is a line drawn by connecting respective measurement results in Example 1 and Reference Examples 1 to 3 described later, in a primary linear fashion by use of a least-squares method, based on the toner dust emission (Dt) actually measured at a printing speed of 36 sheets/min in terms of A4 short side feed and the dust emission rate (Vd) per hour of the image forming device using the toner.

The dotted line is a line drawn based on the actually measured results by performing proportional calculation of the amount of dust generated from the image forming device (dust emission rate: Vd) that is increased or decreased in the printing speed, and shows the relationship between the toner dust emission (Dt) at each printing speed (Vp) and the dust emission rate (Vp) from the image forming device.

Furthermore, in FIG. 4, a horizontal line at Vd=3.0 is drawn. The abscissa value of the coordinates of intersections of this horizontal line with the dotted or solid line establishing, in a primary linear fashion using the least-squares method, the relationship between the toner dust emission (Dt) and the dust emission rate (Vd) from the image forming device indicates the toner dust emission upper limit (DtL) when the dust emission rate (Vd) is set to a specific value of 3.0 or less.

Figure 5:
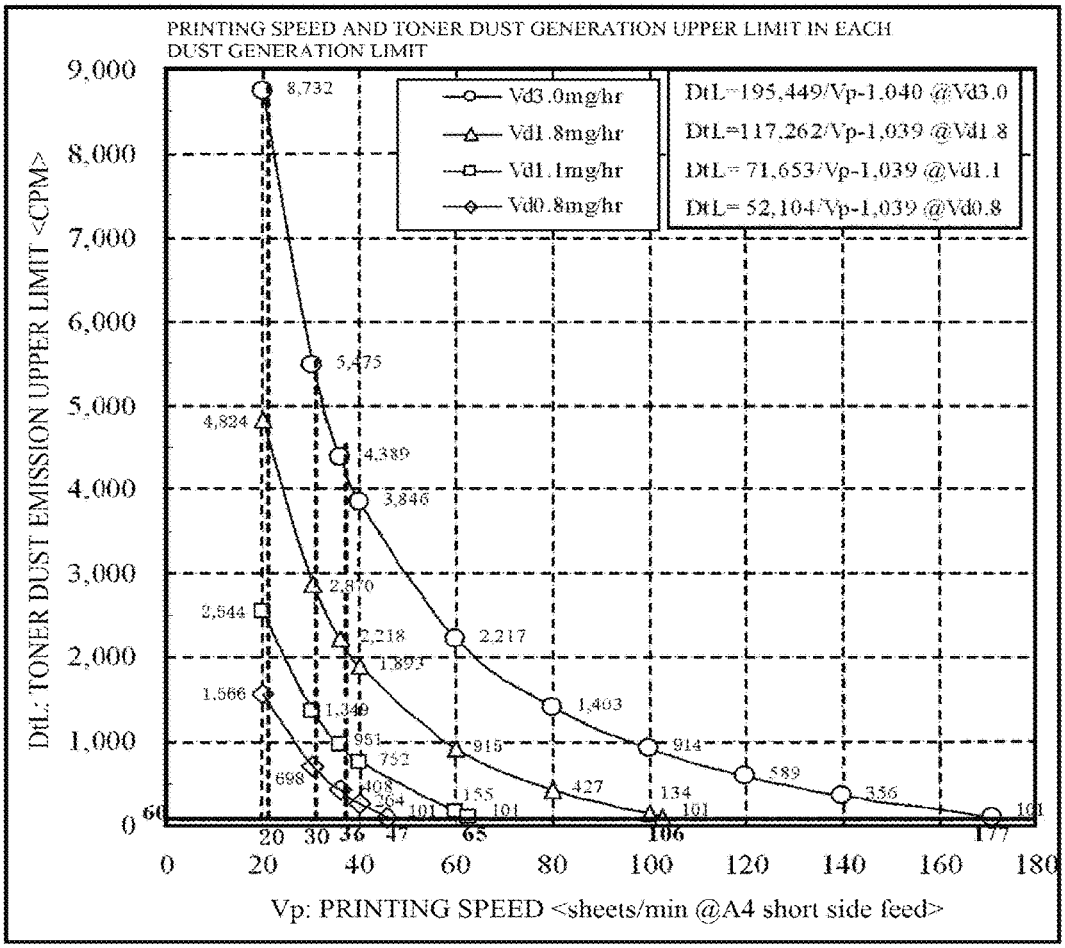
FIG. 5 is a graph showing the relationship between printing speed (Vp) and toner dust emission upper limit (DtL), where the abscissa indicates each printing speed (Vp) in terms of A4 short side feed and the ordinate indicates the toner dust emission upper limit (DtL).

In FIG. 5, the abscissa indicates each printing speed (Vp), and the ordinate indicates the toner dust emission upper limit (DtL). As shown in FIG. 5, since the amount of the electrostatic image developing toner consumed per unit time increases as the printing speed becomes higher, it is clearly understood that for controlling the dust emission not to exceed a specific value (for example, the regulatory level), the upper limit of the amount of dust dispersed from the electrostatic image developing toner per unit mass must also be set to a small value.

When the relationship in FIG. 5 between the printing speed (Vp) and the toner dust emission upper limit (DtL), which are marked with ○ (circular) dots, is expressed by an inversely proportional formula using the least-squares method, a formula of toner dust emission upper limit DtL=195,449/Vp−1,040 is established. This is the toner dust emission upper limit (DtL) at each printing speed (Vp), and the right-hand side of formula (1) corresponds thereto.

The amount of dust generated per hour (dust emission rate: Vd) at the time of continuous printing in an image forming device preferably takes a smaller value, and in order for the preferable dust emission rate (Vd) to satisfy a specific value of 1.8 or less, the dust emission (Dt) from the electrostatic image developing toner preferably satisfies formula (2):

$$60 \leq Dt \leq 117{,}262/Vp - 1{,}039 \quad (2)$$

Formula (2) is a requirement for controlling the amount of dust generated per hour (dust emission rate: Vd) from an image forming device to a preferable specific value of 1.8 or less, and similarly to the method for determining formula (1), the formula is a function necessarily determined from the measured values of dust emission (Dt) of the electrostatic image developing toner and dust emission rate (Vd), which are described in Examples.

In formula (2), Dt indicates a dust emission per minute (CPM) when the electrostatic image developing toner is heated, and Vp indicates a printing speed (sheets/min) in terms of A4 short side feed in an image forming device, provided that Vp is 106 or less.

Specifically, in FIG. 4, the abscissa value of the coordinates of intersections of the horizontal line at Vd=1.8 with the dotted line establishing, in a primary linear fashion using the least-squares method, the relationship between the toner dust emission (Dt) and the dust emission rate (Vd) from the image forming device indicates the toner dust emission upper limit (DtL) when the dust emission rate (Vd) is set to a specific value of 1.8 or less. As shown in FIG. 5, when the value of each printing speed (Vp) on the abscissa and the value of each toner dust emission upper limit (DtL) on the ordinate are marked with Δ (triangle) dots and the printing speed (Vp) and the toner dust emission upper limit (DtL), which are marked with Δ, are expressed by an inversely proportional formula using the least-squares method, a formula of toner dust emission upper limit DtL=117,262/(Vp−1,039) is established. This is the relationship of the toner dust emission upper limit (DtL) at each printing speed (Vp), corresponding to the right-hand side of formula (2).

In order to control the amount of dust generated per hour (dust emission rate), Vd, at the time of continuous printing in an image forming device to a more preferable value of 1.1 or less, Dt more preferably satisfies formula (3):

$$60 \leq Dt \leq 71{,}653/Vp - 1{,}039 \quad (3)$$

Formula (3) is a requirement for controlling the amount of dust generated per hour (dust emission rate: Vd) from an image forming device to a preferable specific value of 1.1 or less, and likewise the method for determining formula (1), the formula is a function necessarily determined from the measured values of dust emission (Dt) of the electrostatic image developing toner and dust emission rate (Vd), which are described in Examples.

In formula (3), Dt indicates a dust emission per minute (CPM) when the electrostatic image developing toner is heated, and Vp indicates a printing speed (sheets/min) in terms of A4 short side feed in an image forming device, provided that Vp is 65 or less.

Specifically, in FIG. 4, the abscissa value of the coordinates of intersections of the horizontal line at Vd=1.1 with the dotted line establishing, in a primary linear fashion using the least-squares method, the relationship between the toner dust emission (Dt) and the dust emission rate (Vd) from the image forming device indicates the toner dust emission upper limit (DtL) when the dust emission rate (Vd) is set to a specific value of 1.1 or less. As shown in FIG. 5, when the value of each printing speed (Vp) on the abscissa and the value of each toner dust emission upper limit (DtL) on the ordinate are marked with □ (square) dots and the printing speed (Vp) and the toner dust emission upper limit (DtL), which are marked with □ dots, are expressed by an inversely proportional formula using the least-squares method, a formula of toner dust emission upper limit DtL=71,653/Vp−1,039 is established. This is the relationship of the toner dust emission upper limit (DtL) at each printing speed (Vp), corresponding to the right-hand side of formula (3).

In order to control the amount of dust generated per hour (dust emission rate) (Vd) at the time of continuous printing in an image forming device to a most preferable value of 0.8 or less, the toner dust emission (Dt) still more preferably satisfies formula (4):

$$60 \leq Dt \leq 52{,}104/Vp - 1{,}039 \quad (4)$$

Formula (4) is a requirement for controlling the amount of dust generated per hour (dust emission rate: Vd) from an image forming device to a preferable specific value of 0.8 or less, and likewise the method for determining formula (1), the formula is a function necessarily determined from the measured values of dust emission (Dt) of the electrostatic image developing toner and dust emission rate (Vd), which are described in Examples. Specifically, in FIG. 4, the abscissa value of the coordinates of intersections of the horizontal line at Vd=0.8 with the dotted line establishing, in a primary linear fashion using the least-squares method, the relationship between the toner dust emission (Dt) and the dust emission rate (Vd) from the image forming device indicates the toner dust emission upper limit (DtL) when the dust emission rate (Vd) is set to a specific value of 0.8 or less. As shown in FIG. 5, when the value of each printing speed (Vp) on the abscissa and the value of each toner dust emission upper limit (DtL) on the ordinate are marked with ♦ (diamond) dots and the printing speed (Vp) marked with a ♦ (diamond) dot is expressed by an inversely proportional formula using the least-squares method, a formula of toner dust emission upper limit DtL=52,104/Vp−1,039 is established. This is the relationship of the toner dust emission upper limit (DtL) at each printing speed (Vp), corresponding to the right-hand side of formula (4).

In formula (4), Dt indicates a dust emission per minute (CPM) when the electrostatic image developing toner is heated, and Vp indicates a printing speed (sheets/min) in terms of A4 short side feed in an image forming device, provided that Vp is 47 or less.

(1-2. Method for Controlling Toner Dust Emission (Dt) to Satisfy Formulae (1) to (4))

In order for the dust emission Dt of the electrostatic image developing toner to satisfy the range of formula (1), this may be attained by selecting the wax, binder resin, colorant, external additive and other substances and controlling the amounts added thereof. In particular, since the main cause of dust is wax, the dust emission Dt of the electrostatic image developing toner can be adjusted to fall in the range of formula (1) by selecting a substance suitable for the wax in view of sublimation energy and controlling the amount added thereof.

Likewise, in order for the dust emission Dt to satisfy the range of formula (2), it is preferable to select a wax smaller in the dust generation amount than the wax selected in formula (1) or reduce the amount of the wax added.

In addition, in order for the dust emission Dt to satisfy the range of formula (3), it is preferable to select a wax smaller in the dust generation amount than the wax selected in formula (2) or reduce the amount of the wax added.

Furthermore, in order for the dust emission Dt to satisfy the range of formula (4), it is preferable to select a wax smaller in the dust generation amount than the wax selected in formula (3) or reduce the amount of the wax added.

An electrostatic image developing toner satisfying formula (2) may be more preferred than an electrostatic image developing toner satisfying only formula (1), from the standpoint that the dust emission rate can be reduced in a high-speed image forming device (the printing speed per unit time is high). Likewise, an electrostatic image developing toner satisfying formula (3) may be more preferred than an electrostatic image developing toner satisfying only formulae (1) and (2), and an electrostatic image developing toner satisfying formula (4) may be more preferred than an electrostatic image developing toner satisfying formulae (1) to (3), from the standpoint that the dust emission rate can be more reduced in a high-speed image forming device (the printing speed per unit time is high).

In order for the dust emission Dt of the electrostatic image developing toner to satisfy the range of formula (1), this may be attained by configuring the electrostatic image developing toner according to the following method (I) or (II).

(I) The electrostatic image developing toner containing a binder resin, a colorant, and a wax having at least one melting point at 55 to 90° C. in the state of being contained in the electrostatic image developing toner is configured to satisfy the following (a) to (c):

(a) the electrostatic image developing toner contains at least two kinds of waxes, i.e., a wax component X and a wax component Y, (b) the dust emission of the wax component Y is larger than the dust emission of the wax component X, and (c) the content of the wax component X is larger than the content of the wax component Y.

(II) The electrostatic image developing toner containing a binder resin, a colorant, and a wax having at least one melting point at 55 to 90° C. in the state of being contained in the electrostatic image developing toner is configured to satisfy the following (a), (b) and (e):

(a) the electrostatic image developing toner contains at least two kinds of waxes, i.e., a wax component X and a wax component Y, (b) the dust emission of the wax component Y is larger than the dust emission of the wax component X, and (e) the balance between the wax component X and the wax component Y is adjusted in terms of wax dust emission and wax content.

The wax dust emission and the wax content in (b) and (c) above are described in detail.

Assuming that the wax dust emission of the wax component X is $Dw_X$ and the wax dust emission of the wax component Y is $Dw_Y$ and that the concentrations of these wax components in the electrostatic image developing toner are $Cw_X$ and $Cw_Y$, respectively, the following formula:

$$Dw_{All}=\Sigma Dw_n \cdot Cw_n/100=(Dw_X \times Cw_X+Dw_Y \times Cw_Y)/100 \quad (5)$$

is considered.

In formula (5), $Dw_{All}$ indicates a wax-derived dust emission and is a value derived by calculation, and this is a value showing to what extent the emission reaches when all wax components contained in the toner are dispersed, namely, the value is a product of the emission at the time of dispersion of a single wax and the content, in the toner, of the wax giving the emission. In the case where a plurality of waxes, like the wax component X and the wax component Y, are caused to be present as the wax in the toner, the sum of the products thereof is $Dw_{All}$.

The definition and measurement method of the dust emission of the wax are as described in Examples.

The concentration of the wax in the electrostatic image developing toner can be calculated from the blending formulation.

In FIG. 1, the value of $Dw_{All}$ (CPM) in each of Examples 1 to 5, Comparative Examples 1 to 4 and Reference Examples 1 to 4 which are described later, is taken on the abscissa, and Dt (dust emission per minute when the electrostatic image developing toner is heated) is taken on the ordinate.

Least-squares fitting of a quadratic function with intercept of zero leads to the following formula:

$$Dt=3.36\times10^{-5}\times Dw_{All}^2-8.59\times10^{-2}\times Dw_{All}(R^2=1.00) \quad (6)$$

Since the square of the correlation coefficient is 1.00, it is understood that the dust emission Dt generated from the toner is determined almost by $Dw_{All}$, i.e., the dust emission of the wax existing in the toner and the content of the wax existing in the toner.

Figure 2:
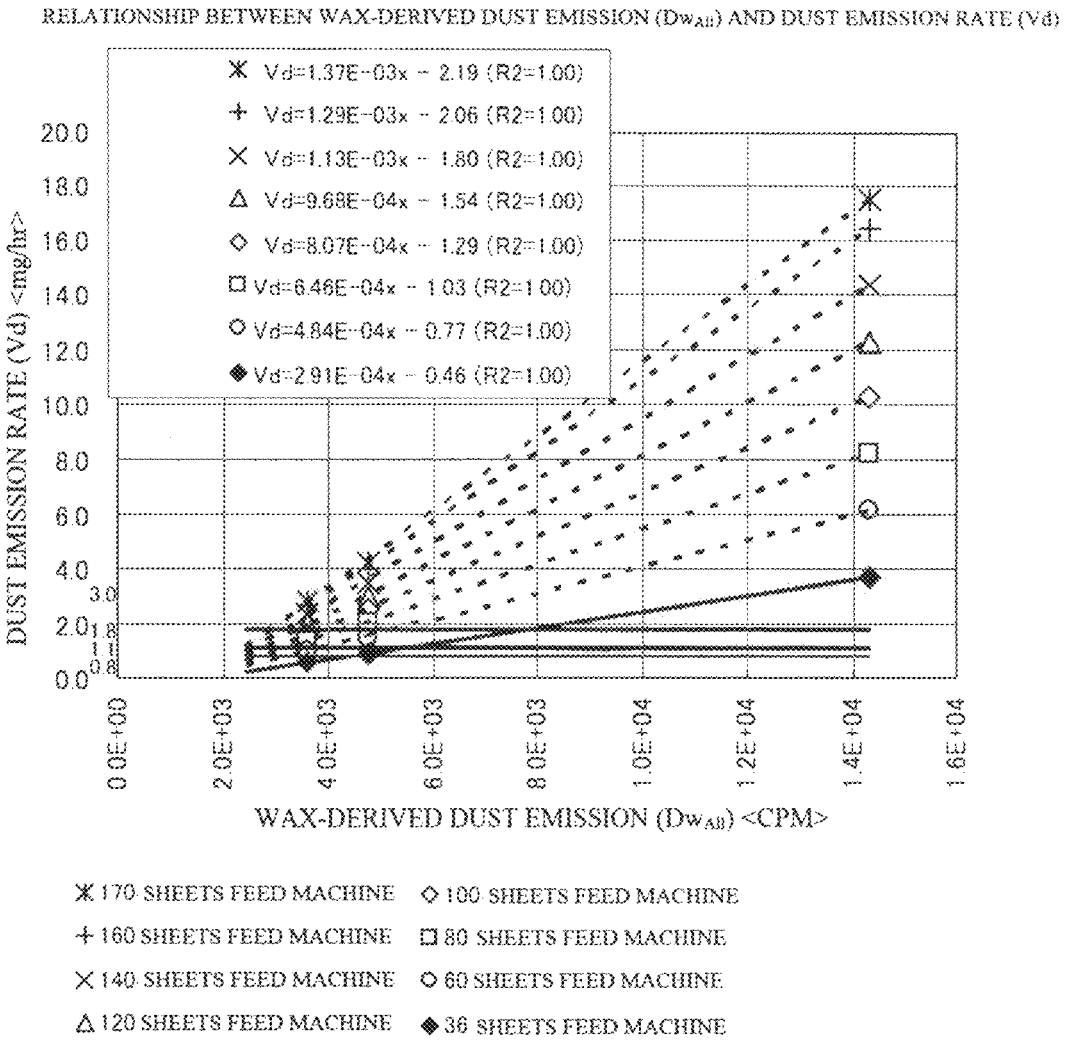
FIG. 2 is a graph showing the relationship between wax-derived dust emission ($Dw_{All}$) and dust emission rate (Vd).

Next, when Dt is converted to $Dw_{All}$ by referring to FIG. 4 described later and the relationship with the dust emission rate Vd is examined, it is understood that the relationship can be fitted in a primary linear fashion as shown in FIG. 2. Here, since the square of the correlation coefficient is 1.00, it has been found that Vd and $Dw_{All}$ show a very high correlativity with each other.

Furthermore, similarly to FIG. 4, when a horizontal line is drawn at Vd values of 3.0, 1.8, 1.1 and 0.8 that are a critical point of the dust emission rate Vd in the present invention, the value on the X-coordinate at the intersection of the horizontal line with the line in a primary linear fashion is the maximum value of the wax-derived dust emission $Dw_{All}$ according to the printing speed of each image forming device.

Figure 3:
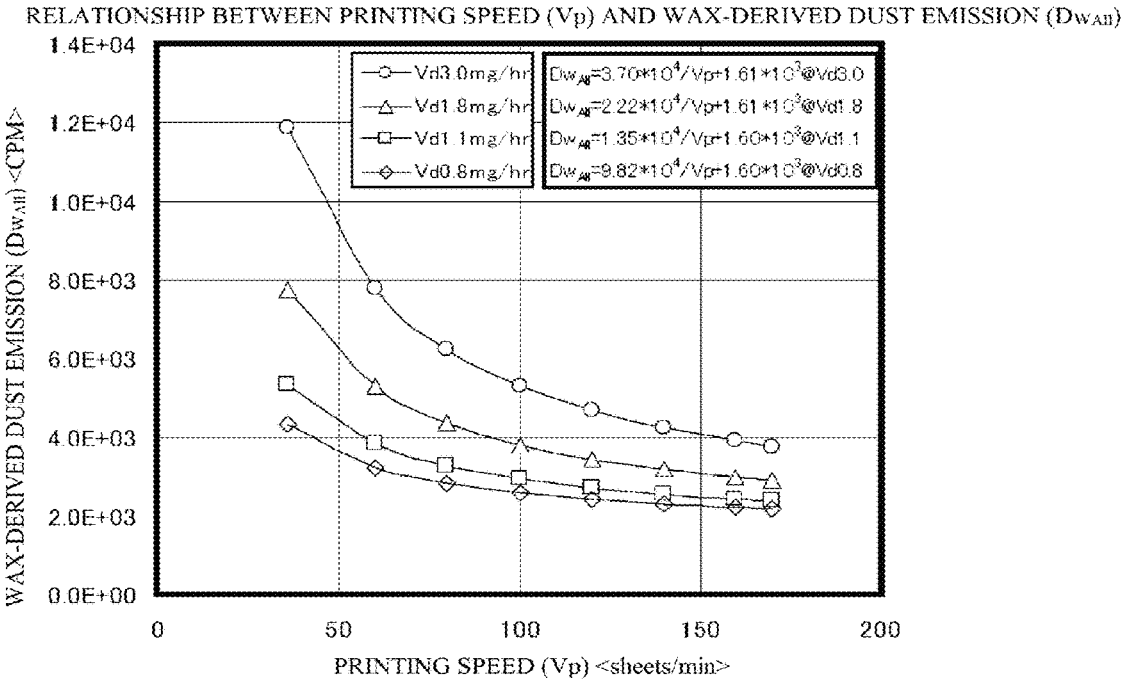
FIG. 3 is a graph showing the relationship between printing speed (Vp) and wax-derived dust emission ($Dw_{All}$).

FIG. 3 shows a view plotting the maximum value of $Dw_{All}$ as the intersection on the ordinate and plotting the printing speed Vp at that time on the abscissa. As described above, Dt and $Dw_{All}$ are correlated with each other and are defined unambiguously, and therefore, FIG. 3 is the same as FIG. 5 described later where Dt is converted to $Dw_{All}$.

In FIG. 3, $Dw_{All}$ has the form of a function inversely proportional to Vp, similarly to FIG. 5, and since the square of the correlation coefficient is also 1.00, it may be said that there is a very good correlation.

In other words, when the printing speed of a designed image forming device is determined, the upper limit of the wax-derived dust emission $Dw_{All}$ can be derived therefrom for each allowable value of the dust emission rate Vd from the image forming device.

Taking these together, the qualitative tendency of the dust emission Dt of the electrostatic image developing toner so as to satisfy the range of formula (1) is as follows:

(A) when the dust emission of the wax is large, the hot offset resistance (HOS) is improved but on the other hand, the dust emission rate Vd from an image forming device increases, (B) when the wax content is large, HOS is improved but on the other hand, the dust emission rate Vd from an image forming device increases, (C) when the dust emission of the wax is too small, HOS is deteriorated, but the dust emission rate Vd from an image forming device decreases, (D) when the wax content is too small, HOS is deteriorated, but the dust emission rate Vd from an image forming device decreases, (E) when the printing speed Vp is low, the amount of dust generated per unit time decreases and Vd lowers, (F) when the printing speed Vp is high, the amount of dust generated per unit time increases and Vd rises, and (G) when the threshold level of Vd is lowered, a wax having a large dust emission is difficult to select and furthermore, the wax concentration in the toner is also difficult to increase, as a result, the printing speed can be hardly increased.

On account of these, for obtaining the toner as a premise of the present invention, it is important to control the dust emission Dt of the toner. To this end, it can be said that selection of the wax and control of the wax content are most important.

Next, the maximum allowable value of the wax content when selecting an arbitrary wax is described.

First, the printing speed Vp in an image forming device is set to an arbitrary value. This is a design requirement of an image forming device, and the dust emission rate Vd from the image forming device at that printing speed must be kept to 3.0 or less.

Since Vp is the value on the X-axis of FIG. 3, the value on the Y-axis in the curve of Vd=3.0 mg/hr is also determined (in FIG. 3, circle mark: ○). When the value on the Y-axis is determined, the maximum amount of the wax-derived dust emission ($Dw_{All}$) permitted for achieving the dust emission rate (Vd) from the image forming device of 3.0 mg/hr or less is determined.

Subsequently, the dust emission (Dw) of the wax used is measured by the method described in Examples.

Consequently, the values of Dw and $Dw_{All}$ are determined. The relational expression of formula (5) when simplified becomes $Cw=Dw_{All}/Dw$ and therefore, Cw is determined by assigning the actual values to $Dw_{All}$ and Dw.

As a result, the maximum allowable concentration of the wax (maximum allowable wax amount) in the toner, which is permitted for achieving the dust emission rate (Vd) of 3.0 mg/hr or less when arbitrary Vp is set, can be derived.

Here, when the derivation method above is simplified, the maximum allowable wax can be determined through the following procedure:

(a-1) Vp is set to an arbitrary value, (a-2) Vp set in (a-1) above is assigned to the numerical expression of $Dw_{All}=3.70\times10^4/Vp+1.61\times10^3$ of FIG. 3 to determine $Dw_{All}$, (a-3) the dust emission (Dw) of the wax used is measured by the method described in of Examples, and (a-4) $Dw_{All}$ determined in (a-2) above and Dw measured in (a-3) above are assigned to the relational expression of $Cw=Dw_{All}/Dw$ to determine Cw.

In this way, the maximum allowable concentration of the wax that can be contained in the toner at the time of selecting arbitrary Vp or arbitrary wax can be determined.

As described above, if the dust emission from the wax is too small, HOS is deteriorated. On this account, in the toner of the present invention, the wax is specified in terms of not only the maximum allowable wax concentration but also the minimum wax content.

As a result of studies in Examples and Comparative Examples later, when the dust emission Dt from the toner according to the present invention is less than 60 and sufficient releasability cannot be imparted to a fixing roller, HOS is deteriorated. For this reason, Dt must be designed to be 60 or more.

From FIG. 1, Dt and $Dw_{All}$ have the relationship of formula (6). $Dw_{All}$ is unambiguously determined by assigning 60 to Dt in formula (6).

Since $Dw_{All}$ is calculated, when the dust emission Dw of the wax selected is measured by the method described in Examples, the value of $Dw_{All}/Dw$ in the relational expression $Cw=Dw_{All}/Dw$ can be extracted and in turn, Cw can be obtained. The Cw obtained here is the minimum wax content when an arbitrary wax is selected.

When the derivation method above is simplified, the minimum allowable wax can be determined through the following procedure:

(b-1) 101 is assigned to Dt of formula (6) to determine $Dw_{All}$ ($Dw_{All}$=3,272 is obtained), (b-2) the dust emission Dw of the wax used is measured by the method described in Examples, and (b-3) $Dw_{All}$ determined in (b-1) above and the value of Dw determined in (b-2) above are assigned to the relational expression $Cw=Dw_{All}/Dw$ to determined Cw.

In this way, the minimum wax content for not deteriorating HOS in graphic use accompanying a large toner adhesion amount can be determined.

Likewise, the electrostatic image developing toner where the dust emission Dt satisfies the range of any one of formulae (2) to (4) is obtained, in the method (I) above, by preparing an electrostatic image developing toner having a shell-core structure, incorporating the wax component Y into the shell material, and incorporating the wax component X into the core material.

In the method (II), the wax is incorporated into the primary polymer particle described later to provide a state of the wax component X and the wax component Y being dispersed in the entire toner base particle before external addition for forming an electrostatic image developing toner. Each of the dust emission of wax component X, the dust emission of wax component Y, and the contents of these components in the toner must satisfy the above-described relationship.

The toner for development of the present invention is measured by the method described in <Measurement Method and Definition of Melting Point of Wax in the State of Being Contained in Electrostatic Image Developing Toner> of Examples, whereby the melting point of the wax in the state of being contained in the toner can be determined. The toner for development of the present invention is, as a premise, a toner where at least one melting point of the wax in the state of being contained in the toner is present at 55 to 90° C.

In addition, the toner for development obtained by the methods (I) and (II) is preferably a toner where according to the measurement method of the melting point of the wax in the state of being contained in the toner, the wax in the state of being contained in the toner has at least one melting point in the range of 55° C. to less than 70° C. and at least one melting point in the range of 70 to 80° C.

Furthermore, the toner for development of the present invention can improve the hot offset resistance while suppressing generation of dust during fixing, even in a high-speed machine consuming a large amount of the electrostatic image developing toner per unit time or even in graphic use accompanying an increase in the adhesion amount of the electrostatic image developing toner to paper and therefore, is suitably used at the time of high-speed printing. Above all, the toner of the present invention exerts the above-described effects particularly in a high-speed machine where the printing speed (Vp) is 20 (sheets/min) or more, more preferably the printing speed (Vp) is 30 (sheet/min) or more, and therefore, is suitably used therein.

<2. Endothermic Quantity in Second Elevated Temperature Process in DSC>

The toner for development of the present invention must have, at 65.6 to 70.8° C., a peak or shoulder exhibiting a decay of the endothermic quantity in the second elevated temperature process in DSC to 80% or less of the endothermic quantity in the first elevated temperature process in DSC. In the present invention, the peak or shoulder exhibiting the decay preferably appears at 66.5° C. or more, more preferably at 66.9° C. or more, still more preferably at 67.5° C. or more. On the other hand, in the present invention, the peak or shoulder exhibiting the decay preferably appears at 69.6° C. or less, more preferably at 69.4° C. or less, still more preferably at 69.2° C. or less. If the peak or shoulder exhibiting the decay appears in a range less than 65.6° C., the storability of the toner for development may be reduced, whereas if the peak or shoulder exhibiting the decay appears in a range exceeding 70.8° C., the low-temperature fixability may be deteriorated, making the toner impracticable.

The measurement method in first and second DSC and the definition method of the peak or shoulder exhibiting a decay follow the methods described in Examples.

The toner for development of the present invention where, as described above, an endothermic peak or shoulder temperature derived from, e.g., enthalpy relaxation or partial crystallization of the binder resin at the time of heating the toner is kept in a specific very narrow range, is obtained by the methods described in the following (III-1) to (III-4).

(III-1) A copolymer resin is employed as the binder resin constituting the toner of the present invention, monomers differing in Tg are used as the monomer, and the copolymerization composition ratio of those monomers differing in Tg is adjusted. Specifically, the binder resin includes a styrene-based resin, a vinyl chloride-based resin, a rosin-modified maleic acid resin, a phenolic resin, an epoxy resin, a saturated or unsaturated polyester resin, a polyethylene-based resin, a polypropylene-based resin, an ionomer resin, a polyurethane resin, a silicone resin, a ketone resin, an ethylene-acrylate copolymer, a xylene resin, a polyvinylbutyral resin, a styrene-alkyl acrylate copolymer, a styrene-alkyl methacrylate copolymer, a styrene-acrylonitrile copolymer, a styrene-butadiene copolymer, a styrene-maleic anhydride copolymer, etc. One of these resins may be used alone, or some of them may be used in combination. At this time, for example, in the case of a styrene-alkyl acrylate copolymer, when the proportion of the styrene component is increased relative to alkyl acrylate, the endothermic peak or shoulder temperature derived from, e.g., enthalpy relaxation or partial crystallization of the binder resin can be raised, and by adjusting the ratio in the styrene-alkyl acrylate copolymer, the peak or shoulder exhibiting a decay of the endothermic quantity in the second elevated temperature process in DSC to 80% or less of the endothermic quantity in the first elevated temperature process in DSC can be controlled to appear at 65.6 to 70.8° C.

(III-2) The radical concentration during a polymerization reaction of the binder resin is changed, for example, by adjusting the amount of a chain transfer agent added at the time of conversion of a monomer to a polymer or adjusting the amount of a polymerization initiator added or the polymerization temperature, so as to adjust the proportion of components not more than the critical molecular weight (Mc), and thereby, the peak or shoulder exhibiting a decay of the endothermic quantity in the second elevated temperature process in DSC to 80% or less of the endothermic quantity in the first elevated temperature process in DSC can also be controlled to appear at 65.6 to 70.8° C.

The critical molecular weight (Mc) corresponds to a molecular weight twice the entanglement molecular weight (Me), and the entanglement molecular weight is a value inherent in a monomer and is a molecular weight between molecular chain entanglements. Furthermore, a molecular chain is entangled, folded back and entangled with another molecule and thus exhibits a polymer-like behavior. A molecular weight corresponding to twice the entanglement molecular weight (Me) is the critical molecular weight (Mc). A high molecular chain not less than the critical molecular weight has an inherent Tg according to the monomer, but in a low molecular chain not more than the critical molecular weight, the peak or shoulder temperature exhibiting a decay of the endothermic quantity in the second elevated temperature process in DSC to 80% or less of the endothermic quantity in the first elevated temperature process in DSC decays according to the molecular chain length. That is, in the case of radical-polymerizing a monomer having an unsaturated double bond, the peak or shoulder temperature exhibiting a decay of the endothermic quantity in the second elevated temperature process in DSC to 80% or less of the endothermic quantity in the first elevated temperature process in DSC can be lowered by increasing the amount of a chain transfer agent added at the time of conversion of a monomer to a polymer and increasing a component not more than the critical molecular weight. In this way, the chain transfer agent is selected and the amount thereof is adjusted, according to the above-described binder resin, whereby the peak or shoulder temperature exhibiting a decay of the endothermic quantity in the second elevated temperature process in DSC to 80% or less of the endothermic quantity in the first elevated temperature process in DSC can be controlled.

In the case of radical-polymerizing a monomer having an unsaturated double bond, a chain transfer agent such as tert-dodecylmercaptan, 2-mercaptoethanol, diisopropyl xanthogen, carbon tetrachloride and trichlorobromomethane, can be selected.

In a polyester resin obtained by condensation polymerization of a polyhydric alcohol and a polybasic acid, the dihydric alcohol includes, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol, bisphenol A, hydrogenated bisphenol A, a bisphenol A alkylene oxide adduct such as polyoxyethylenated bisphenol A and polyoxypropylenated bisphenol A, and others. The polybasic acid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides and lower alkyl esters thereof, alkenylsuccinic acids or alkylsuccinic acids such as n-dodecenylsuccinic acid and n-dodecylsuccinic acid, and other divalent organic acids. When the pressure reduction degree or temperature during a condensation reaction is decreased, the dehydration reaction is suppressed and in turn, the peak or shoulder temperature exhibiting a decay of the endothermic quantity in the second elevated temperature process in DSC to 80% or less of the endothermic quantity in the first elevated temperature process in DSC lowers. In this way, the peak or shoulder temperature exhibiting a decay of the endothermic quantity in the second elevated temperature process in DSC to 80% or less of the endothermic quantity in the first elevated temperature process in DSC can be controlled.

(III-3) A crystalline resin component is incorporated as the binder resin constituting the toner of the present invention.

The crystalline resin component includes, an acrylic acid derivative having a long chain alkyl group, such as stearyl acrylate and behenyl acrylate, a methacrylic acid derivative such as stearyl methacrylate and behenyl methacrylate, etc. A polyester-based crystalline resin is preferably a resin containing an aliphatic hydrocarbon as the polyhydric alcohol and includes a polyester-based crystalline resin obtained using 1,2-propylene glycol, 1,3-propylene glycol, 1,4-butanediol, 1,4-butenediol, 1,5-pentanediol, neopentyl glycol, 1,5-pentane glycol, 1,6-hexanediol, 1,4-cyclohexanediol, 1,7-heptanediol, 1,8-octanediol, 1,9-nonanediol, 1,10-decanediol, dipropylene glycol, polyethylene glycol, polypropylene glycol or polytetramethylene glycol. By incorporating from 5 to 30 mass % of a crystalline resin component, the peak or shoulder temperature exhibiting a decay of the endothermic quantity in the second elevated temperature process in DSC to 80% or less of the endothermic quantity in the first elevated temperature process in DSC lowers. In this way, the peak or shoulder temperature exhibiting a decay of the endothermic quantity in the second elevated temperature process in DSC to 80% or less of the endothermic quantity in the first elevated temperature process in DSC can be controlled.

(III-4) A wax component having high compatibility with the binder resin constituting the toner of the present invention is incorporated.

As the wax component having high compatibility, a wax having a solubility parameter close to that of the binder resin component is selected or a wax differing in the solubility parameter but having a low molecular weight solubility is selected, whereby the peak or shoulder temperature exhibiting a decay of the endothermic quantity in the second elevated temperature process in DSC to 80% or less of the endothermic quantity in the first elevated temperature process in DSC can be controlled. The solubility parameter is calculated from the sum of sublimabilities and thus, lies in close relation with the wax-derived dust emission and in turn, the toner dust emission. That is, the sublimability lowers when having a polar group or in the case of hydrocarbon, having a high molecular weight and therefore, a wax having a large solubility parameter value comes to have low sublimability. For example, in the case of an ester-based wax having the same molecular weight as a hydrocarbon-based wax, since the polarity of the ester moiety is high, the solubility parameter becomes large and the sublimability decreases. Compared with a hydrocarbon-based wax, an ester-based wax exhibits high compatibility with a styrene acryl-based resin or polyester-based resin generally used as the binder resin component of an electrostatic image developing toner, and the peak or shoulder temperature exhibiting a decay of the endothermic quantity in the second elevated temperature process in DSC to 80% or less of the endothermic quantity in the first elevated temperature process in DSC lowers.

<3. Re: Average Value of Tan δ in Range of Angular Velocity of 20 to 100 Rad/Sec>

In the developer for development of the present invention, the average value of tan δ in the range of an angular velocity of 20 to 100 rad/sec in the dynamic viscoelasticity measurement at 140° C. must be from 1.62 to 2.20. In the present invention, the average value of the tan δ above is preferably 1.82 or more, more preferably 1.86 or more, still more preferably 1.94 or more. On the other hand, the average value of the tan δ above is preferably 2.13 or less, more preferably 2.12 or less, still more preferably 2.11 or less. If the average value of the tan δ above is less than 1.62, the gloss may be changed for the worse, making the toner impracticable, whereas if the average value of the tan δ above exceeds 2.20, the hot offset resistance may be deteriorated, allowing hot offset to readily occur.

The toner for development of the present invention, where as described above, the average value in the plateau region of tan δ (phase difference) observed only in a high frequency region of 20 rad/sec or more in the viscoelasticity measurement of the toner is kept in a specific narrow range, is obtained by the methods described in the following (IV-1) and (IV-2).

(IV-1) The amount of a crosslinking component is adjusted according to the primary molecular chain length of a monomer used for the binder resin constituting the toner of the present invention, at the time of obtaining the binder resin by polymerization.

In the case of radical-polymerizing a monomer having an unsaturated double bond, the monomer includes divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, diallyl phthalate, etc. In addition, by increasing the amount added of a polymerizable monomer having a reactive group in the pendant group, for example, glycidyl methacrylate, methylolacrylamide and acrolein, the value of tan δ observed only in a high frequency region of 20 rad/sec or more can be decreased, and in a polyester resin obtained by condensation polymerization of a polyhydric alcohol and a polybasic acid, by increasing the amount added of a trivalent or higher polybasic acid, for example, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, or an anhydride thereof, the value of tan δ observed only in a high frequency region of 20 rad/sec or more can be decreased. The value of tan δ observed only in a high frequency region of 20 rad/sec or more can be controlled by adjusting the amount added of such a crosslinking agent and thereby adjusting the amount of a crosslinking component.

(IV-2) The primary molecular chain length of a monomer used for the binder resin constituting the toner of the present invention is adjusted.

In the case of radical-polymerizing a monomer having an unsaturated double bond, the number of parts of a chain transfer agent added, such as tert-dodecylmercaptan, 2-mercaptoethanol, diisopropyl xanthogen, carbon tetrachloride and trichlorobromomethane, is decreased, whereby the primary molecular chain length can be increased and the proportion of a crosslinking component can be increased even with the same amount of a crosslinking agent, so that the value of tan δ can be decreased. In the case of a polyester-based resin, the value of tan δ can be decreased by reducing the amount of a monohydric alcohol component or lowering the pressure reduction degree or temperature, in the process of a condensation reaction. In this way, the value of tan δ can be controlled by adjusting the primary molecular chain length.

<4. Re: Plasticization Initiating Temperature Determined by Dynamic Viscoelasticity Measurement>

In the toner for development of the present invention, as long as the effects of the present invention are not significantly impaired, the plasticization initiating temperature determined by dynamic viscoelasticity measurement is not limited, but in view of toner storability and low-temperature fixability, the plasticization initiating temperature determined by dynamic viscoelasticity measurement is usually 73.5° C. or more, preferably 74.8° C. or more, more preferably 75.2° C. or more, still more preferably 75.9° C. or more, and, on the other hand, is usually 80.5° C. or less, preferably 79.2° C. or less, more preferably 78.9° C. or less, still more preferably 78.4° C. or less. If the plasticization initiating temperature determined by dynamic viscoelasticity measurement is less than 73.5° C., the toner storability may be deteriorated, making the toner impracticable, and on the other hand, if the plasticization initiating temperature determined by dynamic viscoelasticity measurement exceeds 80.5° C., the low-temperature fixability may be deteriorated, making the toner impracticable.

The toner for development where, as described above, the plasticization initiating temperature determined by dynamic viscoelasticity measurement is in a specific range, is obtained by the methods described in the following (V-1) to (V-4).

(V-1) A copolymer resin is employed as the binder resin constituting the toner of the present invention, monomers differing in Tg are used as the monomer, and the copolymerization composition ratio of those monomers differing in Tg is adjusted.

Specifically, the binder resin includes a styrene-based resin, a vinyl chloride-based resin, a rosin-modified maleic acid resin, a phenolic resin, an epoxy resin, a saturated or unsaturated polyester resin, a polyethylene-based resin, a polypropylene-based resin, an ionomer resin, a polyurethane resin, a silicone resin, a ketone resin, an ethylene-acrylate copolymer, a xylene resin, a polyvinylbutyral resin, a styrene-alkyl acrylate copolymer, a styrene-alkyl methacrylate copolymer, a styrene-acrylonitrile copolymer, a styrene-butadiene copolymer, a styrene-maleic anhydride copolymer, etc. One of these resins may be used alone, or some of them may be used in combination. At this time, for example, in the case of a styrene-alkyl acrylate copolymer, when the proportion of the styrene component is increased relative to alkyl acrylate, the plasticization initiating temperature determined by dynamic viscoelasticity measurement can be raised, and by adjusting the ratio in the styrene-alkyl acrylate copolymer, the plasticization initiating temperature determined by dynamic viscoelasticity measurement can be controlled.

(V-2) The plasticization initiating temperature determined by dynamic viscoelasticity measurement can also be controlled by adjusting the proportion of components not more than the critical molecular weight (Mc).

The critical molecular weight (Mc) is as described above. A high molecular chain not less than the critical molecular weight has an inherent Tg according to the monomer, but Tg of a low molecular chain not more than the critical molecular weight lowers according to the molecular chain length.

For example, in the case of a polymer obtained by radical-polymerizing a monomer having an unsaturated double bond, the components not more then the critical molecular weight can be increased by adjusting the amount of a chain transfer agent added at the time of conversion of a monomer to a polymer or adjusting the amount of a polymerization initiator added or the polymerization temperature, thereby changing the radical concentration during a polymerization reaction of the binder resin. In this way, according to the above-described binder resin, the chain transfer agent is selected and the amount thereof is adjusted, whereby the plasticization initiating temperature determined by dynamic viscoelasticity measurement can be controlled. In the case of radical-polymerizing a monomer having an unsaturated double bond, a chain transfer agent such as tert-dodecylmercaptan, 2-mercaptoethanol, diisopropyl xanthogen, carbon tetrachloride and trichlorobromomethane, can be selected.

In a polyester resin obtained by condensation polymerization of a polyhydric alcohol and a polybasic acid, the dihydric alcohol includes, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol, bisphenol A, hydrogenated bisphenol A, a bisphenol A alkylene oxide adduct such as polyoxyethylenated bisphenol A and polyoxypropylenated bisphenol A, and others. The polybasic acid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides and lower alkyl esters thereof, alkenylsuccinic acids or alkylsuccinic acids such as n-dodecenylsuccinic acid and n-dodecylsuccinic acid, and other divalent organic acids. When the pressure reduction degree or temperature during a condensation reaction is decreased, the dehydration reaction is suppressed and in turn, the plasticization initiating temperature determined by dynamic viscoelasticity measurement can be controlled.

(V-3) A crystalline resin component is incorporated as the binder resin constituting the toner of the present invention.

As the crystalline resin component, the crystalline resin components recited in (III-3) can be used. By incorporating from 5 to 30 mass % of a crystalline resin component, the plasticization initiating temperature determined by dynamic viscoelasticity measurement can be lowered. In this way, the plasticization initiating temperature determined by dynamic viscoelasticity measurement can be controlled.

(V-4) A wax component having high compatibility with the binder resin constituting the toner of the present invention is incorporated.

As the wax component having high compatibility, a wax having a solubility parameter close to that of the binder resin component is selected or a wax differing in the solubility parameter but having a low molecular weight solubility is selected, whereby the plasticization initiating temperature determined by dynamic viscoelasticity measurement can be controlled. The solubility parameter is calculated from the sum of sublimabilities and thus, lies in close relation with the wax-derived dust emission and in turn, the toner dust emission. That is, the sublimability lowers when having a polar group or in the case of hydrocarbon, having a high molecular weight and therefore, a wax having a large solubility parameter value comes to have low sublimability. For example, in the case of an ester-based wax having the same molecular weight as a hydrocarbon-based wax, since the polarity of the ester moiety is high, the solubility parameter becomes large and the sublimability decreases. Compared with a hydrocarbon-based wax, an ester-based wax exhibits high compatibility with a styrene acryl-based or polyester-based resin generally used as the binder resin component of an electrostatic image developing toner, and the plasticization initiating temperature determined by dynamic viscoelasticity measurement can be lowered <5. Configuration of Toner>

The electrostatic image developing toner of the present invention may be sufficient if it is an electrostatic image developing toner containing a binder resin, a colorant and, wherein at least one peak or shoulder attributable to the melting point of the wax in the state of being contained in the electrostatic image developing toner is present at 55 to 90° C. in the second elevated temperature process in DSC and the dust emission (Dt) of the electrostatic image developing toner satisfies the following formula (1):

$$60 \leq Dt \leq 195{,}449/Vp - 1{,}040 \quad (1)$$

and wherein a peak or shoulder exhibiting a decay of the endothermic quantity in the second elevated temperature process in DSC to 80% or less of the endothermic quantity in the first elevated temperature process in DSC appears at 65.6 to 70.8° C. and the average value of tan δ in the range of an angular velocity of 20 to 100 rad/sec in the dynamic viscoelasticity measurement at 140° C. is from 1.62 to 2.20. From the standpoint of bringing out more prominently the effects of the present invention, furthermore, the plasticization initiating temperature determined by dynamic viscoelasticity measurement is preferably set to be from 73.5 to 80.5° C.

The method for producing the toner for development of the present invention is not particularly limited, and it may be sufficient if the configuration described below is employed while appropriately employing the above-described production method of (III-1) to (III-4), (IV-1, IV-2) and (V-1) to (V-4) in the production method of a wet-process toner or a pulverization toner.

As the binder resin constituting the toner of the present invention, a binder resin appropriately selected from those known to be usable for a toner may be used. The binder resin includes, for example, the resins recited as examples in (III-1) or (V-1).

As the colorant constituting the toner of the present invention may, a colorant appropriately selected from those known to be usable for a toner may be used. The colorant includes, for example, a yellow pigment, a magenta pigment, and a cyan pigment, which are described below. As the black pigment, carbon black or a pigment obtained by mixing the later-described yellow pigment/magenta pigment/cyan pigment to form a black color, may be utilized.

Among those, carbon black as the black pigment exists as an aggregate of very fine primary particles and when dispersed as a pigment dispersion, particle coarsening due to re-aggregation is likely to occur. The degree of re-aggregation of carbon black particles is correlated with whether large or small the amount of impurities contained in carbon black (the degree of the amount of an organic substance remaining undecomposed) is, and when the amount of impurities is large, the coarsening due to re-aggregation after dispersion tends to be aggressive.

As the quantitative evaluation of the amount of impurities, the ultraviolet absorbance of a toluene extract of carbon black as measured by the below-described method is preferably 0.05 or less, more preferably 0.03 or less. In general, carbon black by a channel process tends to contain a large amount of impurities and therefore, the carbon black for use in the present invention is preferably carbon black produced by a furnace process.

The ultraviolet absorbance (λc) of carbon black is determined by the following method.

First, 3 g of carbon black is fully dispersed and mixed in 30 ml of toluene and the resulting mixed solution is filtered using No. 5C filter paper. Thereafter, the filtrate is put in a quartz cell with a 1 cm-square absorption part, and the absorbance (λs) at a wavelength of 336 nm is measured by means of a commercially available ultraviolet spectrophotometer. The absorbance (λo) of toluene alone is measured as a reference by the same method, and the ultraviolet absorbance can be determined from $\lambda c = \lambda s - \lambda o$. As the commercially available spectrophotometer, for example, an ultraviolet-visible spectrophotometer (UV-3100PC) manufactured by Shimadzu Corporation may be used.

As the yellow pigment, a compound typified by a condensed azo compound, an isoindolinone compound, etc. is used. Specifically, C.I. Pigment Yellow 12, 13, 14, 15, 17, 62, 74, 83, 93, 94, 95, 109, 110, 111, 128, 129, 147, 150, 155, 168, 180, 194, etc. are suitably used.

As the magenta pigment, a condensed azo compound, a diketopyrrolopyrrole compound, anthraquinone, a quinacridone compound, a basic dye lake compound, a naphthol compound, a benzimidazolone compound, a thioindigo compound, and a perylene compound are used.

Specifically, C.I. Pigment Red 2, 3, 5, 6, 7, 23, 48:2, 48:3, 48:4, 57:1, 81:1, 122, 144, 146, 166, 169, 173, 184, 185, 202, 206, 207, 209, 220, 221, 238, 254, C.I. Pigment Violet 19, etc are suitably used. Among others, a quinacridone pigment represented by C.I. Pigment Red 122, 202, 207, 209 and C.I. Pigment Violet 19 is preferred. Among the quinacridone pigments, a compound represented by C.I. Pigment Red 122 is more preferred.

As the cyan pigment, a copper phthalocyanine compound, a derivative thereof, an anthraquinone compound, a basic dye lake compound, etc. can be used. Specifically, C.I. Pigment Blue 1, 15, 15:1, 15:2, 15:3, 15:4, 60, 62, 66, etc., and C.I. Pigment Green 7, 36, etc. may be suitably used, among others.

<6. Wet-Process Toner>

The wet-process toner is described.

As the wet process of obtaining a toner in an aqueous medium, a method of performing radical polymerization of an unsaturated double bond-containing monomer in an aqueous medium, such as suspension polymerization method and emulsion polymerization aggregation method, or as with a polyester resin, performing condensation polymerization in an aqueous medium, an emulsion aggregation method (a method where a polyester resin etc. is microparticulated in water under a high-pressure condition or in the presence of a solvent to a submicron size that is not more than the toner size, and thereafter, the obtained fine particles are aggregated to a micron size that is the toner size), and a chemical pulverization method are suitably used (hereinafter, simply referred to as "polymerization method", and the obtained toner is simply referred to as "polymerization-method toner"). For example, in the production process of a conventional polymerization-method toner, the suspension polymerization method includes, e.g., a method of applying a high shear force or increasing the amount of a dispersion stabilizer, etc., in the step of producing a polymerizing monomer droplet.

As the method for obtaining a toner having a particle diameter in a specific range, a production method employing any of polymerization methods described above, such as suspension polymerization method, emulsion polymerization aggregation method, emulsion aggregation method and chemical pulverization method, may be used, but in both the suspension polymerization method and the chemical pulverization method, a toner having a size larger than the toner base particle diameter is processed into a toner having a small size. Therefore, when the average particle diameter is intended to be reduced, the proportion of the particle diameter on the small particle side tends to increase, imposing an excessive load such as classification step.

On the other hand, in a buildup method in water, typified by emulsion polymerization aggregation method and emulsion aggregation method, a particle having a size smaller than the toner base particle diameter is processed into a large particle, making the particle diameter distribution be relatively sharp, and a toner having a regulated particle diameter distribution is obtained without a step such as classification step. For these reasons, the toner of the present invention is preferably produced by an emulsion polymerization aggregation method or an emulsion aggregation method.

Here, in the case of a pulverization toner, a classification step is usually indispensable, but in the case of a wet-process toner, particularly, according to an emulsion polymerization aggregation method, a toner having a desired particle diameter distribution can be obtained without classification.

A toner produced by an emulsion polymerization aggregation method of radical-polymerizing an unsaturated double bond-containing monomer in an aqueous medium, which is an example of the production method preferred in the present invention among production methods for a polymerization toner, is described in more detail below.

In the case of producing a toner by an emulsion polymerization aggregation method, the process usually includes a polymerization step, a mixing step, an aggregation step, a ripening step, and a washing/drying step. That is, in general, a dispersion liquid of colorant, charge-controlling agent, wax, etc. is mixed with a dispersion liquid containing primary polymer particles obtained by emulsion polymerization, the primary particles in the resulting dispersion liquid are aggregated to form a particle aggregate, and after attaching and fusing a fine particle, etc. thereto, the particle obtained is washed and dried, if desired, whereby a toner base particle is obtained. In the case of a toner where a shell-core structure is formed, a primary polymer particle dispersion liquid working out to a shell material is added to a core formed through a core material aggregation step involving polymerization, mixing and aggregation, and the mixture is held and then passed through a round shape formation step and a washing/drying step, whereby a shell-core structure can be formed.

As the binder resin constituting the primary polymer particle used in the emulsion polymerization aggregation method, one polymerizable monomer or two or more polymerizable monomers, which can be polymerized by an emulsion polymerization method, may be appropriately used. As the polymerizable monomer used for a core material, a shell material or a toner base particle where a shell-core structure is not formed, a polymerizable monomer having a Bronsted-acidic group (hereinafter, sometimes simply referred to as "acidic monomer") or a polymerizable monomer having a Bronsted-basic group (hereinafter, sometimes simply referred to as "basic monomer"), and a polymerizable monomer having neither a Bronsted-acidic group nor a Bronsted-basic group (hereinafter, sometimes referred to as "other monomer") are preferably used as raw material polymerizable monomers. At this time, respective polymerizable monomers may be added separately, or a plurality of polymerizable monomers may be previously mixed and added at a time. Furthermore, it is also possible to change the polymerizable monomer composition during the addition of polymerizable monomers. The polymerizable monomer may be added as it is or may be added as an emulsion liquid prepared by previously mixing the monomer with water, an emulsifying agent, etc.

The "acidic monomer" includes, for example, a carboxyl group-containing polymerizable monomer such as acrylic acid, methacrylic acid, maleic acid, fumaric acid and cinnamic acid, a sulfonic acid group-containing polymerizable monomer such as sulfonated styrene, and a sulfonamide group-containing polymerizable monomer such as vinylbenzenesulfonamide.

The "basic monomer" includes, for example, an amino group-containing aromatic vinyl compound such as aminostyrene, a polymerizable monomer containing a nitrogen-containing heterocyclic ring, such as vinylpyridine and vinylpyrrolidone, and an amino group-containing (meth) acrylic acid ester such as dimethylaminoethyl acrylate and diethylaminoethyl methacrylate.

One of these acid monomers and basic monomers may be used alone, or a plurality thereof may be mixed and used, and the monomer may be present as a salt accompanied by a counter ion. Among these, an acidic monomer is preferably used, and the acidic monomer is more preferably an acrylic acid and/or a methacrylic acid. The total amount of the acidic monomer and the basic monomer per 100 mass % of all polymerizable monomers constituting a binder resin as a primary polymer particle is preferably 0.05 mass % or more, more preferably 0.5 mass % or more, still more preferably 1 mass % or more. The upper limit is preferably 10 mass % or less, more preferably 5 mass % or less.

The "other monomer" includes, for example, styrenes such as styrene, methylstyrene, chlorostyrene, dichlorostyrene, p-tert-butylstyrene, p-n-butylstyrene and p-n-nonylstyrene, acrylic acid esters such as methyl acrylate, ethyl acrylate, propyl acrylate, n-butyl acrylate, isobutyl acrylate, hydroxyethyl acrylate and ethylhexyl acrylate, methacrylic acid esters such as methyl methacrylate, ethyl methacrylate, propyl methacrylate, n-butyl methacrylate, isobutyl methacrylate, hydroxyethyl methacrylate and ethylhexyl methacrylate, acrylamide, N-propylacrylamide, N,N-dimethylacrylamide, N,N-dipropylacrylamide, N,N-dibutylacrylamide, and acrylic acid amide. One polymerizable monomer may be used alone, or a plurality of polymerizable monomers may be used in combination.

In the present invention, when the above-described polymerizable monomers, etc. are used in combination, one preferred embodiment is to use an acidic monomer and the other monomer in combination. More preferably, an acrylic acid and/or a methacrylic acid are used as the acidic monomer, and a polymerizable monomer selected from styrenes, acrylic acid esters and methacrylic acid esters is used as the other monomer; still more preferably, an acrylic acid and/or a methacrylic acid are used as the acidic monomer, and a combination of styrene and acrylic acid esters and/or methacrylic acid esters is used as the other monomer; and yet still more preferably, an acrylic acid and/or a methacrylic acid are used as the acidic monomer, and a combination of styrene and n-butyl acrylate is used as the other monomer.

Furthermore, in the case of using a crosslinked resin as the binder resin constituting the primary polymer particle, a polyfunctional monomer having radical polymerizability is used as the crosslinking agent shared with the above-described polymerizable monomer, and the polyfunctional monomer includes, for example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, and diallyl phthalate. In addition, it is also possible to use a polymerizable monomer having a reactive group in the pendant group, for example, glycidyl methacrylate, methylolacrylamide or acrolein. Among others, a radical-polymerizable bifunctional monomer is preferred, and divinylbenzene and hexanediol diacrylate are more preferred.

One of these polyfunctional monomers may be used alone, or a plurality thereof may be mixed and used. In the case of using a crosslinked resin as the binder resin constituting the primary polymer particle, the blending ratio of the polyfunctional monomer to all polymerizable monomers constituting the resin is preferably 0.005 mass % or more, more preferably 0.1 mass % or more, still more preferably 0.3 mass % or more, and the upper limit is preferably 5 mass % or less, more preferably 3 mass % or less, still more preferably 1 mass % or less.

As the emulsifying agent used for emulsion polymerization, a known emulsifying agent may be used, and one emulsifying agent selected from a cationic surfactant, an anionic surfactant, and a nonionic surfactant may be used, one or two or more emulsifying agents selected therefrom may be used in combination.

The cationic surfactant includes, for example, dodecylammonium chloride, dodecylammonium bromide, dodecyltrimethylammonium bromide, dodecylpyridinium chloride, dodecylpyridinium bromide, and hexadecyltrimethylammonium bromide.

The anionic surfactant includes, for example, a fatty acid soap such as sodium stearate and sodium dodecanoate, sodium dodecyl sulfate, sodium dodecylbenzenesulfonate, and sodium laurylsulfate.

The nonionic surfactant includes, for example, polyoxyethylene dodecyl ether, polyoxyethylene hexadecyl ether, polyoxyethylene nonylphenyl ether, polyoxyethylene lauryl ether, polyoxyethylene sorbitan monooleate ether, and monodecanoyl sucrose.

The amount of the emulsifying agent used is usually from 1 to 10 parts by mass per 100 parts by mass of the polymerizable monomer. In combination with the emulsifying agent, one member or two or more members of, for example, polyvinyl alcohols such as partially or completely saponified polyvinyl alcohol, and cellulose derivatives such as hydroxyethyl cellulose, may be used as a protective colloid.

As the polymerization initiator, for example, hydrogen peroxide; persulfates such as potassium persulfate; organic peroxides such as benzoyl peroxide and lauroyl peroxide; azo compounds such as 2,2'-azobisisobutyronitrile and 2,2'-azobis(2,4-dimethylvaleronitrile); and a redox initiator are used. One of these or two or more thereof are used usually in an amount of 0.1 to 3 parts by mass per 100 parts by mass of the polymerizable monomer. Above all, it is preferred that the initiator is at least partially or entirely hydrogen peroxide or organic peroxides.

In addition, one suspension stabilizer one or two or more suspension stabilizers, such as calcium phosphate, magnesium phosphate, calcium hydroxide and magnesium hydroxide, may be used in a range of usually from 1 to 10 parts by mass per 100 parts by mass of the polymerizable monomer.

Both of the above-described polymerization initiator and suspension stabilizer may be added to the polymerization system in any timing, i.e., before the addition of the polymerizable monomer, simultaneously with the addition, or after the addition, and if desired, these addition methods may be combined.

At the time of emulsion polymerization, a known chain transfer agent may be used, if desired, and specific examples of the chain transfer agent include tert-dodecylmercaptan, 2-mercaptoethanol, diisopropyl xanthogen, carbon tetrachloride, and trichlorobromomethane. One chain transfer agent may be used alone, or two or more kinds of chain transfer agents may be used in combination, and the chain transfer agent is used in a range of 5 mass % or less relative to all polymerizable monomers. In addition, a pH adjusting agent, a polymerization degree adjusting agent, a defoaming agent, etc. may be further appropriately blended with the reaction system.

The emulsion polymerization polymerizes the above-described polymerizable monomers in the presence of a polymerization initiator, and the polymerization temperature is usually from 50 to 120° C., preferably from 60 to 100° C., more preferably from 70 to 90° C.

The volume average diameter (Mv) of the primary polymer particle obtained by emulsion polymerization is usually 0.02 μm or more, preferably 0.05 μm or more, more preferably 0.1 μm or more, and is usually 3 μm or less, preferably 2 μm or less, more preferably 1 μm or less. When the volume average particle diameter (Mv) of the primary polymer particle is in the range above, the aggregation rate can be relatively easily controlled, and a toner having the objective particle diameter can be obtained.

The glass transition temperature (Tg), as measured by DSC method, of the binder resin constituting the primary polymer particle is preferably from 40 to 80° C. Here, in the case where Tg of the binder resin overlaps with the calorific change based on other components, for example, with the melting peak of polylactone or wax, and cannot be clearly determined, Tg means a value when the toner is produced in the state of these other components being removed.

The acid value of the binder resin constituting the primary polymer particle is, as the value measured by the method of JIS K-0070 (1992), preferably from 3 to 50 mg KOH/g, more preferably from 5 to 30 mg KOH/g.

The colorant may be a colorant that is usually used, and is not particularly limited. The colorant includes, for example, the above-describe pigments, carbon black such as furnace black and lamp black, and a magnetic colorant. The content of the colorant may be sufficient if it is an amount large enough for the obtained toner to form a visible image by development, and the content is, for example, preferably from 1 to 25 parts by mass, more preferably from 1 to 15 parts by mass, still more preferably from 3 to 12 parts by mass, relative to the toner.

The colorant may have magnetism, and the magnetic colorant includes a ferromagnetic substance exhibiting ferrimagnetism or ferromagnetism around 0 to 60° C. that are use environment temperatures for a printer, a copying machine, etc., and specifically includes, for example, magnetite (Fe3O4), maghematite ($\gamma$-$Fe_2O_3$), an intermediate or mixture of magnetite and maghematite, a spinel ferrite represented by $M_xFe_{3-x}O_4$ (M is Mg, Mn, Fe, Co, Ni, Cu, Zn, Cd, etc.), a hexagonal crystal ferrite such as $BaO.6Fe_2O_3$ and $SrO.6Fe_2O_3$, a garnet oxide such as $Y_3Fe_5O_{12}$ and $Sm_3Fe_5O_{12}$, a rutile oxide such as $CrO_2$, a metal such as Cr, Mn, Fe, Co and Ni, and a ferromagnetic alloy thereof exhibiting magnetism at around 0 to 60° C. Among these, magnetite, maghematite, and an intermediate of magnetite and maghematite are preferred.

In the case of incorporating the magnetic colorant in view of scattering prevention, charge control, etc. while keeping the properties as a non-magnetic toner, the content of the magnetic powder in the toner is from 0.2 to 10 mass %, preferably from 0.5 to 8 mass %, more preferably from 1 to 5 mass %. In the case of using the toner as a magnetic toner, the content of the magnetic powder in the toner is usually 15 mass % or more, preferably 20 mass % or more, and is usually 70 mass % or less, preferably 60 mass % or less. If the content of the magnetic powder is less than this range, a magnetic force necessary as a magnetic toner may not be obtained, and if the content exceeds the range above, a fixing failure may be caused.

As the method for blending the colorant in the emulsion polymerization aggregation method, usually, a primary polymer particle dispersion liquid and a colorant dispersion liquid are mixed to make a mixed dispersion liquid, and the mixed dispersion liquid is aggregated to form a particle aggregate. The colorant is preferably used in the state of being emulsified by mechanical means such as sand mill or bead mill in water in the presence of an emulsifying agent. At this time, the colorant dispersion liquid is preferably prepared by adding from 10 to 30 parts by mass of a colorant and from 1 to 15 parts by mass of an emulsifying agent per 100 parts by mass of water. Here, the volume average diameter (Mv) is preferably controlled to be finally from 0.01 to 3 μm, more preferably from 0.05 to 0.5 μm, by monitoring the particle diameter of the colorant in the dispersion liquid during the dispersion process. The number average diameter (Mn) is preferably controlled to be from 0.01 to 3 μm, more preferably from 0.05 to 0.5 μm. The colorant dispersion liquid at the time of emulsion aggregation is used by calculating the blending ratio to account for 2 to 10 mass % in the finished toner base particle after aggregation.

As for the wax contained in the toner for development of the present invention, it is preferable to contain at least two kinds of waxes and precisely control the structure so as to satisfy the above-described toner dust emission Dt. That is, the toner for development of the present invention preferably satisfies the following requirements (a) to (c):

(a) the toner for development contains at least two kinds of waxes, i.e., a wax component X and a wax component Y, (b) the dust emission of the wax component Y is larger than the dust emission of the wax component X, and (c) the content of the wax component X is larger than the content of the wax component Y.

Here, the wax component X and the wax component Y indicate two kinds of waxes contained in the toner for development and have the same meanings as "wax X" and "wax Y", respectively.

Above all, it is preferred that the content of the wax component X is larger than the content of the wax component Y.

In addition, the ratio of the wax component Y to all wax components is preferably from 0.1 mass % to less than 10 mass %.

The toner of the present invention preferably satisfies the following requirement (f) in addition to the requirements (a) to (c) or in place of the requirement (c):

(f) the electrostatic image developing toner has a region in which the abundance ratio of the wax component Y is larger than that of the wax component X, and the number of the regions is larger in the outer wall side than in the center side of the electrostatic image developing toner.

In other words, when a wax having a small dust emission is used in the center side of the toner for development and a wax having a large dust emission is used in the outer wall side of the toner, the hot offset resistance is more improved than in the case of dispersing both waxes substantially uniformly in the toner.

While the wax is added for the purpose of imparting releasability of the toner for development from a fixing roller, it is considered that when a highly sublimable wax having high releasability is caused to exist in a concentrated manner selectively in the outer wall side of the toner for development, the wax diffuses from the toner for development at a higher rate and therefore, higher releasability can be imparted.

In the description of the present invention, when the toner base particle takes on a core-shell structure, the outer wall side of the toner indicates the shell layer, and the center side of the toner indicates the core layer. However, in practice, the shell portion and the core portion cannot be definitely differentiated, and a plurality of shell portions and core portions may randomly exist in one toner base particle. In such a case, the state of (f) "the toner for development has a region in which the abundance ratio of the wax component Y is higher than that of the wax component X, and the number of the regions is larger in the outer wall side than in the center side of the electrostatic image developing toner" is defined as follows.

That is, a state where in all core components existing inside the toner base particle, 50% or more of the circumference of each component is covered with a shell component, is defined as the state of (f) above.

Specific examples showing the state of (f) are depicted in FIGS. 10(*a*) to 10(*l*).

In FIGS. 10(*a*) to 10(*l*), the white portion indicates the core component, the dotted line indicates the circumference of the core component, the gray portion indicates the shell component, and the solid line indicates the circumference of the shell component. Incidentally, the state of (f) is not limited thereto.

The abundance ratio of the wax component X and the wax component Y is determined by the way of charging the wax at the time of production. Therefore, in order to cause a highly sublimable wax having high releasability to exist in a concentrated manner selectively in the outer wall side of the toner for development, this may be achieved by disposing the highly sublimable wax in a larger amount in the shell component than in the core component.

The method therefor includes, for example, the following methods:

1. a particle smaller than the core component is blended as the shell component, 2. the shell component is added later than the core component, and 3. in the case of producing the toner in a solvent containing water, the shell component uses a component having high polarity, compared with the core component.

The component having high polarity in 3. above includes, for example, a component containing a carboxyl group, a sulfonic acid group, a hydroxyl group, an amino group, an alkoxy group, etc.

Out of the methods in 1. to 3. above, one method may be used, or a plurality of methods may be used in combination.

The electrostatic image developing toner of the present invention preferably forms a shell-core structure having, in the center side of the toner, a core where the abundance ratio of the wax with a small dust emission is high, and having, in the outer wall side of the toner, a shell where the abundance ratio of the wax with a large dust emission is high. In the present invention, among the configurations of forming a shell-core structure, a configuration where the wax contained in the shell material of the shell-core structure contains substantially only the wax component Y and the wax contained in the core material of the shell-core structure contains substantially only the wax component X, is more preferred. Even when a shell-core structure is not formed, it is sufficient if the toner has a region where the abundance ratio of the wax with a large dust emission is higher in the outer wall side of the toner than in the center side of the toner.

Containing substantially only the wax component Y (or X) indicates that unavoidable trace impurities may be additionally mixed. The unavoidable impurity as used herein means a wax other than the wax component Y (or X).

The toner of the present invention preferably satisfies the following requirement (d) in addition to the requirements (a) to (c) or in place of the requirement (c):

(d) the dust emission (Dw) of the wax component X is 50,000 CPM or less, and the dust emission (Dw) of the wax component Y is 100,000 CPM or more.

This is because the amount of dust generated per hour (dust emission rate: Vd) from an image forming device can be controlled to be a lower value by setting the dust emission (Dw) of the wax component X existing in the center side of the toner to 50,000 CPM or less and higher hot offset resistance can be achieved by setting the dust emission (Dw) of the wax component Y existing in the outer wall side of the toner to 100,000 CPM or more.

The dust emission Dw of the wax component X or the wax component Y can be measured by the method described in Examples, similarly to the toner dust emission. Here, the static environment means to be placed under the conditions described in Examples, and the heating conditions are as described in Examples.

Specifically, the wax component X with a small dust emission includes a hydrocarbon-based wax and an ester-based wax, and among others, from the standpoint of reducing the emission, a microcrystalline wax or an ester-based wax, having a large sublimation energy, is preferably used.

The wax component Y with a large dust emission includes a hydrocarbon-based wax, and among others, from the standpoint of imparting releasability, a paraffin wax having many linear molecules is preferably used.

The toner for development of the present invention preferably has a shell-core structure and uses, as at least one shell material, a primary polymer particle including a wax and having a volume average diameter (Mv) of 50 to 500 nm.

The production method of the toner for development having a shell-core structure of the present invention is not particularly limited but, for example, a shell fine particle produced by an emulsion polymerization method, a mini-emulsion method or a coacervation method is attached to the surface of a core particle produced by any one of a pulverization method, an emulsion polymerization aggregation method, a suspension polymerization method and a chemical pulverization method (melt suspension method) and thereafter, if desired, the shell and the core are fused by heating, whereby the toner can be produced.

The reason why taking on this shell-core structure is because arranging a wax in the more outward side is advantageous in view of the release ability and, on the other hand, existence of a wax on the outermost surface of the toner for development may cause contamination of a member such as photoreceptor, making it impossible to obtain a satisfactory image quality.

As the measure for achieving the structure, it is preferable to employ, as one shell material, a primary polymer particle caused to include a wax having the above-described volume average diameter (Mv) by an emulsion polymerization method, a miniemulsion method or a coacervation method with use of a resin component. For example, in the case where the primary polymer particle used as a shell material is obtained by an emulsion polymerization method, the primary polymer particle can be produced in the same manner as the primary polymer particle obtained in the process of producing the toner by the emulsion polymerization aggregation method.

As the wax, a wax having a melting point of 90° C. or less must be contained for imparting satisfactory fixability to the electrostatic image developing toner. This is because no matter how the sublimation energy is low, a wax having a too high melting point diffuses at a low speed from the toner when the toner is melted in a fixing device, and the wax is eventually not transferred to the toner surface, making it impossible to impart sufficient release performance.

Furthermore, a wax having a too low melting point gives rise to reduction in the heat resistance of the toner and cannot be used because of a fear of causing a problem of blocking, etc. during transportation, and this makes it essential to contain a wax having a melting point 55° C. or more.

The melting point of the wax itself is from 55 to 90° C. Here, the melting point of the wax in the state of being contained in the electrostatic image developing toner is a value measured by the method described in Examples later, i.e., a method of measuring the wax by means of a thermal analyzer (DSC) in the state of a peak (heat history) derived from the enthalpy relaxation at the glass transition point of the resin in the toner being caused to disappear.

The wax used for producing the electrostatic image developing toner to have a dust emission Dt (CPM) value satisfying any one of formulae (1) to (4) described in the description of the present invention is not particularly limited except for the above-described melting point, but specifically, examples thereof include an olefin-based wax; paraffin wax; a long-chain aliphatic group-containing ester-based wax such as behenyl behenate, montanic acid ester and stearyl stearate; a vegetable wax such as hydrogenated castor oil and carnauba wax; a long-chain alkyl group-containing ketone such as distearyl ketone; an alkyl group-containing silicone; a higher fatty acid such as stearic acid; a long-chain aliphatic alcohol such as eicosanol; a carboxylic acid ester of a polyhydric alcohol, obtained from a polyhydric alcohol such as glycerin and pentaerythritol and a long-chain fatty acid, or a partial ester thereof; a higher fatty acid amide such as oleic acid amide and stearic acid amide; and low-molecular-weight polyester.

Among others, a hydrocarbon-based wax (Fischer-Tropsch wax, microcrystalline wax, polyethylene wax, polypropylene wax), and an ester-based wax (an esterification product of a long-chain fatty acid and a long-chain alcohol, or an esterification product of a long-chain fatty acid and a polyhydric alcohol) are preferred and suitably used.

The amount of the wax used is not particularly limited in both cases where the toner forms a shell-core structure and where the toner does not form a shell-core structure and includes substantially uniformly a binder resin, a colorant and a wax. In addition, as long as the electrostatic image developing toner is produced using a wax having a melting point in the above-described range to have a dust emission Dt (CPM) satisfying any one of formulae (1) to (4) set forth in the description of the present invention, the amount of the wax used is not particularly limited.

Above all, in any of the core material, the shell material and the toner base material forming no shell-core structure, the wax may be blended in an amount of preferably from 4 to 30 parts by mass, more preferably from 5 to 20 parts by mass, still more preferably from 7 to 15 parts by mass, per 100 parts by mass of the binder resin. If the amount of the wax used is less than this range, satisfactory hot offset resistance can be hardly obtained due to the lack of release force, and if the amount used exceeds the range above, it may be difficult to achieve dust suppression.

However, when the electrostatic image developing toner is produced using a wax having a melting point in the range set forth in the description of the present invention to have a dust emission Dt (CPM) set forth in the description of the present invention, there is no limitation, among others, on the amount of the wax used.

In the case where the toner contains two kinds of waxes, i.e., the wax component X and the wax component Y, as long as a wax having a larger dust emission is selected for the wax component Y than for the wax component X, any of the waxes exemplified above can be used.

As the method for blending the wax in the emulsion polymerization aggregation method, a wax dispersion liquid previously prepared by the emulsification dispersion in water to have a volume average diameter (Mv) of 0.01 to 2.0 μm, preferably from 0.01 to 1.0 μm, more preferably from 0.01 to 0.5 μm, is preferably added at the time of emulsion polymerization or in the aggregation step.

In order to disperse the wax in the toner to have a suitable dispersion particle diameter, it is preferable to add the wax as a seed during emulsion polymerization. Thanks to the addition as a seed, a primary polymer particle including the wax is obtained and in turn, a large amount of wax is not present on the toner surface, so that the chargeability or heat resistance of the toner can be prevented from deterioration. The wax is used by calculating the wax abundance in the primary polymer particle to become preferably from 4 to 30 mass %, more preferably from 5 to 20 mass %, still more preferably from 7 to 15 mass %.

In the toner according to the present invention, a charge-controlling agent may be blended so as to impart charge amount and charge stability. As the charge-controlling agent, conventionally known compounds are used. The compound includes, for example, a metal complex of hydroxycarboxylic acid, a metal complex of azo compound, a naphtholic compound, a metal compound of naphtholic compound, a nigrosine-based dye, a quaternary ammonium salt, and a mixture thereof. The blending amount of the charge-controlling agent is preferably from 0.1 to 5 parts by mass per 100 parts by mass of the resin.

In the case of incorporating a charge-controlling agent into the toner in the emulsification polymerization aggregation method, the charge-controlling agent can be blended by a method where the charge-controlling agent is blended together with a polymerizable monomer, etc. at the time of emulsion polymerization, blended together with a primary polymer particle, a colorant, etc. in the aggregation step, or blended after aggregating a primary polymer particle, a colorant, etc. and reaching a particle diameter suitable as a toner. Of those, the charge-controlling agent is preferably emulsified/dispersed in water by using an emulsifying agent and used as an emulsion having a volume average diameter (Mv) of 0.01 to 3 μm. At the time of emulsion aggregation, the charge-controlling agent dispersion liquid is used by calculating the blending ratio to account for 0.1 to 5 mass % in the finished toner base particle after aggregation.

The volume average diameter (Mv) of the primary polymer particle, colorant dispersion particle, wax dispersion particle, charge-controlling agent dispersion particle, etc. in the dispersion liquid above is measured by means of Nanotrac by the method described in Examples and is defined as the measured value.

In the aggregation step of the emulsion polymerization aggregation method, the above-described blending components, for example, a primary polymer particle, a colorant particle and, if desired, a charge-controlling agent, a wax, etc., are mixed simultaneously or successively, but in view of composition uniformity and particle diameter uniformity, it is preferable to previously produce dispersion liquids of respective components, i.e., a primary polymer particle dispersion liquid, a colorant particle dispersion liquid, a charge-controlling agent dispersion liquid and a wax fine particle dispersion liquid, and mix these dispersion liquids to obtain a mixed dispersion liquid.

The aggregation treatment includes usually a method of heating the dispersion liquid or adding an electrolyte in a stirring tank, and a method of combining these methods. In the case of aggregating primary particles under stirring to obtain a particle aggregate of a size close to the toner size, the particle diameter of the particle aggregate is controlled by the balance between the cohesive force of particles to each other and the shear force by stirring, and the cohesive force can be increased by heating the system or adding an electrolyte.

In the case of performing the aggregation by adding an electrolyte, the electrolyte may be either an organic salt or an inorganic salt but specifically, includes NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, $C_6H_5SO_3Na$, etc. Among these, an inorganic salt having a divalent or higher polyvalent metal cation is preferred.

The blending amount of the electrolyte varies depending on the kind of electrolyte, the objective particle diameter, etc. but is usually from 0.05 to 25 parts by mass, preferably from 0.1 to 15 parts by mass, more preferably from 0.1 to 10 parts by mass, per 100 parts by mass of solid components in the mixed dispersion liquid. If the blending amount is less than this range, the aggregation reaction proceeds slowly and, for example, a fine powder of 1 μm or less may remain even after the aggregation reaction, or the average particle diameter of the particle aggregate obtained may not reach the objective particle diameter. If the blending amount exceeds the range above, abrupt aggregation is likely to occur, making it difficult to control the particle diameter, and there may arise a problem, for example, that a coarse powder or an amorphous particle may be contained in the aggregated particles obtained.

Here, as the method for controlling the particle diameter to fall in the specific range of the present invention, a method of reducing the blending amount of the electrolyte may be employed. In general, when the blending amount of the electrolyte is reduced, the particle growth rate decreases, and this is industrially unfavorable in terms of production efficiency. However, the particle diameter can be controlled to fall in the specific range of the present invention by, contrary to the industrial standpoint, daringly reducing the blending amount of the electrolyte.

In the case of performing the aggregation by adding an electrolyte, the aggregation temperature is preferably from 20 to 70° C., more preferably from 30 to 60° C. Here, controlling the temperature before the aggregation step is also one method for controlling the particle size to fall in the specific range. Some colorants added in the aggregation step also have the property of an electrolyte, and aggregation sometimes occur even without addition of an electrolyte. This aggregation can be prevented by previously lowering the temperature of the primary polymer particle dispersion liquid at the time of mixing of the colorant dispersion liquid. The aggregation gives rise to easy generation of a fine powder and occurrence of unevenness in the particle size distribution. In the present invention, the primary polymer particle is preferably cooled in advance to the range of 0 to 15° C., more preferably from 0 to 12° C., still more preferably from 2 to 10° C.

In the case of performing the aggregation only by heating without using an electrolyte, the aggregation temperature is usually, relative to the glass transition temperature Tg of the primary polymer particle, from (Tg-20° C.) to Tg, preferably from (Tg-10° C.) to (Tg-5° C.).

The time required for the aggregation is optimized according to the apparatus configuration or the processing scale, but in order for the particle diameter of the toner base particle to reach the objective particle diameter, the system is preferably held at a temperature in the range above usually for at least 30 minutes or more. As for the temperature rise to reach the predetermined temperature, the temperature may be raised at a constant rate or may be raised in a stepwise manner.

In the present invention, if desired, a primary polymer particle dispersion liquid may be added (attached or fixed) to the particle aggregate after the above-described aggregation treatment, to form a toner base particle having a shell-core structure.

The shell material preferably contains a primary polymer particle containing or including a wax and having a volume average diameter (Mv) of preferably from 50 to 500 nm, more preferably from 80 to 450 nm, still more preferably from 100 to 400 nm, yet still more preferably from 150 to 350 nm.

When the volume average diameter (Mv) of the wax-including primary polymer particle as the shell material is in this range, the shell agent can be efficiently attached to the core agent and in the case of forming, in the outer wall side of the toner, a region having a high abundance ratio of a wax with a large dust emission, not only higher releasability can be imparted but also the amount of dust generated per hour (dust emission rate: Vd) from an image forming device can be easily controlled to a lower value, so that higher hot offset resistance can be achieved.

For these reasons, it is also preferred as the electrostatic image developing toner that the electrostatic image developing toner has a shell-core structure, the core material of the shell-core structure contains a primary polymer particle containing or including substantially only the wax component X and having a volume average diameter (Mv) of 50 to 500 nm, and the shell material of the shell-core structure contains a primary polymer particle containing or including only the wax component Y and having a volume average diameter (Mv) of 50 to 500 nm.

The resin fine particle is usually used in the form of a dispersion liquid prepared by dispersing the particle in water or a water-based liquid by use of an emulsifying agent. In the case of adding the above-described charge-controlling agent after the aggregation treatment, it is preferable to add the charge-controlling agent to a particle aggregate-containing dispersion liquid and thereafter, add the resin fine particle.

In the emulsion polymerization aggregation method, after the growth of a toner base particle is stopped by adding an emulsifying agent or pH adjusting agent as a dispersion stabilizer and thereby lowering the cohesive force of particles to each other, a ripening step of causing fusion between aggregated particles is preferably added so as to increase the stability of the particle aggregate obtained by aggregation.

Here, the toner of the present invention preferably has a sharp particle size distribution. The method for controlling the particle size to fall in the specific range includes a method of decreasing the stirring rotation speed, i.e., reducing the shear force by stirring, before the step of adding an emulsifying agent or a pH adjusting agent.

In the ripening step, the viscosity of the binder resin is lowered by heating for rounding the particle, but if heating is continued as it is, the growth of the toner base particle is not stopped. Therefore, for the purpose of stopping the growth of the particle diameter by heating, usually, an emulsifying agent or pH adjusting agent may be added as a dispersion stabilizer, or a shear force may be applied by increasing the stirring rotation speed.

In addition, even when the stirring rotation speed is decreased to reduce the shear force on the aggregated particle not before the step of adding a dispersion stabilizer, a toner having a specific particle size distribution can also be obtained. However, considering the capability of adjusting the blending amount of the dispersion stabilizer, the control is preferably performed before the step of adding a dispersion stabilizer.

The temperature in the ripening step is preferably not less than Tg of the binder resin constituting the primary particle, more preferably not less than a temperature 5° C. higher than Tg, and is preferably not more than a temperature 80° C. higher than Tg, more preferably not more than a temperature 50° C. higher than Tg. The time required for the ripening step varies depending on the objective shape of the toner but after reaching a temperature not less than the glass transition temperature of the polymer constituting the primary particles, the particle is preferably held usually for 0.1 to 10 hours, preferably for 1 to 6 hours.

In the emulsion polymerization aggregation method, it is preferable to add an emulsifying agent or raise the pH value of the aggregation solution, after the aggregation step, preferably before the ripening step or during the ripening step. As the emulsifying agent used here, one or more members selected from the emulsifying agents that can be used for the production of the above-described primary polymer particle may be used, but among others, the same emulsifying agent as that used when producing the primary polymer particle is preferably used.

In the case of blending an emulsifying agent, the blending amount of the emulsifying agent is not limited but is preferably 0.1 part by mass or more, more preferably 1 part by mass or more, still more preferably 3 parts by mass or more, and is preferably 20 parts by mass or less, more preferably 15 parts by mass or less, still more preferably 10 parts by mass or less, per 100 parts by mass of solid components in the mixed dispersion liquid. After the aggregation step but before the completion of the ripening step, an emulsifying agent is added or the pH value of the aggregation solution is raised, whereby particle aggregates aggregated in the aggregation step can be prevented from aggregation, etc. with each other and generation of a coarse particle in the toner after the ripening step can be inhibited.

By such a heat treatment, primary particles in the aggregate are fused and integrated, and the shape of the toner base particle as an aggregate also becomes close to a sphere. The particle aggregate before the ripening step is considered to be a bulk material by electrostatic or physical aggregation of primary particles but after the ripening step, the primary polymer particles constituting the particle aggregate are fused together, and the shape of the toner base particle can also be made close to a sphere. Through such a ripening step, a toner of various shapes according to the purpose, for example, a grape bunch shape resulting from the aggregation of primary particles, a potato shape resulting from the progress of fusion, and a sphere resulting from the progress of fusion, can be produced by controlling the temperature, time, etc. in the ripening step.

The particle aggregate obtained through respective steps above is subjected to solid/liquid separation according to a known method to collect particle aggregates, and the collected particle aggregate is washed, if desired, and then dried, whereby the objective toner base particle can be obtained.

In addition, on the surface of the particle obtained by the above-described emulsion polymerization aggregation method, an outer layer mainly composed of a polymer may also be further formed to a thickness of preferably from 0.01 to 0.5 μm, for example, by a spray dry method, an in-situ method, an in-liquid particle coating method or other methods to produce an encapsulated toner base particle.

In the toner produced by the emulsion polymerization aggregation method, the 50% circularity as measured by means of flow-type particle image analyzer FPIA-3000 (manufactured by Malvern Instruments Ltd.) is preferably 0.90 or more, more preferably 0.92 or more, still more preferably 0.95 or more. As the shape is closer to a sphere, there is a tendency that localization of the charging amount in a particle is less likely to occur and the developability becomes uniform, but since production of a completely spherical toner is difficult, the average circularity above is preferably 0.995 or less, more preferably 0.990 or less.

In addition, at least one of peak molecular weights in gel permeation chromatography (hereinafter, sometimes simply referred to as "GPC") of the tetrahydrofuran (THF) soluble content of the toner is preferably 10,000 or more, more preferably 15,000 or more, still more preferably 20,000 or more, and is preferably 100,000 or less, more preferably 80,000 or less, still more preferably 50,000 or less. If all peak molecular weights are less than this range, the mechanical durability in a nonmagnetic one-component development system may be deteriorated, and if all peak molecular weights exceed the range above, the low-temperature fixability or fixing strength may be changed for the worse.

The THF insoluble content of the toner is, when measured by a Celite-filtration gravimetric method, preferably 1 mass % or more, more preferably 2 mass % or more, and is preferably 20 mass % or less, more preferably 10 mass % or less. If the insoluble content is outside the range above, it may become difficult to satisfy both mechanical durability and low-temperature fixability.

The chargeability of the toner produced by the emulsion polymerization aggregation method may be either positive charging or negative charging. The chargeability of the toner can be controlled by adjusting, for example, the selection and content of the charge-controlling agent, or the selection and blending amount of the external additive.

<7. Pulverization Toner>

The method for producing the pulverization toner is not particularly limited as long as the dust emission (CPM) specified in the description of the present invention is achieved, but the method includes, for example, the following production method.

As the resin used for the production of the pulverization toner, a resin appropriately selected from those known to be usable for a toner may be used. For example, a styrene-based resin, a vinyl chloride-based resin, a rosin-modified maleic acid resin, a phenolic resin, an epoxy resin, a saturated or unsaturated polyester resin, an ionomer resin, a polyurethane resin, a silicone resin, a ketone resin, an ethylene-acrylate copolymer, a xylene resin, and a polyvinylbutyral resin are used. One of these resins may be used alone, or some of them may be used in combination.

The polyester resin used for the production of the pulverization toner is obtained by polymerizing a polymerizable monomer composition composed of a polyhydric alcohol and a polybasic acid, if desired, with at least either the polyhydric alcohol or the polybasic acid containing a trivalent or higher polyfunctional component (crosslinking component). Of these, the dihydric alcohol used for the synthesis of the polyester resin includes, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol and 1,6-hexanediol, bisphenol A, hydrogenated bisphenol A, a bisphenol A alkylene oxide adduct such as polyoxyethylenated bisphenol A and polyoxypropylenated bisphenol A, and others. Among these monomers, a bisphenol A alkylene oxide adduct is preferably used as the main component monomer, and an adduct having an average alkylene oxide addition number of 2 to 7 per molecule is more preferred.

The trihydric or higher polyhydric alcohol participating in crosslinking of the polyester includes, for example, sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and others.

On the other hand, the polybasic acid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, an anhydride or lower alkyl ester of these acids, alkenylsuccinic or alkylsuccinic acids such as n-dodecenylsuccinic acid and n-dodecylsuccinic acid, and other divalent organic acids.

The trivalent or higher polybasic acid participating in crosslinking of the polyester includes, for example, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, an anhydride thereof, and others.

These polyester resins can be synthesized by an ordinary method. Specifically, the conditions such as reaction temperature (from 170 to 250° C.) and reaction pressure (from 5 mmHg to atmospheric pressure) may be determined according to the reactivity of the monomer, and the reaction may be terminated when the predetermined physical properties are obtained. The softening point (Sp) of the polyester resin is preferably from 90 to 135° C., more preferably from 95 to 133° C. The range of Tg is, for example, from 50 to 65° C. when the softening point is 90° C., and from 60 to 75° C. when the softening point is 135° C. In this case, if Sp is less than this range, an offset phenomenon at the time of fixing is likely to occur, and if the softening point exceeds the range above, the fixing energy increases and in the case of a color toner, the glossiness and transparency tend to be disadvantageously deteriorated. In addition, if Tg is less than the range described above, toner blocking or caking readily occurs, and if the transition temperature exceeds the range, the fixing strength at the time of heat fixing tends to be disadvantageously reduced.

Sp can be controlled mainly by the molecular weight of the resin, and when the tetrahydrofuran soluble content of the resin is measured by GPC method, the molecular weight is, in terms of the number average molecular weight, preferably set to be from 2,000 to 20,000, more preferably from 3,000 to 12,000. In addition, Tg can be controlled mainly by selecting the monomer component constituting the resin, and specifically, Tg can be elevated by using, for the acid component, an aromatic polybasic acid as the main component. That is, out of the above-described polybasic acids, phthalic acid, isophthalic acid, terephthalic acid, 1,2,4-benzenetricarboxylic acid, 1,2,5-benzenetricarboxylic acid, an anhydride or lower alkyl ester thereof, etc. is preferably used as the main component.

Sp is defined as a value measured using the flow tester described in JIS K7210 (1999) and K6719 (1999). Specifically, using a flow tester (CFT-500, manufactured by Shimadzu Corporation), about 1 g of a sample is heated for a preheating time of 5 minutes at 50° C. at a temperature rise rate of 3° C./min while applying a load of 30 kg/cm$^2$ by a plunger with an area of 1 cm$^2$ and extruded from a die having a hole diameter of 1 mm and a length of 10 mm. A plunger stroke-temperature profile curve is drawn and assuming that the height of the S-shaped curve is h, the temperature corresponding to h/2 is defined as the softening point. In addition, Tg is defined as a value measured in a conventional manner by using a differential scanning calorimeter (DSC7 manufactured by Perkin Elmer Co., Ltd, or DSC 120 of Seiko Instruments & Electronics Ltd.)).

In general, when the acid value of the polyester resin is too high, a stable and high charging amount is difficult to obtain, and the charging stability in high-temperature high-humidity environment tends to be also deteriorated. On this account, in the present invention, the acid value is preferably adjusted to 50 mgKOH/g or less, more preferably 30 mg KOH/g or less, and most preferably from 3 to 15 mg KOH/g. The method for adjusting the acid value to the range above includes, for example, a method of controlling the blending ratio of alcohol-based and acid-based monomers used at the time of synthesis of the resin, a method of synthesizing the resin by using an acid monomer component previously converted into a lower alkyl ester by transesterification, etc., and a method of neutralizing the remaining acid group by blending, in the composition, a basic component such as amino group-containing glycol, but needless to say, the method for adjustment is not limited thereto, and all known methods can be employed. The acid value of the polyester resin is measured in conformity with the method of JIS K0070 (1992). However, in the case where the resin is hardly soluble in a solvent, a good solvent such as dioxane is used.

As the polyester resin, when the glass transition temperature (Tg) as an x-axis variable and the softening point (Sp) as a y-axis variable are plotted in the xy coordinates, a polyester resin having physical properties in the range surrounded by straight lines represented by the following formulae (i) to (iv) is preferred. The unit of Tg and Sp is "° C.".

$$Sp=4\times Tg-110 \quad \text{Formula (i)}$$

$$Sp=4\times Tg-170 \quad \text{Formula (ii)}$$

$$Sp=90 \quad \text{Formula (iii)}$$

$$Sp=135 \quad \text{Formula (iv)}$$

In the case where the polyester resin having the physical properties surrounded by the straight lines represented by formulae (i) to (iv) is used for a pulverization toner, the pulverization toner is very highly resistant to mechanical stress and moreover, in continuous use, etc., the toner can avoid cohesion or solidification due to heat generated by friction and can maintain appropriate chargeability over a long period of time.

Also in the pulverization toner, the colorant may be a colorant that is usually employed, and is not particularly limited. For example, the colorant used for the polymerization toner described above can be used. The content ratio of the colorant may be sufficient if it is an amount large enough for the obtained toner to form a visible image by development, and the content in a toner at the same level as the polymerization toner is, for example, preferably from 1 to 25 parts by mass, more preferably from 1 to 15 parts by mass, still more preferably from 3 to 12 parts by mass.

The pulverization toner may contain other constituent materials. For example, as the charge-controlling agent, all known charge-controlling agents are usable. For example, a nigrosine dye, an amino group-containing vinyl-based copolymer, a quaternary ammonium salt compound, a polyamine resin, etc. are known for positive charging, and a metal-containing azo dye containing a metal such as chromium, zinc, iron, cobalt or aluminum, a salt or complex of salicylic acid or alkylsalicylic acid with the metal above, etc. are known for negative charging.

The amount of the charge-controlling agent used is preferably from 0.1 to 25 parts by mass, more preferably from 1 to 15 parts by mass, per 100 parts by mass of the resin. In this case, the charge-controlling agent may be blended in the resin or may be used in the form of being attached to the toner based particle surface.

Among these charge-controlling agents, when the charge imparting ability to toner and the adaptability to color toner (the charge-controlling agent itself is colorless or pale and has no color hindrance to toner) are taken into account, an amino group-containing vinyl-based copolymer and/or a quaternary ammonium salt compound are preferred for positive charging, and metal salts and metal complexes of salicylic acid or alkylsalicylic acid with chromium, zinc, aluminum, boron, etc. are preferred for negative charging.

Of these, the amino group-containing vinyl-based copolymer includes, for example, a copolymer resin of amino-acrylates with styrene, methyl methacrylate, etc., such as N,N-dimethylaminomethyl acrylate and N,N-diethylaminomethyl acrylate. The quaternary ammonium salt compound includes, for example, a salt-forming compound of tetraethylammonium chloride or benzyltributylammonium chloride with naphtholsulfonic acid. For the positively charging toner, the above-described amino group-containing vinyl-based copolymer and quaternary ammonium salt compound may be blended individually or may be used in combination.

As the metal salt and metal complex of salicylic acid or alkylsalicylic acid, among known substances, a chromium, zinc or boron complex of 3,5-di-tertiary-butylsalicylic acid is preferred. In addition, the colorant or charge-controlling agent described above may be in advance subjected to a pre-dispersion treatment by pre-kneading, etc. with a resin, namely, a so-called masterbatch treatment, so as to improve the dispersibility and compatibility in the toner.

The pulverization toner preferably contains at least one fine particle additive in its particle surface. This aims mainly at not only improving the tackiness, cohesiveness, fluidity, etc. of the toner base particle but also improving the triboelectric chargeability and durability of the toner. Specifically, the fine particle additive includes an organic or inorganic fine particle having an average primary particle diameter of 0.001 to 5 μm, preferably from 0.002 to 3 μm, which may be surface-treated, and examples thereof include a fluororesin powder such as polyvinylidene fluoride and polytetrafluoroethylene, a fatty acid metal salt such as zinc stearate and calcium stearate, resin beads using polymethyl methacrylate, silicone resin, etc. as the main component, minerals such as talc and hydrotalcite, and a metal oxide such as silicon oxide, aluminum oxide, titanium oxide, zinc oxide and tin oxide.

Among these, a silicon oxide fine particle is preferred, and a silicon oxide fine particle of which surface is hydrophobized is more preferred. The method for hydrophobization includes, for example, a method of chemically treating a silicon oxide fine particle by the reaction or physical adsorption with, e.g., an organic silicon compound such as hexamethyldisilazane, trimethylsilane, dimethyldichlorosilane and silicone oil. The BET specific surface area thereof is preferably from 20 to 200 $m^2/g$. The blending ratio of such a fine particle additive relative to the pulverization toner is preferably from 0.01 to 10 mass %, more preferably from 0.05 to 5 mass %, of the entire toner base particle.

The wax in the pulverization toner is also not particularly limited as long as the electrostatic image developing toner is produced to have a dust emission (CPM) specified in the description of the present invention, and examples of the wax that is suitably used include an olefin-based wax such as low-molecular-weight polyethylene, low-molecular-weight polypropylene and copolymerized polyethylene; paraffin wax; a long-chain aliphatic group-containing ester-based wax such as behenyl behenate, montanic acid ester and stearyl stearate; a vegetable wax such as hydrogenated castor oil and carnauba wax; a long-chain alkyl group-containing ketone such as distearyl ketone; an alkyl group-containing silicone; a higher fatty acid such as stearic acid; a long-chain aliphatic alcohol such as eicosanol; a carboxylic acid ester or partial ester of a polyhydric alcohol, obtained from a polyhydric alcohol such as glycerin and pentaerythritol, and a long-chain fatty acid; a higher fatty acid amide such as oleic acid amide and stearic acid amide; and a low-molecular-weight polyester. Among these, a hydrocarbon-based wax (Fischer-Tropsch wax, microcrystalline wax, polyethylene wax, polypropylene wax), and an ester-based wax (an esterification product of a long-chain fatty acid and a long-chain alcohol, or an esterification product of a long-chain fatty acid and a polyhydric alcohol) are suitably used.

The method for producing the pulverization toner includes the following example:

1. a resin, a charge-controlling agent, a colorant and additives added, if desired, are uniformly dispersed by means of a Henschel mixer, etc., 2. the dispersion is melt-kneaded by means of a kneader, an extruder, a roll mill, etc., 3. the kneaded product is coarsely pulverized by means of a hammer mill, a cutter mill, etc. and then finely pulverized by means of a jet mill, an I-type mill, etc.

4. the finely pulverized powder is classified by means of a dispersion classifier, a zigzag classifier, etc., and 5. depending on the case, silica, etc. is dispersed in the classified powder by means of a Henschel mixer, etc.

The thus-obtained pulverization toner is very highly resistant to mechanical stress and moreover, in continuous use, etc., the toner can avoid cohesion or solidification due to heat generated by friction and can maintain appropriate chargeability over a long period of time, ensuring suitability particularly as a toner for nonmagnetic one-component development system.

<8. Toner>

The volume median diameter (hereinafter, sometimes simply referred to as "Dv50") of the electrostatic image developing toner is measured by means of Multisizer III manufactured by Beckman Coulter K.K. (aperture diameter: 100 μm) by using, as the dispersion medium, Isoton II produced by the same company and dispersing the toner to afford a dispersoid concentration of 0.03 mass %. The particle diameter is measured in a range from 2.00 to 64.00 μm and after this range is discretized into 256 divisions at equal intervals on a logarithmic scale, the value calculated from their statistical values on the volume basis is defined as the volume median diameter (Dv50). In addition, the value calculated from the statistical values on the number basis is defined as the number median diameter (Dn50).

In the present invention, the "toner" is obtained by blending the later-described external additive, etc. with a "toner base particle". Since Dv50 above is Dv50 of the "toner", the "toner" is naturally used as the measurement sample and measured according to the above-described method. However, the measurement of a toner base particle before external addition also gives the same Dv50 and therefore, not only the volume median diameter (Dv50) of the toner but also that of the toner base particle are measured by the method above. Furthermore, even when a wet-process toner obtained by an emulsion polymerization aggregation method, etc., in the state of a dispersion liquid before filtration and drying, is measured by substantially dispersing it in the dispersion medium, Isoton II, to afford a dispersoid concentration of 0.03% by mass, the obtained Dv50 is substantially the same as that of the toner and therefore, the toner base particle in the state of a dispersion liquid before filtration and drying is also measured by the method above.

The thus-obtained toner base particle may be formed into a toner by blending known external additives to the surface of the toner base particle so as to control the flowability or developability. The external additive includes, for example, a metal oxide or hydroxide such as alumina, silica, titania, zinc oxide, zirconium oxide, cerium oxide, talc and hydrotalcite, a metal titanate such as calcium titanate, strontium titanate and barium titanate, a nitride such as titanium nitride and silicon nitride, a carbide such as titanium carbide and silicon carbide, and an organic particle of acrylic resin, melamine resin, etc., and a plurality of external additives may be combined. Among others, silica, titania and alumina are preferred, and such an external additive is more preferably surface-treated with a silane coupling agent, a silicone oil, etc.

The average primary particle diameter thereof is preferably from 1 to 500 nm, more preferably from 5 to 100 nm. In addition, it is also preferable to use, within the particle diameter range above, a small-size particle and a large-size particle in combination. The total of blending amounts of external additives is preferably from 0.05 to 10 parts by mass, more preferably from 0.1 to 5 parts by mass, per 100 parts by mass of the toner base particle.

Furthermore, the value (Dv/Dn) obtained by dividing Dv by Dn is preferably from 1.0 to 1.25, more preferably from 1.0 to 1.20, still more preferably from 1.0 to 1.15, and is preferably closer to 1.0. An electrostatic image developing toner having a sharp particle size distribution tends to exhibit uniform chargeability between particle solids, and therefore, DV/Dn of the electrostatic image developing toner for achieving high image quality and high-speed image formation is preferably in the range above.

The electrostatic image developing toner of the present invention may be used for any of a magnetic two-component developer where a carrier for conveying the toner to an electrostatic latent image part by magnetic force is present together, a magnetic one-component developer where a magnetic powder is incorporated into the toner, or a non-magnetic one-component developer where a magnetic powder is not used in the developer. In order to remarkably bring out the effects of the present invention, among others, the toner is preferably used as a developer for nonmagnetic one-component development system.

In the case of using the toner as the above-described magnetic two-component developer, as the carrier mixed with the toner to form the developer, a known magnetic substance such as magnetic powder-based, ferrite-based or magnetite-based carrier, the magnetic substance above where resin coating is applied to the surface, or a magnetic resin carrier may be used. The usable coat resin of the carrier includes, but is not limited to, a generally known resin such as styrene-based resin, acrylic resin, styrene-acrylic copolymer resin, silicone-based resin, modified silicone-based resin and fluororesin. The average particle diameter of the carrier is not particularly limited, but a carrier having an average particle diameter of 10 to 200 μm is preferred. Such a carrier is preferably used in an amount of 5 to 100 parts by mass per 1 part by mass of the toner.

EXAMPLES

The present invention is described more specifically below by referring to Examples, but the present invention is not limited to the following Examples as long as its gist is observed. In Examples, "parts" means "parts by mass".

[Measurement Method and Definition]

<Measurement Method and Definition of Peak Temperature (TT1) Observed at 61 to 73° C. in First Temperature Rise in DSC>

A thermal analyzer (DSC220U/SSC5200 System) manufactured by SII Nanotechnology Inc. (formerly Seiko Instruments Inc.) was used.

As for the measurement method, the measurement was carried out in a nitrogen atmosphere, and 7 mg of aluminum oxide and 10 mg of an electrostatic image developing toner were put in the standard pan and the sample pan, respectively. Subsequently, the temperature was raised from 10° C. to 121° C. at a rate of 10° C./min, and the largest endothermic peak or shoulder observed at 61.0 to 73.0 in this first temperature rise is defined as TT1 (° C.). The results are shown in Table 2.

<Measurement Method and Definition of Decay Degree (TT1R) of TT1 in Second Temperature Rise in DSC>

The same apparatus as in the measurement of TT1 above was used. As for the measurement method, the measurement was carried out in a nitrogen atmosphere, and 7 mg of aluminum oxide and 10 mg of an electrostatic image developing toner were put in the standard pan and the sample pan, respectively. Subsequently, the temperature was raised from 10° C. to 121° C. at a rate of 10° C./min, held at 121° C. for 10 minutes, then lowered from 121° C. to 10° C. at a rate of 10° C./min, held at 10° C. for 5 minutes, and further raised from 10° C. to 120° C. at a rate of 10° C./min.

In the process of this measurement, the Heat Flow (W/g) value at 50° C. in the first elevated temperature process is defined as HF1_50° C. and employed as the Heat Flow base line in the first elevated temperature process, and the results are shown in Table 2. Furthermore, the Heat Flow (W/g) value at the largest endothermic peak or shoulder temperature TT1 observed between 61° C. and 73° C. in the first elevated temperature process is defined as HF1_P and shown in Table 2. The value obtained by subtracting the base line HF1_50° C. from the HF1_P value is taken as the substantial Heat Flow (W/g) value in the first elevated temperature process and shown as HF1_T1 in Table 2.

Then, the Heat Flow (W/g) value at 50° C. in the second elevated temperature process is defined as HF2_50° C. and employed as the Heat Flow base line in the second elevated temperature process, and the results are shown in Table 2. Furthermore, the Heat Flow (W/g) value in the second elevated temperature process at the largest endothermic peak or shoulder temperature TT1 observed between 61° C. and 73° C. in the first elevated temperature process is defined as HF2_P and shown in Table 2. The value obtained by subtracting the base line HF2_50° C. from the HF2_P value is taken as the substantial Heat Flow (W/g) value in the second elevated temperature process and shown as HF2T1 in Table 2.

The HF2_T1 value is lower than HF1_T1 because of a decay derived from enthalpy relaxation of the electrostatic image developing toner, and the value of HF2_T1÷HF1_T1 is shown as RTT1 in Table 2 (measurement method RTT1).

<Measurement Method and Definition of Melting Point of Wax in the State of being Contained in Electrostatic Image Developing Toner>

The same apparatus as in the measurement of TT1 above was used. As for the measurement method (MpW), the measurement was carried out in a nitrogen atmosphere, and 7 mg of aluminum oxide and 10 mg of an electrostatic image developing toner were put in the standard pan and the sample pan, respectively. Subsequently, the temperature was raised from 10° C. to 121° C. at a rate of 10° C./min, held at 121° C. for 10 minutes, then lowered from 121° C. to 10° C. at a rate of 10° C./min, held at 10° C. for 5 minutes, and further raised from 10° C. to 120° C. at a rate of 10° C./min, and the endothermic peak or shoulder temperature in this second temperature rise is taken as the melting point of wax in the state of being contained in the electrostatic image developing toner. More specifically, since the peak derived from enthalpy relaxation at the glass transition point of the resin in the toner disappears and the melting point of the wax can be clearly observed by reading the peak in the second temperature rise, the data in the second temperature rise is employed as the melting point of wax in the state of being contained in the electrostatic image developing toner and shown, in Table 1, as HFW1 and HFW2 in the order of the endothermic peak or shoulder becoming small In addition, the melting point of the wax alone was measured by observing the peak or shoulder in the second temperature rise in DSC similarly to the method above except that the weight of the sample was changed to 3.5 mg.

The melting point of the wax in the state of being contained in the electrostatic image developing toner and the melting point of the wax alone or wax mixture often show different melting points or give different endothermic profiles relative to the temperature in DSC measurement, for example, when the wax is compatibilized with a resin or a wax different from the wax, and for this reason, the melting point of the wax alone and the melting point of the wax in the state of being contained in the electrostatic image developing toner were measured separately.

<Measurement Method and Definition of Average Value of Phase Difference (Average Value of Tan δ) in High Strain Rate Region>

As the preliminary sample preparation, 1.3 g of an electrostatic image developing toner was put in a metal-made tube having a diameter of 25 mm and press-molded for 10 minutes by heating the toner with the metal container at 50° C. while applying a load of 30 kg/cm$^2$.

A dynamic viscoelasticity measuring device (ARES) manufactured by TA Instruments Japan Inc. was used, and TA Orchestrator Ver 7.2.0.2 produced by the same company was used for the analysis and operating software.

The preliminarily prepared sample was sandwiched between parallel plates of 25 mm in diameter and heated to 120° C. and at the point when the softened sample was crushed by narrowing the space between the parallel plates to 3.2 mm, the normal stress was fixed.

Thereafter, the frequency at temperatures of 120° C. and 140° C. was swept in the range of 1 to 100 rad/sec under the condition of a strain of 0.1%. Detailed measurement conditions are described below.

Strain: 0.1%
Sweep Mode: Log
Initial Frequency: 1.0 rad/sec
Final Frequency: 100 rad per sec
Point per Decade: 20
Initial Temp 120.0° C.
Final Temp 140.0° C.
Temp Increment: 20.0° C.
Soak Time: 1:00

From the results measured in this way, the values of tan δ at a frequency of 20 to 100 rad/sec in measurement at 140° C. were averaged, whereby the average value of phase difference in the high strain rate region (in Table 2, indicated as tan δ Ave) was determined. The results are shown in Table 2.

<Measurement Method and Definition of Plasticization Initiating Temperature (TPR)>

As the preliminary sample preparation, 1.3 g of an electrostatic image developing toner was put in a metal-made tube having a diameter of 25 mm and press-molded for 10 minutes by heating the toner with the metal container at 50° C. while applying a load of 30 kg/cm$^2$.

A dynamic viscoelasticity measuring device (ARES) manufactured by TA Instruments Japan Inc. was used, and TA Orchestrator Ver 7.2.0.2 produced by the same company was used for the analysis and operating software.

The preliminarily prepared sample was sandwiched between parallel plates of 25 mm in diameter and heated to 120° C. and at the point when the softened sample was crushed by narrowing the space between the parallel plates to 3.2 mm, the normal stress was fixed. Then, the temperature was once lowered to 40° C.

Thereafter, the temperature was swept from 40 to 100° C. at a temperature rise rate of 4° C./min under the conditions of a frequency of 6.28 rad/sec and a strain of 0.1%, and the temperature (TPR) when the storage modulus became $10^6$ (Pa) at the time of sweeping was defined as the plasticization initiating temperature of the electrostatic image developing toner. The temperature determined is shown in Table 2.

As for detailed measurement conditions, the measurement was carried out under the following conditions in TA Orchestrator Ver 7.2.02.

Test setup: Predefined (Test Setup Dynamic Temperature Ramp Test)
Test Type: Strain Controlled
Measure Type: Dynamic
Frequency: 6.28 rad/sec
Initial Temp.: 40.0° C.
Final Temp.: 205° C.
Ramp Rate: 4.0° C./min
Soak Time After Ramp: 20
Time per Mesure: 1
Strain: 0.1%
Options
Auto tension Adjustment
Auto Tension Direction: Tension
Initial Static Force: 0.0 g
Auto Tension Sensitivity 2.0 g
Switch Auto Tension to Programmed Extension When Sample Modulus: 1.0e+8
Auto Strain Adjustment
MAX Applied Strain: 40.0%
MAX Allowed Torque: 1,000 g-cm
MIN Allowed Torque: 2.0 g-cm
Strain Adjustment: 20.0% of Current Strain <Measurement Method and Definition of Volume Average Diameter (Mv) and Number Average Diameter (Mn) of Pigment Dispersion Liquid, Primary Polymer Particle Dispersion Liquid and Wax Dispersion Liquid>

The volume average diameter (Mv) and number average diameter (Mn) of a pigment dispersion liquid, a primary polymer particle dispersion liquid or a wax dispersion liquid were measured by means of Model: Microtrac Nanotrac 150 (hereinafter, simply referred to as "Nanotrac") manufactured by Nikkiso Co., Ltd. and an analysis software, Microtrac Particle Analyzer Ver 10.1.2.-019EE, produced by the same company by the method described in the instruction manual of Nanotrac by using, as the dispersion medium, ion-exchanged water having electric conductivity of 0.5 μS/cm and employing the following measurement conditions or inputting the following conditions.

With respect to the primary polymer particle dispersion liquid and the wax dispersion liquid:
solvent refractive index: 1.333
measurement time: 100 seconds
number of measurements: 1
particle refractive index: 1.59
transmissivity: transparent
shape: truly spherical
density: 1.04

With respect to the pigment premix liquid and the colorant dispersion liquid:
solvent refractive index: 1.333
measurement time: 100 seconds
number of measurements: 1
particle refractive index: 1.59
transmissivity: absorbing
shape: non-spherical
density: 1.00

<Measurement Method and Definition of Volume Median Diameter (Dv50) and Number Median Diameter (Dn50) of Electrostatic Image Developing Toner>

A treatment before measurement of a toner finally obtained through an external addition step was performed as follows.

A cylindrical polyethylene (PE)-made beaker having an inner diameter of 47 mm and a height of 51 mm was added with 0.100 g of the toner by means of a spatula and 0.15 g of an aqueous 20 mass % DBS solution (NEOGEN S-20D, produced by Daiichi Kogyo Seiyaku Co., Ltd.) by means of a dropper. At this time, in order to avoid scattering of the toner to the rim, etc. of the beaker, the toner and the aqueous 20% DBS solution were put only in the bottom of the beaker. Next, the toner and the aqueous 20% DBS solution were stirred for 3 minutes by means of a spatula until turned into a paste. Also at this time, care was taken to allow for no scattering of the toner to the rim, etc. of the beaker.

Subsequently, 30 g of a dispersion medium Isoton II was added, and the mixture was stirred for 2 minutes by means of a spatula to form an entirely uniform solution as visually observed. A fluororesin-coated rotor having a length of 31 mm and a diameter of 6 mm was then put in the beaker, and the solution was dispersed at 400 rpm for 20 minutes by means of a stirrer. At this time, macroscopic particles as visually observed at the air-liquid interface and the rim of the beaker were caused to fall into the inside of the beaker by means of a spatula at a rate of once each three minutes and treated to form a uniform dispersion liquid. Thereafter, the dispersion liquid was filtered through a mesh having an opening of and the obtained filtrate was designated as "toner dispersion liquid".

As to the measurement of the particle diameter in the process of producing a toner base particle, the filtrate obtained by filtering the slurry during aggregation through a mesh of 63 μm was designated as "slurry liquid".

The median diameter (Dv50 and Dn50) of the particle was measured by means of Multisizer III manufactured by Beckman Coulter K.K. (aperture diameter: 100 μm) (hereinafter, simply referred to as "Multisizer") by using, as the dispersion medium, Isoton II produced by the same company and diluting the "toner dispersion liquid" or "slurry liquid" to afford a dispersoid concentration of 0.03 mass %, where a Multisizer III analysis software was used and the KD value was set to 118.5. The particle diameter was measured in a range from 2.00 to 64.00 μm and after this range was discretized into 256 divisions at equal intervals on a logarithmic scale, the value calculated from their statistical values on the volume basis was defined as the volume median diameter (Dv50), and the value calculated from the statistical values on the number basis was defined as the number median diameter (Dn50).

The thus-measured volume median diameter (Dv50) and number median diameter (Dn50) of the electrostatic image developing toner are shown in Table 1.

<Measurement Method and Definition of Average Circularity>

In the present invention, the "average circularity" is measured as follows and defined as follows. That is, toner base particles were dispersed in a dispersion medium (Isoton II, produced by Beckman Coulter K.K.) to afford a concentration of 5,720 to 7,140 particles/μL and measured by means of a flow-type particle image analyzer (FPIA3000, manufactured by SYSMEX Corporation) under the following apparatus conditions, and the obtained value is defined as the "average circularity". In the present invention, the same measurement is performed three times, and the arithmetic average value of three "average circularity" values is employed as the "average circularity".

Mode: HPF

HPF Analysis amount: 0.35 μL

Number of particles detected by HPF: 8,000 to 10,000

The followings are values determined by the apparatus above and displayed thereon through automatic calculation made in the apparatus, but the "circularity" is defined by the following formula:

[Circularity]=[circumferential length of circle having the same area as the projected area of particle]/[circumferential length of the projected image of particle]

From 8,000 to 10,000 particles as the number of particles detected by HPF were measured, and the arithmetic average (arithmetic mean) of the circularity values of individual particles is displayed on the apparatus as the "average circularity".

The thus-measured average circularity of the electrostatic image developing toner is shown in Table 1.

<Dust Detection/Measuring Apparatus>

The dust detection/measuring apparatus used in Examples is described.

Figure 6:
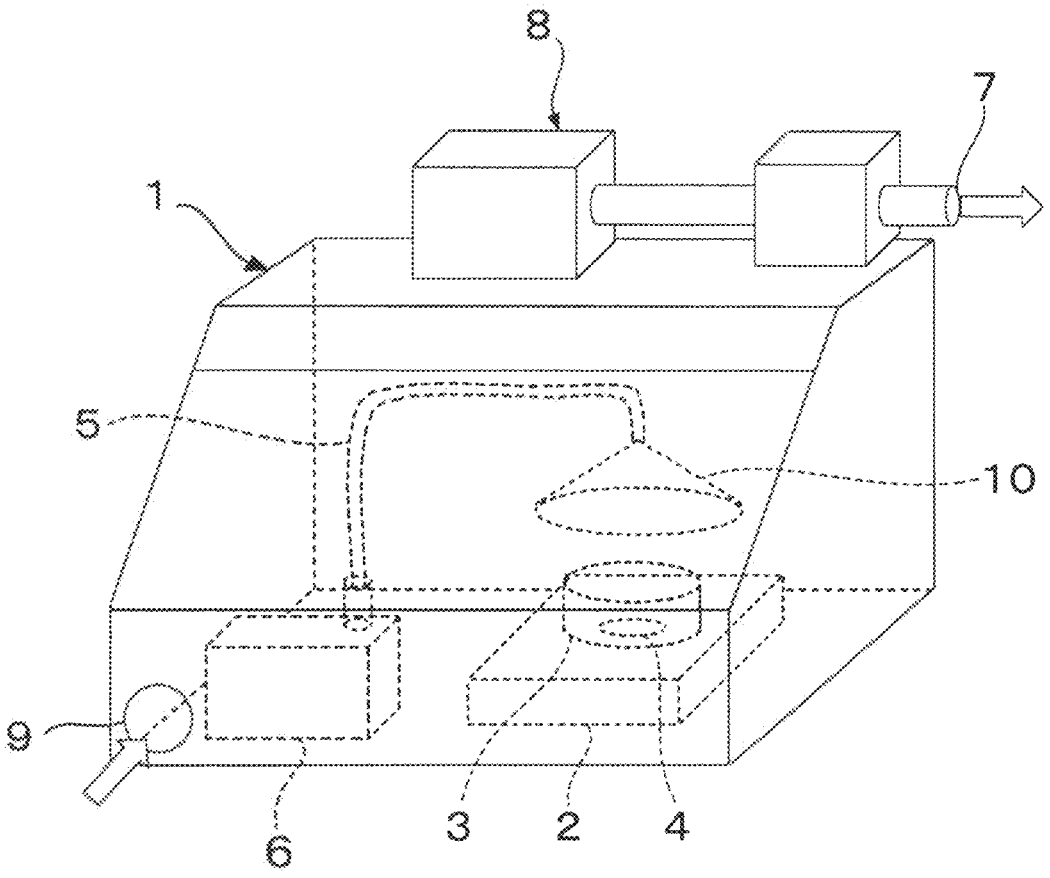
FIG. 6 is a view showing a schematic configuration of a dust detection/measuring apparatus.

FIG. 6 is a view showing a schematic configuration of the dust detection/measuring apparatus used in Examples. As shown in FIG. 6, the dust detection/measuring apparatus used in Examples is equipped with an intake port 9 for introducing ambient air or an inert gas into a draft 1 and an exhaust fan 8 having an exhaust port 7 for discharging such a gas, and inside the draft 1, a heating device (hot plate) 2 for heating a sample 4 put in a sample cup (aluminum cup) 3 and measuring the dust emission is provided. Above the heating device 2, a funnel-like cone collector 10 for collecting dust generated at the time of heating the sample 4 put in the sample cup 3 with the heating device 2 is arranged. The cone collector 10 is connected to a dust measuring device 6 via a suction duct 5.

In FIG. 6, the sample cup 3 is cylindrical, but in practice, a mortar-shaped cup was used. However, the shape of the sample cup is not particularly limited as long as the top of the opening is kept from narrowing.

In the dust detection/measuring apparatus shown in FIG. 6, for the dust measuring device 6, a digital dust monitor "DUSTMATE Model LD-3K2" manufactured by SHIBATA Scientific Technology Ltd. was used. In addition, for the draft 1, Labohood FUMRHOOD LF-600 Set (aeration: 6.7 $m^3$/min, static pressure: 0.36 kPa, consumption power: 93 W) was used, and for the exhaust fan 8, NS-K-20PS manufactured by Mitsubishi Electric Corporation was used.

Figure 7:
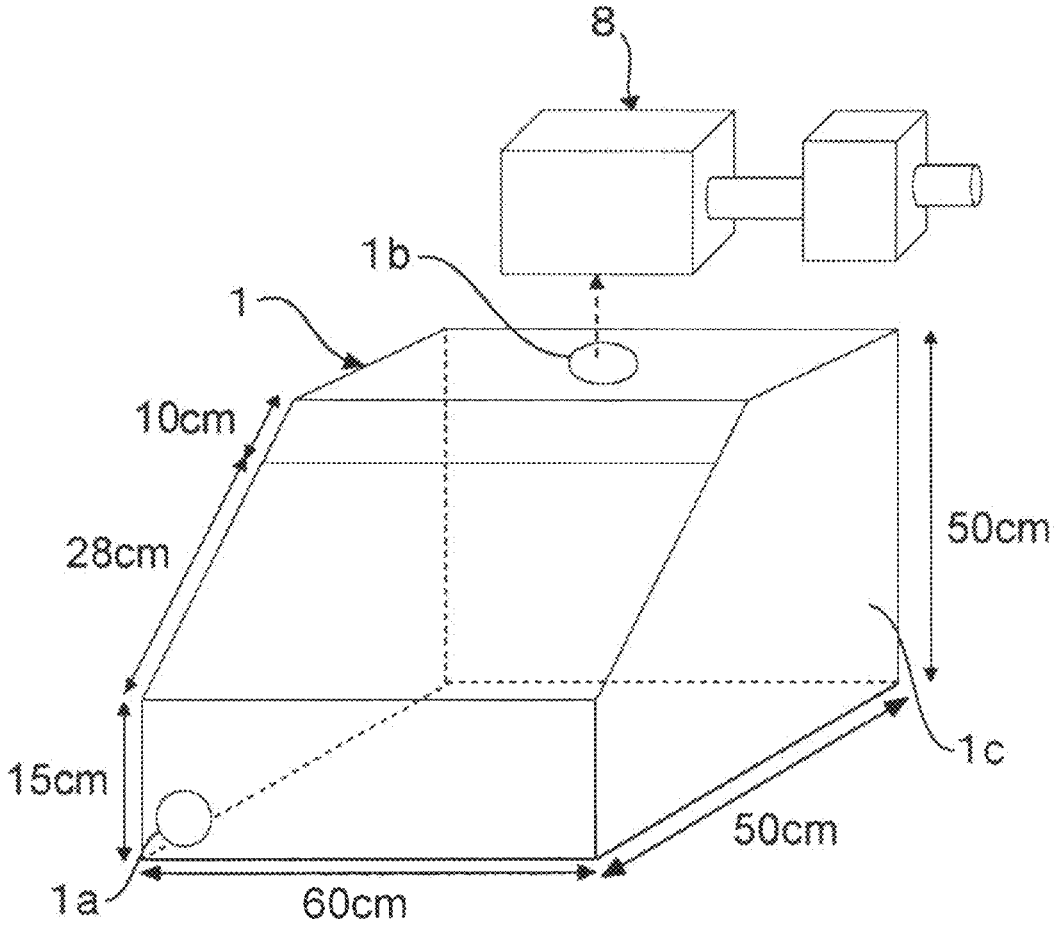
FIG. 7 is an explanatory view illustrating the specific size data of a draft 1 of the dust detection/measuring apparatus shown in FIG. 6.

FIG. 7 is an explanatory view depicting the specific configuration and size of the draft 1 of the dust detection/measuring apparatus shown in FIG. 6. In FIG. 7, each length (cm) shows the specific length of each region of the draft 1 of the dust detection/measuring apparatus used in Examples. In FIG. 7, 1*a* is an air inlet port (intake port) for the draft, serving also as a power source cable port and having a diameter of 3 cm. In FIG. 7, 1*b* is an exhaust port for the draft, having a diameter of 10 cm. In FIG. 7, the draft 1 and the exhaust fan 8 are shown as divided, but as in FIG. 6, the exhaust fan 8 communicates with the exhaust port 1*b* for the draft. The draft 1 is openable and closable at the portion of 28 cm×60 cm in the front of the apparatus, and the sample can be taken in/out therethrough.

Figure 8:
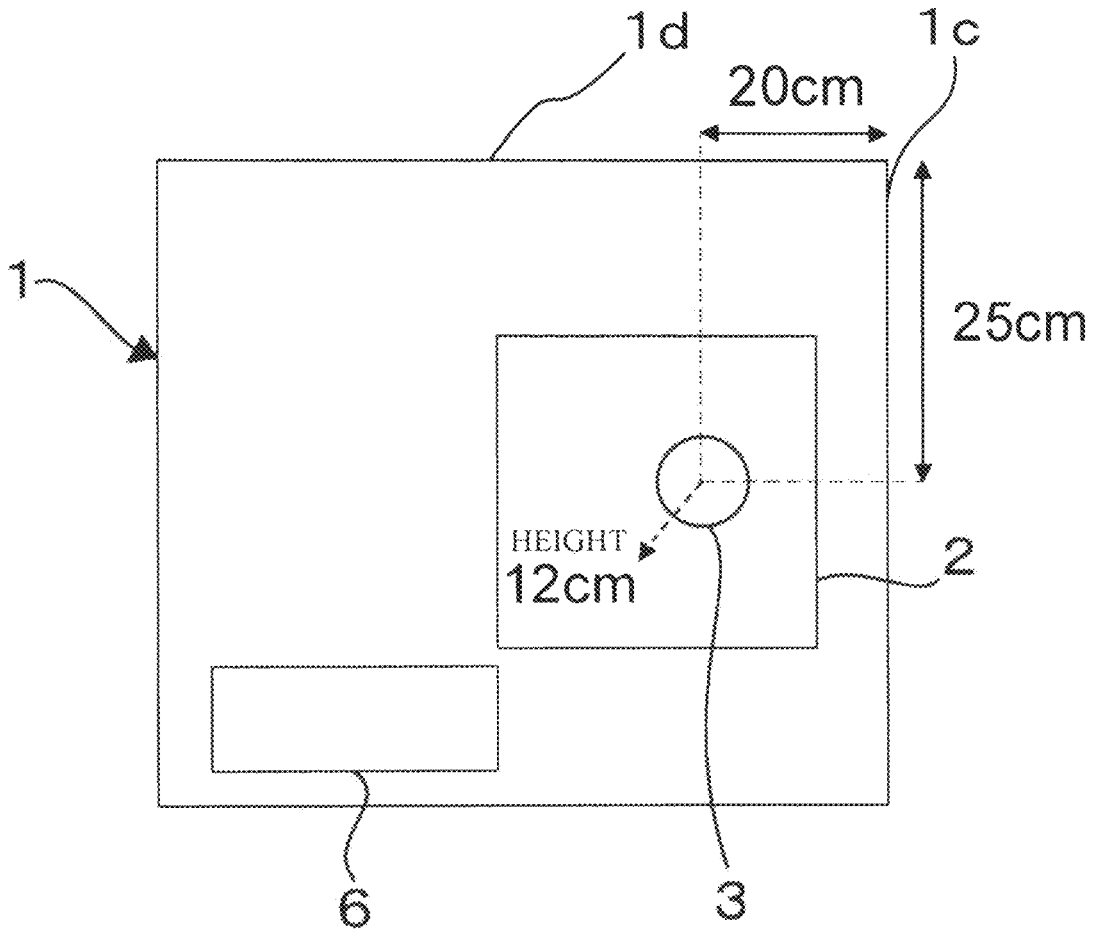
FIG. 8 is a plan view, as seen from the top, of part of the inside of the dust detection/measuring apparatus shown in FIG. 6.

FIG. 8 is a plan view, as seen from the top, of part of the inside of the dust detection/measuring apparatus shown in FIG. 6. As shown in FIG. 8, the sample cup (aluminum cup) 3 placed on the heating device (hot plate) 2 is disposed such that that the center of the sample cup comes to a position 20 cm apart from a right-hand wall 1*c* of the draft 1 and 25 cm apart from a rear-side wall 1*d* of the draft 1. For the sample cup (aluminum cup) 3, a cup having a diameter of 6 cm was used. The height 12 cm in FIG. 8 indicates the height from the floor of the draft 1 to the surface of the sample put in the sample cup 3.

Figure 9:
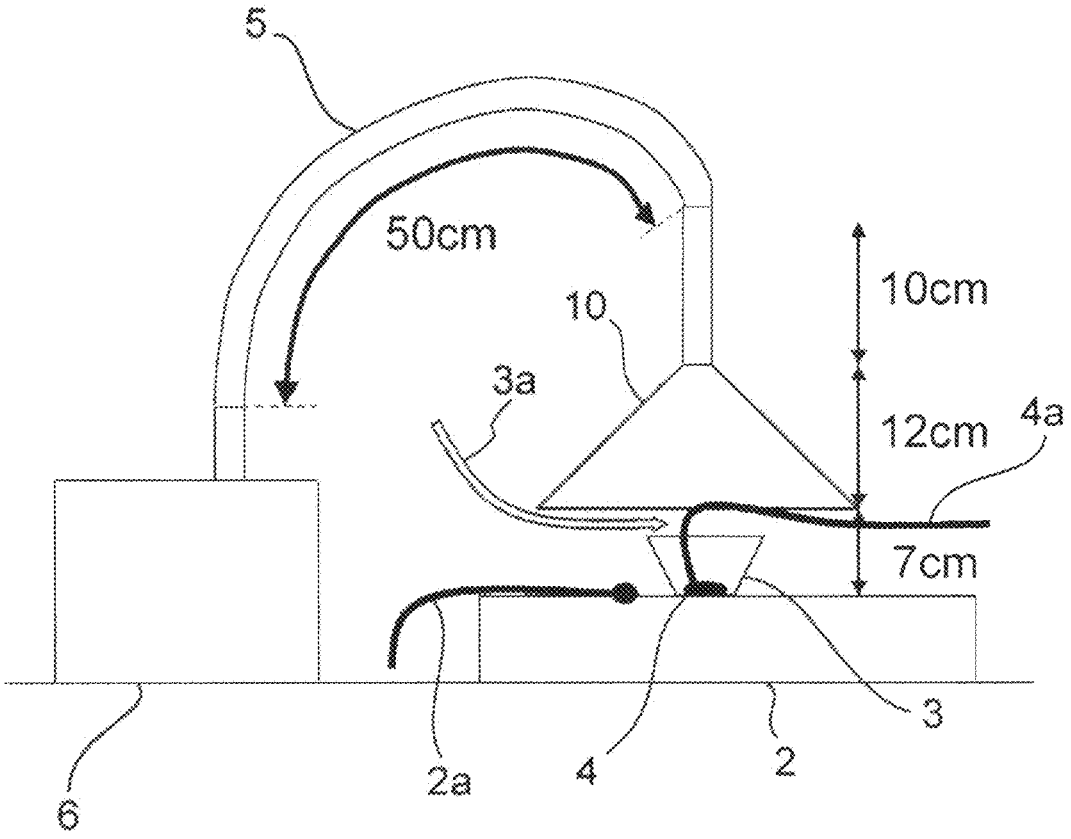
FIG. 9 is a view for explaining the positional relationship in the height direction of a heating device (hot plate) 2, a sample cup (aluminum cup) 3 and a cone collector 10, the size of a suction duct 5 connected to the cone collector 10, and the positional relationship in the height direction of the suction duct 5 and a dust measuring device 6, in the dust detection/measuring apparatus shown in FIG. 6.
Figure 10A:
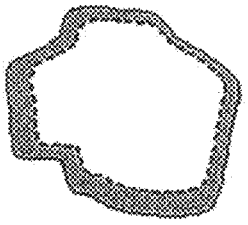
FIGS. 10A to 10L are schematic views showing specific examples of the state "the electrostatic image developing toner has a region in which the abundance ratio of the wax component Y is higher than that of the wax component X, and the number of the regions is larger in the outer wall side than in the center side of the electrostatic image developing toner".
Figure 10B:
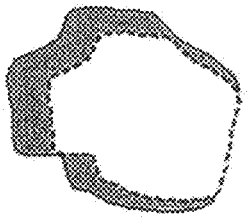
Figure 10C:
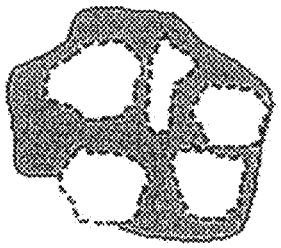
Figure 10D:
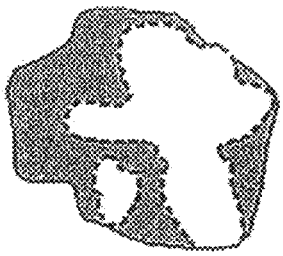
Figure 10E:
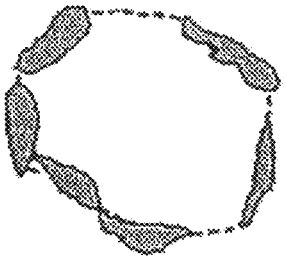
Figure 10F:
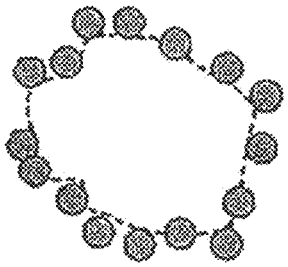
Figure 10G:
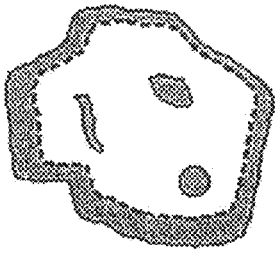
Figure 10H:
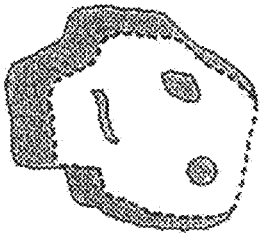
Figure 10I:
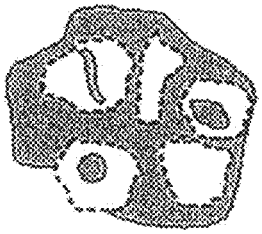
Figure 10J:
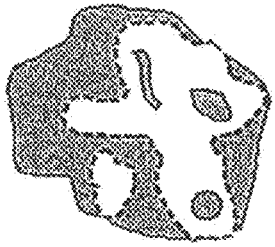
Figure 10K:
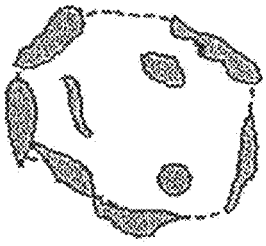
Figure 10L:
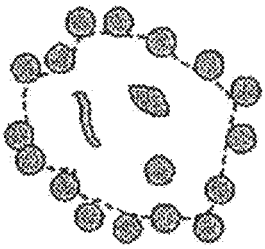

FIG. 9 is a view for explaining the positional relationship in the height direction of the heating device (hot plate) 2, the sample cup (aluminum cup) 3 and the cone collector 10, the size of the suction duct 5 connected to the cone collector 10, and the positional relationship in the height direction of the suction duct 5 and the dust measuring device 6, in the dust detection/measuring apparatus shown in FIG. 6.

As shown in FIG. 9, the lower end part of the funnel-like portion of the cone collector 10 is disposed at a position of 7 cm upward from the sample cup (aluminum cup) 3 placed on the heating device (hot plate) 2. The height from the lower end part of the funnel-like portion of the cone collector 10 to the upper end part of the funnel-like portion is 12 cm. Furthermore, the length (height) from the upper end part of the funnel-like portion of the cone collector 10 to the connection part connected to the suction duct 5 is 10 cm. The diameter of the lower end part of the funnel-like portion of the cone collector 10 is 15 cm. In addition, the length of the suction duct 5 is 50 cm, and the inner diameter of the suction duct 5 is 1.5 cm. For the suction duct 5, a polypropylene-made duct was used.

As shown in FIG. 9, the dust detection/measuring apparatus is equipped with a thermometer 2*a* for measuring the surface temperature of the heating device (hot plate) 2, and a sample thermometer 4*a* for measuring the surface temperature of the sample held in the sample cup (aluminum cup) 3.

<Measurement Method and Definition of Dust Emission (Dt) of Electrostatic Image Developing Toner and Dust Emission (Dw) of Wax>

Using the dust detection/measuring apparatus shown in FIGS. 6 to 9, the dust emission dispersed from the sample was measured under the following conditions according to the following procedure (Dt measurement condition T for the electrostatic image developing toner and. Dw measurement condition W for the wax) in the draft 1 adjusted to a temperature of 22 to 28° C. and a humidity of 50 to 60%.

(I) The exhaust fan 8 was driven and immediately after the heating device (hot plate) 2 was heated to 200° C., the temperature was lowered to 100° C. and held at 100° C. Raising the temperature to 200° C. was carried out for the purpose of including, in the background (BG) value, the dust emission generated from except for the sample at the dust measurement maximum temperature.

(II) In the state of the heating device 2 being at 100° C., the background (BG) measurement (1 minute) of the dust measuring device 6 and the dust calibration value measurement were performed. Furthermore, after the actual measurement of (III), the background measurement for 1 minute was also carried out, and the average value of two background values before and after the actual measurement of (III) was employed as the background value.

(III) In the state of the heating device 2 being at 100° C., from 1.0 to 1.1 g of the sample 4 was weighed in the sample cup (aluminum cup) 3 having a diameter of 6 cm, and the sample cup was placed at the center of the heating device 2. From a nitrogen inlet port 3*a* shown in FIG. 9, a nitrogen gas was introduced into the sample cup 3 at a flow velocity of 100 ml/min via a duct having an inner diameter of 2 mm, thereby putting the sample under an inert atmosphere. Although not shown in FIGS. 6 to 9, a pipe is laid from outside the draft 1 to near the sample cup 3, so that the nitrogen gas can be discharged from the nitrogen introduction port 3*a* via the inside of the pipe to thereby put the sample under an inert atmosphere. In FIG. 9, the pipe is depicted only near the sample cup 3 to clearly show the nitrogen inlet port 3*a*.

Introduction of the nitrogen gas was carried out for the purpose of heating the sample in an inert gas atmosphere in order to prevent the sample from entering a dangerous state such as firing due to an oxidation reaction, etc. at high temperature. Therefore, the nitrogen gas was flowed in at a very low flow velocity (100 ml/min) so that dust collection by the cone collector 10 is not inhibited by the inflow of nitrogen gas. Here, the sample is an electrostatic image developing toner or a wax alone.

(IV) From the state of the heating device 2 being at 100° C., the temperature was raised to 200° C. over 60 minutes according to the programmed temperature rise and thereafter kept at 200° C. for 5 minutes. The dust generated in this 65 minutes was measured at intervals of 1 minute by means of the dust measuring device, and the sum total of 65 measurement values was determined as the dust value before taking into account the background. Thereafter, the background (BG) value previously measured in (II) was subtracted from the value determined above, and the value obtained was taken as the dust emission (Dt) of the electrostatic image developing toner or the dust emission (Dw) of the wax.

For example, when the sum total before taking into account the background, at the time of measuring the sample 65 times at intervals of 1 minute according to the temperature rise profile described in (III), is 345 CPM and when the background measurement value (before sample measurement) for 1 minute is 3 CPM and the background measurement value (after sample measurement) is 4 CPM, 118 is shown as the proper dust emission of the sample in Table 2, because $345-((3+4)/2))\times 65=118$.

As the unit, "CPM" displayed on the dust measuring device, i.e., the digital dust monitor "DUSTMATE Model LD-3K2" manufactured by SHIBATA Scientific Technology Ltd., was employed.

The dust emission (Dt) of the electrostatic image developing toner and the dust emission (Dw) of the wax, of the electrostatic image developing toner measured in this way, are shown in Table 1.

<Methods for Measuring and Judging High Adhesion-Amount HOS Property>

A color page printer ML 9600PS (manufactured by Oki Data Corporation) was used and after adjusting the development bias and the supply bias, a test was performed by actually printing a solid image in a size of 201 mm×287 mm on Excellent White A4 Paper (produced by Oki Data Corporation) while changing the image density in steps of 0.2 in the image density range of 1.0 to 2.0 on a photoreceptor. In order to stabilize the temperature of the fixing device, printing on 30 sheets was performed at each image density, and the final one sheet was used for judgment. The hot offset resistance was judged by rating C when the image density of the final one sheet is 1.6 or less and a blister (gloss unevenness) ascribable to hot offset is generated, rating A when the image density is from more than 1.6 to 1.8 and a blister is generated, and rating AA when a blister is not generated even with an image density of more than 1.8. The test was carried out by setting the process speed of the machine to 36 sheets/min in terms of A4 short side feed.

<Methods for Measuring and Judging HOS Property at Low-Speed Printing>

An unfixed image was prepared with Excellent White Paper (A4) produced by Oki Data Corporation, a portrait orientation, a blank of 5 mm at the top, an area of 200 mm (width)×40 mm (height), and an adhesion amount of 0.5 mg/cm$^2$. Since a portrait orientation, the horizontal size of A4 paper is 210 mm and in turn, both the right and left blanks are 5 mm.

Using this unfixed image, the evaluation was carried out under the condition of no silicon oil coating by performing fixing by means of a fixing device where the roller diameter is 27 mm, a nip width is 9 mm, both upper and lower rollers have a heater, and the roller surface is composed of PFA (tetrafluoroethylene-perfluoroalkyl vinyl ether copolymer).

Since the rotation speed of the roller of the fixing machine was set to 82 rpm, assuming that the paper-to-paper interval is 30 mm, the printing speed is 29 sheets/min in terms of A4 short side feed. In this state, a fixed image was obtained by setting the roller surface temperature to 195° C.

The fixed image was judged with an eye and rated A when a blister (gloss unevenness) ascribable to hot offset is not generated, and rated C when generated.

The HOS property at low-speed printing of the electrostatic image developing toner, measured and judged in this way, is shown in Table 2.

<Methods for Measuring and Judging COS Property at High-Speed Printing and Gloss at High-Speed Printing>

An unfixed image was prepared with Excellent White Paper (A4) produced by Oki Data Corporation, a portrait orientation, a blank of 5 mm at the top, an area of 200 mm (width)×40 mm (height), and an adhesion amount of 0.5 mg/cm$^2$. Since a portrait orientation, the horizontal size of A4 paper is 210 mm and in turn, both the right and left blanks are 5 mm.

Using this unfixed image, the evaluation was carried out under the condition of no silicon oil coating by performing fixing by means of a fixing device where the roller diameter is 27 mm, a nip width is 9 mm, both upper and lower rollers have a heater, and the roller surface is composed of PFA (tetrafluoroethylene-perfluoroalkyl vinyl ether copolymer).

Since the rotation speed of the roller of the fixing machine was set to 162 rpm, assuming that the paper-to-paper interval is 30 mm, the printing speed is 57 sheets/min in terms of A4 short side feed. In this state, a fixed image was obtained by changing the roller surface temperature in steps of 5° C. from 150° C. to 180° C. The tape peeling residual ratio of this fixed image was measured by the following method. First, a mending tape was attached to the fixed image, the paper was placed on a desk having smooth surface with the fixed image downward, a weight of 2 kg was passed, from back side, mainly over the mending tape for 4 seconds at a speed of 1 cm/sec to closely contact the tape with the fixed image. Thereafter, the mending tape was peeled over 4 seconds, and the image density of the tape peeled area and the tape non-peeled area was measured X-Rite manufactured by X-Rite Inc. At this time, when 95% or more of the image density of the tape non-peeled area remains in the tape peeled area, the image density was judged as passed, and the COS property at high-speed printing was judged as follows by using, as an indicator, the minimum roller surface temperature below which the image density is not passed.

AA: Passed at 160° C. or less.

A: Passed at 165 to 170° C.

C: Not passed unless exceeding 170° C.

As for the gloss at high-speed printing, a test was performed by the same method as in the COS property at high-speed printing, and the surface gloss of a fixed image when the roller surface temperature was set to 185° C. was measured at an angle of 75° by means of Gloss Meter VG2000 manufactured by NIPPON DENSHOKU Industries Co., Ltd., and the sample was judged as follows according to the glossiness.

AA: Glossiness is 25% or more.

A: Glossiness is from 18% to less than 25%.

C: Glossiness is less than 18%.

The COS property at high-speed printing and the gloss at high-speed printing of the electrostatic image developing toner, measured and judged in this way, are shown in Table 2.

<Storability>

A cylindrical container having an inner diameter of 15 mm and a length of 80 mm, which was erected on an iron-made plate and in which paraffin paper was wound onto the inside of the cylinder, was previously prepared, and 10 g of the electrostatic image developing toner sieved through a 500 mesh sieve was charged into the cylinder. A weight (sample vial of 15 mm in diameter) adjusted to 20 g was placed thereon from the above and in the state of applying a load of 20 g on the electrostatic image developing toner, cylindrical container with the plate was put inside of a thermo-hygrostat (50° C., 40%) and held for 24 hours. After taking it out, the toner was left standing at room temperature for 2 hours, and the weight, paraffin paper and cylindrical container were slowly removed. An agglomerate of toner base particles was taken out and by sequentially placing weights thereon, the amount of weight when the toner agglomerate is disintegrated was measured.

The storability of the electrostatic image developing toner was judged as follows for each minimum weight applied by the weight for causing disintegration.

Incidentally, when the agglomerate was already disintegrated at the time of slowly removing the cylindrical container, without a disintegrating treatment, the weight was regarded as 0 g.

AA (Good): Disintegrated under a load of less than 50 g.

A (Practicable): Disintegrated under a load of from 50 g to less than 100 g.

C (Unusable): Not disintegrated unless a load of 100 g or more is applied.

<Measurement Method and Definition of Dust Emission Rate (Vd)>

All four cartridges of a color page printer ML 9600PS (manufactured by Oki Data Corporation) were filled with the toner for development produced by the later-described method. Using high-quality paper PA4 (produced by Fuji Xerox Co., Ltd.), dust was collected according to the Blue Angel Mark-certified measurement method (RAL_UZ122_2006), and the dust emission rate was determined by measuring the mass of substances collected on the filter.

Specifically, an emission test chamber (VOC-010, volume: 1000 L, manufactured by Espec Corp.) was previously subjected to a baking treatment and after blank measurement, the above-described printer and the filter for dust measurement were set. The system was kept in stand-by for 60 minutes or more so that the temperature and humidity in the tank can reach the prescribed values (23±2° C./50±5%). The printer was driven by remote operation and at the same time, suction through the filter was started. The collection by suction was continued for up to 2 hours after printing on a prescribed number of sheets. Here, VE110-7, Version 2006-06-01 (RAL_UZ122/RALC00.PDF) was used for the print pattern.

The dust emission rate was determined according to the following formulae.

$$\text{Mass } mSt \text{ of dust after temperature/humidity correction} = (mMFbrutto - mMFtara) + (mRF1 - mRF2) \quad (1)$$

mMFtara: mass (mg) of the measurement filter of which mass stabilized, before collection of dust sample mMFbrutto: mass (mg) of the measurement filter of which mass stabilized, after collection of dust sample mRF1: mass (mg) of standard filter before test mRF2: mass (mg) of standard filter after test $$Vd=(mSt\times n\times V\times to)/(VS\times tp) \quad (2)$$

Vd: dust emission rate (mg/hr)

n: number of ventilations (h-1)

to: total sampling time (min)

tp: printing time (min)

V: chamber volume ($m^3$)

VS: volume ($m^3$) of air suctioned after passing through filter

The sample was rated AA when Vd is 0.7 or less, rated A when from more than 0.7 to 3.0, and rated C when Vd exceeds 3.0.

The dust emission rate (Vd) of the electrostatic image developing toner, measured and judged in this way, is shown in Table 2.

Incidentally, the Vd values shown in Examples 2 to 5 and Comparative Examples 1 to 4 are an estimate value. As shown in FIG. 4, Dt (toner dust emission) and Vd (dust emission rate) have the above-described relationship of $Vd=5.53\times10^4\times Dt+0.574$ (square of correlation coefficient=0.999), and the estimate value above is Vd determined by assigning the actual value of Dt of Examples 2 to 5 and Comparative Examples 1 to 4 shown in Table 2 to the formula above. Based on the thus-determined Vd value, the sample was rated AA when Vd is 0.7 or less, rated A when from more than 0.7 to 3.0, and rated C when Vd exceeds 3.0.

<Measurement Method and Definition of BET Specific Surface Area of External Additive>

The BET specific surface area was measured by a one-point method using liquid nitrogen, by means of Macsorb model-1201 manufactured by Mountech Co., Ltd. Specifically, the method is as follows.

First, a glass-made dedicated cell was filled with about 1.0 g of the measurement sample (hereinafter, the filling amount of sample is referred to as A (g)). Next, the cell was set on the main body of the measuring device and after drying and degassing at 200° C. for 20 minutes in a nitrogen atmosphere, the cell was cooled to room temperature. Subsequently, while cooling the cell with liquid nitrogen, a measurement gas (a first-rate mixed gas of 30% of nitrogen and 70% of helium) was flowed into the cell at a flow rate of 25 mL/min, and the adsorbed amount V ($cm^3$) of the measurement gas to the sample was measured. Assuming that the total surface area of the sample is S ($m^2$), the target BET specific surface area ($m^2/g$) can be calculated by the following calculating formula:

$$\text{(BET Specific surface area)}=S/A=\{K\times(1-P/P0)\times V\}/A$$

K: gas constant (in this measurement, 4.29)

P/P0: relative pressure of adsorbed gas, 97% of the mixing ratio (in this measurement, 0.29)

Example 1

Preparation of Colorant Dispersion Liquid

20 Parts of carbon black (Mitsubishi Carbon Black MA100S, produced by Mitsubishi Chemical Corporation) produced by a furnace process, where the toluene extract has an ultraviolet absorbance of 0.02 and the true density is 1.8 g/cm3, 1 part of an anionic surfactant (NEOGEN S-20D, produced by Dai-ichi Kogyo Seiyaku Co., Ltd.), 4 parts of a nonionic surfactant (EMULGEN 120, produced by Kao Corporation), and 75 parts of ion-exchanged water having an electric conductivity of 1 μS/cm were added to a vessel of a stirrer equipped with a propeller blade and pre-dispersed to obtain a pigment premix liquid. The volume median diameter Dv50 of carbon black in the dispersion liquid after premixing was about 90 μm.

The premix liquid was fed, as a raw material slurry, to a wet bead mill and subjected to one-pass dispersion. Here, the inner diameter of the stator was 120 mmϕ, the diameter of the separator was 60 mmϕ, and a zirconia bead (true density: 6.0 g/$cm^3$) having a diameter of 50 μm was used as the media for dispersion. The effective internal capacity of the stator was about 2 liters and since the filling volume of the media was set to 1.4 liters, the filling ratio of the media was 70%.

While keeping the rotation speed of the rotor constant (the peripheral speed of the rotor tip was about 11 m/sec), the pigment premix slurry above was fed through a supply port at a supply rate of about 40 liter/hr by a non-pulsation metering pump and at the point of reaching a predetermined particle size, the product was taken out from the discharge port. Incidentally, cooling water at about 10° C. was circulated from a jacket during operation, and a colorant dispersion liquid having a volume average diameter (Mv) of 160 nm and a number average diameter (Mn) of 104 nm was obtained.

Preparation of Wax Dispersion Liquid A1

26.7 Parts (1,068 g) of HiMic-1090 (produced by Nippon Seiro Co., Ltd., melting point: 82° C. (the catalog value is 89° C.)), 3.0 parts of pentaerythritol tetrastearate (acid value: 3.0, hydroxyl value: 1.0, melting point: 77° C. and 67° C.), and 0.3 parts of decaglycerin decabehenate (hydroxyl value: 27, melting point: 70° C.) were added to the jacketed pot of a homogenizer equipped with a pressurized circulation line (Model LAB60-10TBS, manufactured by Gaulin Company) and heated under stirring at 95° C. for 30 minutes. Subsequently, a mixture prepared by previously heating 2.8 parts of an aqueous 20% sodium dodecylbenzenesulfonate solution (NEOGEN S20D, produced by Dai-ichi Kogyo Seiyaku Co., Ltd., hereinafter simply referred to as an aqueous 20% DBS solution) and 67.2 parts of desalted water at 95° C. was added thereto and heated at 100° C., and primary circulation emulsification was performed under a pressure condition of 10 MPa.

The volume median diameter was measured every 10 minutes and by further raising the pressure condition to 25 MPa when the median diameter was reduced to around 500 nm, secondary circulation emulsification was continuously performed. After dispersing the solution until the volume median diameter reached 230 nm, the resulting dispersion was immediately cooled to produce Wax Dispersion Liquid A1 (emulsion solid content concentration=30.3%).

In addition, a mixture prepared by heating 26.7 parts of HiMic-1090 (produced by Nippon Seiro Co., Ltd., melting point: 82° C. (the catalog value is 89° C.)), 3.0 parts of pentaerythritol tetrastearate (acid value: 3.0, hydroxyl value: 1.0, melting point: 77° C. and 67° C.), and 0.3 parts of decaglycerin decabehenate (hydroxyl value: 27, melting point: 70° C.) under stirring at 95° C. for 30 minutes was cooled to room temperature, and the dust emission (Dw) of the resulting wax mixture (Wax A1) was 26,723 CPM.

<Preparation of Wax Dispersion Liquid A2>

27 Parts (1,080 g) of paraffin wax (HNP-9, produced by Nippon Seiro Co., Ltd., melting point: 76° C.) and 2.8 parts of stearyl acrylate (produced by Tokyo Chemical Industry Co., Ltd.) were added to the jacketed pot of a homogenizer equipped with a pressurized circulation line (Model LAB60-10TBS, manufactured by Gaulin Company) and heated under stirring at 90° C. for 30 minutes. Subsequently, a mixture prepared by previously heating 1.9 parts of 20% DBS and 68.3 parts of desalted water at 90° C. was added thereto and heated at 90° C., and primary circulation emulsification was performed under a pressure condition of 10 MPa. The volume median diameter was measured every 10 minutes and by further raising the pressure condition to 20 MPa when the median diameter was reduced to around 500 nm, secondary circulation emulsification was continuously performed. After dispersing the solution until the volume median diameter reached 230 nm, the resulting dispersion was immediately cooled to produce Wax Dispersion Liquid A2 (emulsion solid content concentration=29.4%).

In addition, a mixture prepared by heating 27 parts (540 g) of paraffin wax (HNP-9, produced by Nippon Seiro Co., Ltd., melting point: 76° C.) and 2.8 parts of stearyl acrylate (produced by Tokyo Chemical Industry Co., Ltd.) under stirring at 95° C. for 30 minutes was cooled to room temperature, and the dust emission (Dw) of the resulting wax mixture (Wax A2) was 155,631 CPM.

Preparation of Primary Polymer Particle Dispersion Liquid B1

A reaction vessel equipped with a stirring device (three blades), a heating/cooling device, a concentrating device and a device for charging each raw material or adjuvant was charged with 35.0 parts (700.1 g) of Wax Dispersion Liquid A1 and 259 parts of desalted water, and the temperature was raised under stirring to 90° C. in a nitrogen stream. Thereafter, while continuously stirring the solution above, a mixture of the following "polymerizable monomers, etc." and "aqueous emulsifying agent solution" was added thereto over 5 hours. The time at which the dropwise addition of the mixture was started was taken as "polymerization initiation", and the following "aqueous initiator solution" was added over 4.5 hours from 30 minutes after the polymerization initiation. Furthermore, the following "additional aqueous initiator solution" was added over 2 hours from 5 hours after the polymerization initiation, and the system was kept stirring and held for 1 hour at an internal temperature of 90° C.

| [Polymerizable Monomers, etc.] | |
|---|---|
| Styrene | 75.9 parts |
| Butyl acrylate | 24.1 parts |
| Acrylic acid | 1.2 parts |
| Hexanediol diacrylate | 0.73 parts |
| Trichlorobromomethane | 1.0 parts |
| **[Aqueous Emulsifying Agent Solution]** | |
| Aqueous 20% DBS solution | 1.0 parts |
| Desalted water | 67.0 parts |
| **[Aqueous Initiator Solution]** | |
| Aqueous 8 mass % hydrogen peroxide solution | 15.5 parts |
| Aqueous 8 mass % L(+)-ascorbic acid solution | 15.5 parts |
| **[Additional Aqueous Initiator Solution]** | |
| Aqueous 8 mass % L(+)-ascorbic acid solution | 14.2 parts |

After the completion of polymerization reaction, the reaction mixture was cooled. This operation was repeated twice, and two primary polymer particle dispersion liquids obtained were uniformly mixed to obtain milky-white Primary Polymer Particle Dispersion Liquid B1. The volume average diameter (Mv) as measured by Nanotrac was 242 nm, and the solid content concentration was 22.7 mass %.

Preparation of Primary Polymer Particle Dispersion Liquid B2

A reaction vessel equipped with a stirring device (three blades), a heating/cooling device, a concentrating device and a device for charging each raw material or adjuvant was charged with 36.1 parts (722.2 g) of Wax Dispersion Liquid A2 and 259 parts of desalted water, and the temperature was raised under stirring to 90° C. in a nitrogen stream. Thereafter, while continuously stirring the solution above, a mixture of the following "polymerizable monomers, etc." and "aqueous emulsifying agent solution" was added thereto over 5 hours. The time at which the dropwise addition of the mixture was started was taken as "polymerization initiation", and the following "aqueous initiator solution" was added over 4.5 hours from 30 minutes after the polymerization initiation. Furthermore, the following "additional aqueous initiator solution" was added over 2 hours from 5 hours after the polymerization initiation, and the system was kept stirring and held for 1 hour at an internal temperature of 90° C.

| [Polymerizable Monomers, etc.] | |
|---|---|
| Styrene | 76.8 parts |
| Butyl acrylate | 23.2 parts |
| Acrylic acid | 1.5 parts |
| Hexanediol diacrylate | 0.70 parts |
| Trichlorobromomethane | 1.0 parts |
| **[Aqueous Emulsifying Agent Solution]** | |
| Aqueous 20% DBS solution | 1.0 parts |
| Desalted water | 67.1 parts |
| **[Aqueous Initiator Solution]** | |
| Aqueous 8 mass % hydrogen peroxide solution | 15.5 parts |
| Aqueous 8 mass % L(+)-ascorbic acid solution | 15.5 parts |
| **[Additional Aqueous Initiator Solution]** | |
| Aqueous 8 mass % L(+)-ascorbic acid solution | 14.2 parts |

After the completion of polymerization reaction, the reaction mixture was cooled to obtain milky-white Primary Polymer Particle Dispersion Liquid B2. The volume average diameter (Mv) as measured by Nanotrac was 232 nm, and the solid content concentration was 22.6 mass %.

Preparation of Toner Base Particle C1

Toner Base Particle C1 was produced by using the following components and performing the following aggregation step and round shape forming step. The solid content of the component of the toner base particle for development is as follows.

Core Material:

Primary Polymer Particle Dispersion Liquid B1: 90 parts as solid content (Primary Polymer Dispersion Liquid B1: 4,011 g)

Colorant fine particle dispersion liquid: 6.0 parts as colorant solid content

Shell Material:

Primary Polymer Particle Dispersion Liquid B2: 10 parts as solid content (Primary Polymer Dispersion Liquid B2: 448 g)

(Core Material Aggregation Step)

Primary Polymer Particle Dispersion Liquid B1 (4,011 g) and an aqueous 20% DBS solution (2.53 g) were charged into a mixing vessel (volume: 12 liters, inner diameter: 208 mm, height: 355 mm) equipped with a stirring device (double helical blade), a heating/cooling device, a concentrating device and a device for charging each raw material or adjuvant and uniformly mixed for 5 minutes at an internal temperature of 10° C. After adding desalted water (541.5 g), an aqueous 5% ferrous sulfate ($FeSO_4.7H_2O$) solution (113.2 g) was added over 5 minutes while continuously stirring the mixture at an internal temperature of 10° C. and 250 rpm, and a colorant fine particle dispersion liquid (303.5 g) was added thereto over 5 minutes. The resulting solution was uniformly mixed at an internal temperature of 10° C., and an aqueous 0.5% aluminum sulfate solution (101.2 g) was further added dropwise under the same conditions. After adding desalted water (101.2 g), the temperature was raised to 54° C. as the temperature in the core aggregation step, and the internal temperature was raised from 54.0° C. in a stepwise manner to 56.0° C. over 160 minutes while keeping the rotation speed at 250 rpm. The volume median diameter (Dv50) was measured with Multisizer, as a result, the particle was grown to 6.8 μm.

(Shell Coating Step)

Thereafter, Primary Polymer Particle Dispersion Liquid B2 (447.6 g) was added over 8 minutes, and the system was held as-is for 30 minutes.

<Round Shape Forming Step>

After reducing the rotation speed to 150 rpm, an aqueous 20% DBS solution (303.5 g) was added over 8 minutes, and desalted water (232.5 g) was further added. The temperature was then raised to 90° C. as the temperature in the round shape forming step, and the heating and stirring were continued until the average circularity became 0.967. Thereafter, the reaction mixture was cooled to 30° C. over 20 minutes to obtain a slurry liquid.

(Washing and Drying Step)

The whole amount of the obtained slurry was subjected to a filtration treatment by means of a wet electromagnetic sieve shaker equipped with a sieve having an opening of 24 μm (AS200, manufactured by Retsch) for the purpose of removing coarse particles, and the resulting slurry was once stored in a tank equipped with a stirring device. Subsequently, the slurry was centrifugally dehydrated and washed under an acceleration of 800 G by means of a horizontal centrifuge (Model HZ40Si, manufactured by Mitsubishi Kakoki Kaisha, Ltd.) attached with a filter cloth (Polyester TR815C, Nakao Filter Media Corp., thickness: 0.3 mm, air permeability: 48 ($cc/cm^2/min$)).

Ion-exchanged water having an electric conductivity of 1 μS/cm was added in an amount of about 50 times the slurry solid content at a speed not causing overflow from the rim, as a result, the electric conductivity of the filtrate became 2 μS/cm. Finally, water was fully shaken off, and the cake was collected with a scraping device. The obtained cake was spread in a stainless steel-made vat to a height of 20 mm and dried in a blow dryer set at 40° C. for 48 hours to obtain Toner Base Particle C1.

The following external addition step was carried out by using the obtained toner base particle to produce a toner for development.

<Preparation of Toner D1 for Development>

(External Addition Step)

Toner Base Particle C1 (100 parts: 250 g) was charged into an external addition machine (Model SK-M2000, manufactured by Kyoritsu Riko K.K.). Subsequently, 0.5 parts of a silica fine particle being subjected to a hydrophobic treatment with silicone oil and having a volume average primary particle diameter of 8 nm and a BET specific surface area of 150 $m^2/g$, 0.3 parts of a silica fine particle being subjected to a hydrophobic treatment with silicone oil and having a volume average primary particle diameter of 40 nm and a BET specific surface area of 42 $m^2/g$, and 1.5 parts of a silica fine particle being subjected to a hydrophobic treatment with hexamethylenedisilazane and having a volume average primary particle diameter of 110 nm and a BET specific surface area of 26 $m^2/g$ were added as external additives. After an operation of mixing the particles at 6,000 rpm for 1 minute was repeated five times, the mixture was sieved through a 150 mesh sieve to obtain Toner D1 for Development.

Example 2

Preparation of Primary Polymer Particle Dispersion Liquid B3

Primary Polymer Particle Dispersion Liquid B3 was obtained in the same manner as in the preparation of Primary Polymer Particle Dispersion Liquid B1 except that 74.1 parts of styrene and 25.9 parts of butyl acrylate were added.

Preparation of Toner Base Particle C2

Toner Base Particle C2 was obtained by the same preparation process as in the preparation of Toner Base Particle C1 except for the following changes.

Primary Polymer Particle Dispersion Liquid B3 was used in place of Primary Polymer Particle Dispersion Liquid B1.

The temperature was raised to 44° C. as the temperature in the core aggregation step, the internal temperature was raised in a stepwise manner to 54.0° C. over 310 minutes while keeping the rotation speed at 250 rpm, and the volume median diameter (Dv50) was measured with Multisizer, as a result, the particle was grown to 6.8 μm.

<Preparation of Toner D2 for Development>

Toner D2 for Development was obtained by performing the same preparation process as in the preparation of Toner D1 for Development except that Toner Base Particle C2 was used in place of Toner Base Particle C1.

Example 3

Preparation of Primary Polymer Particle Dispersion Liquid B4

Primary Polymer Particle Dispersion Liquid B4 was obtained in the same manner as in the preparation of Primary Polymer Particle Dispersion Liquid B1 except that 77.7 parts of styrene and 22.3 parts of butyl acrylate were added.

Preparation of Toner Base Particle C3

Toner Base Particle C3 was obtained by the same preparation process as in the preparation of Toner Base Particle C1 except for the following changes.

Primary Polymer Particle Dispersion Liquid B4 was used in place of Primary Polymer Particle Dispersion Liquid B1.

The temperature was raised to 56° C. as the temperature in the core aggregation step, the internal temperature was raised in a stepwise manner to 58.0° C. over 210 minutes while keeping the rotation speed at 250 rpm, and the volume median diameter (Dv50) was measured with Multisizer, as a result, the particle was grown to 6.8 μm.

<Preparation of Toner D3 for Development>

Toner D3 for Development was obtained by performing the same preparation process as in the preparation of Toner D1 for Development except that Toner Base Particle C3 was used in place of Toner Base Particle C1.

Example 4

Preparation of Primary Polymer Particle Dispersion Liquid B5

Primary Polymer Particle Dispersion Liquid B5 was obtained in the same manner as in the preparation of Primary Polymer Particle Dispersion Liquid B1 except that 0.53 parts of hexanediol diacrylate was added.

Preparation of Toner Base Particle C4

Toner Base Particle C4 was obtained by the same preparation process as in the preparation of Toner Base Particle C1 except for the following changes.

Primary Polymer Particle Dispersion Liquid B5 was used in place of Primary Polymer Particle Dispersion Liquid B1.

The temperature was raised to 54° C. as the temperature in the core aggregation step, the internal temperature was raised in a stepwise manner to 55.5° C. over 165 minutes while keeping the rotation speed at 250 rpm, and the volume median diameter (Dv50) was measured with Multisizer, as a result, the particle was grown to 6.8 μm.

<Preparation of Toner D4 for Development>

Toner D4 for Development was obtained by performing the same preparation process as in the preparation of Toner D1 for Development except that Toner Base Particle C4 was used in place of Toner Base Particle C1.

Example 5

Preparation of Primary Polymer Particle Dispersion Liquid B6

Primary Polymer Particle Dispersion Liquid B6 was obtained in the same manner as in the preparation of Primary Polymer Particle Dispersion Liquid B1 except that 0.90 parts of hexanediol diacrylate was added.

Preparation of Toner Base Particle C5

Toner Base Particle C5 was obtained by the same preparation process as in the preparation of Toner Base Particle C1 except for the following changes.

Primary Polymer Particle Dispersion Liquid B6 was used in place of Primary Polymer Particle Dispersion Liquid B1.

The temperature was raised to 55° C. as the temperature in the core aggregation step, the internal temperature was raised in a stepwise manner to 56.0° C. over 170 minutes while keeping the rotation speed at 250 rpm, and the volume median diameter (Dv50) was measured with Multisizer, as a result, the particle was grown to 6.8 μm.

<Preparation of Toner D5 for Development>

Toner D5 for Development was obtained by performing the same preparation process as in the preparation of Toner D1 for Development except that Toner Base Particle C5 was used in place of Toner Base Particle C1.

Comparative Example 1

Preparation of Primary Polymer Particle Dispersion Liquid B7

Primary Polymer Particle Dispersion Liquid B7 was obtained in the same manner as in the preparation of Primary Polymer Particle Dispersion Liquid B1 except that 73.2 parts of styrene and 26.8 parts of butyl acrylate were added.

Preparation of Toner Base Particle C6

Toner Base Particle C6 was obtained by the same preparation process as in the preparation of Toner Base Particle C1 except for the following changes.

Primary Polymer Particle Dispersion Liquid B7 was used in place of Primary Polymer Particle Dispersion Liquid B1.

The temperature was raised to 41° C. as the temperature in the core aggregation step, the internal temperature was raised in a stepwise manner to 53.0° C. over 330 minutes while keeping the rotation speed at 250 rpm, and the volume median diameter (Dv50) was measured with Multisizer, as a result, the particle was grown to 6.8 μm.

<Preparation of Toner D6 for Development>

Toner D6 for Development was obtained by performing the same preparation process as in the preparation of Toner D1 for Development except that Toner Base Particle C6 was used in place of Toner Base Particle C1.

Comparative Example 2

Preparation of Primary Polymer Particle Dispersion Liquid B8

Primary Polymer Particle Dispersion Liquid B8 was obtained in the same manner as in the preparation of Primary Polymer Particle Dispersion Liquid B1 except that 78.6 parts of styrene and 21.4 parts of butyl acrylate were added.

Preparation of Toner Base Particle C7

Toner Base Particle C7 was obtained by the same preparation process as in the preparation of Toner Base Particle C1 except for the following changes.

Primary Polymer Particle Dispersion Liquid B8 was used in place of Primary Polymer Particle Dispersion Liquid B1.

The temperature was raised to 56° C. as the temperature in the core aggregation step, the internal temperature was raised in a stepwise manner to 59.0° C. over 300 minutes while keeping the rotation speed at 250 rpm, and the volume median diameter (Dv50) was measured with Multisizer, as a result, the particle was grown to 6.8 μm.

<Preparation of Toner D7 for Development>

Toner D7 for Development was obtained by performing the same preparation process as in the preparation of Toner D1 for Development except that Toner Base Particle C7 was used in place of Toner Base Particle C1.

Comparative Example 3

Preparation of Primary Polymer Particle Dispersion Liquid B9

Primary Polymer Particle Dispersion Liquid B9 was obtained in the same manner as in the preparation of Primary Polymer Particle Dispersion Liquid B1 except that 0.48 parts of hexanediol diacrylate was added.

Preparation of Toner Base Particle C8

Toner Base Particle C8 was obtained by the same preparation process as in the preparation of Toner Base Particle C1 except for the following changes.

Primary Polymer Particle Dispersion Liquid B9 was used in place of Primary Polymer Particle Dispersion Liquid B1.

The temperature was raised to 54° C. as the temperature in the core aggregation step, the internal temperature was raised in a stepwise manner to 55.5° C. over 180 minutes while keeping the rotation speed at 250 rpm, and the volume median diameter (Dv50) was measured with Multisizer, as a result, the particle was grown to 6.8 μm.

<Preparation of Toner D8 for Development>

Toner D8 for Development was obtained by performing the same preparation process as in the preparation of Toner D1 for Development except that Toner Base Particle C8 was used in place of Toner Base Particle C1.

Comparative Example 4

Preparation of Primary Polymer Particle Dispersion Liquid B10

Primary Polymer Particle Dispersion Liquid B10 was obtained in the same manner as in the preparation of Primary Polymer Particle Dispersion Liquid B1 except that 1.00 parts of hexanediol diacrylate was added.

Preparation of Toner Base Particle C9

Toner Base Particle C9 was obtained by the same preparation process as in the preparation of Toner Base Particle C1 except for the following changes.

Primary Polymer Particle Dispersion Liquid B10 was used in place of Primary Polymer Particle Dispersion Liquid B1.

The temperature was raised to 55° C. as the temperature in the core aggregation step, the internal temperature was raised in a stepwise manner to 56.5° C. over 155 minutes while keeping the rotation speed at 250 rpm, and the volume median diameter (Dv50) was measured with Multisizer, as a result, the particle was grown to 6.8 μm.

<Preparation of Toner D9 for Development>

Toner D9 for Development was obtained by performing the same preparation process as in the preparation of Toner D1 for Development except that Toner Base Particle C9 was used in place of Toner Base Particle C1.

Reference Example 1

Preparation of Toner Base Particle C10

Toner Base Particle C10 was obtained by the same preparation process as in the preparation of Toner Base Particle C1 except for the following changes.

The core material was formulated with Primary Polymer Particle Dispersion Liquid B1: 80 parts as solid content (Primary Polymer Particle Dispersion Liquid B1: 3,607 g) and a colorant fine particle dispersion liquid: 6.0 parts as colorant solid content, and the shell material was formulated with Primary Polymer Particle Dispersion Liquid B2: 20 parts as solid content (Primary Polymer Particle Dispersion Liquid B2: 906 g).

The temperature was raised to 55° C. as the temperature in the core aggregation step, the internal temperature was raised in a stepwise manner to 56.0° C. over 165 minutes while keeping the rotation speed at 250 rpm, and the volume median diameter (Dv50) was measured with Multisizer, as a result, the particle was grown to 6.8 μm.

<Preparation of Toner D10 for Development>

Toner D10 for Development was obtained by performing the same preparation process as in the preparation of Toner D1 for Development except that Toner Base Particle C10 was used in place of Toner Base Particle C1.

Reference Example 2

Preparation of Toner Base Particle C11

Toner Base Particle C11 was obtained by the same preparation process as in the preparation of Toner Base Particle C1 except for the following changes.

The core material was formulated with Primary Polymer Particle Dispersion Liquid B1: 90 parts as solid content (Primary Polymer Particle Dispersion Liquid B1: 4,011 g), Primary Polymer Particle Dispersion Liquid B2: 10 parts as solid content (Primary Polymer Particle Dispersion Liquid B2: 448 g) and a colorant fine particle dispersion liquid: 6.0 parts as colorant solid content, provided that the shell material was not formulated.

The temperature was raised to 55° C. as the temperature in the aggregation step, the internal temperature was raised in a stepwise manner to 56.0° C. over 200 minutes while keeping the rotation speed at 250 rpm, and the volume median diameter (Dv50) was measured with Multisizer, as a result, the particle was grown to 7.3 μm. Subsequently, as the round shape forming step, the rotation speed was reduced to 150 rpm and after adding an aqueous 20% DBS solution (303.5 g) over 8 minutes, desalted water (232.5 g) was further added. The temperature was then raised to 90° C. over 72 minutes, and the heating and stirring were continued until the average circularity became 0.967. Thereafter, the reaction mixture was cooled to 30° C. over 20 minutes to obtain a slurry liquid.

<Preparation of Toner D11 for Development>

Toner D11 for Development was obtained by performing the same preparation process as in the preparation of Toner D1 for Development except that Toner Base Particle C11 was used in place of Toner Base Particle C1.

Reference Example 3

Preparation of Toner Base Particle C12

Toner Base Particle C12 was obtained by the same preparation process as in the preparation of Toner Base Particle C1 except for the following changes.

The core material was formulated with Primary Polymer Particle Dispersion Liquid B2: 90 parts as solid content (Primary Polymer Particle Dispersion Liquid B1: 4,011 g) and a colorant fine particle dispersion liquid: 6.0 parts as colorant solid content, and the shell material was formulated with Primary Polymer Particle Dispersion Liquid B2: 10 parts as solid content (Primary Polymer Particle Dispersion Liquid B1: 447 g). In addition, the temperature was raised to 55° C. as the temperature in the core aggregation step, the internal temperature was raised in a stepwise manner to 56.0° C. over 150 minutes while keeping the rotation speed at 250 rpm, and the volume median diameter (Dv50) was measured with Multisizer, as a result, the particle was grown to 6.8 μm.

<Preparation of Toner D12 for Development>

Toner D12 for Development was obtained by performing the same preparation process as in the preparation of Toner D1 for Development except that Toner Base Particle C12 was used in place of Toner Base Particle C1.

Reference Example 4

Preparation of Toner Base Particle C13

Toner Base Particle C13 was obtained by the same preparation process as in the preparation of Toner Base Particle C1 except for the following changes.

The core material was formulated with Primary Polymer Particle Dispersion Liquid B1: 90 parts as solid content (Primary Polymer Particle Dispersion Liquid B1: 4,013 g) and a colorant fine particle dispersion liquid: 6.0 parts as colorant solid content, and the shell material was formulated with Primary Polymer Particle Dispersion Liquid B1: 10 parts as solid content (Primary Polymer Particle Dispersion Liquid B1: 446 g). The temperature was raised to 55° C. as the temperature in the core aggregation step, the internal temperature was raised in a stepwise manner to 56.0° C. over 180 minutes while keeping the rotation speed at 250 rpm, and the volume median diameter (Dv50) was measured with Multisizer, as a result, the particle was grown to 6.8 μm.

<Preparation of Toner D13 for Development>

Toner D13 for Development was obtained by performing the same preparation process as in the preparation of Toner D1 for Development except that Toner Base Particle C13 was used in place of Toner Base Particle C1.

According to Reference Examples 1 to 4, it is understood that for obtaining a toner capable of balancing the high adhesion amount HOS property and the dust emission rate (Vd), which are the premise of the electrostatic image developing toner of the present invention, for example, in the case of an image forming device of 36 sheets/min, the toner dust emission (Dt) needs to be controlled to satisfy the following formula (7).

Specifically, as seen from comparison of Example 1 and Reference Examples 1 to 4, when as in Reference Example 4, Dt is 21 and deviates toward lower than the range above, the high adhesion-amount HOS property is out of the practical range, and the toner for development cannot be used. In addition, when as in the toner for development of Reference Example 3, Dt deviates toward higher than the upper limit of 5,665, the dust emission rate (Vd) is too high, and the toner for development cannot be used in practice. On the other hand, in Example 1 and Reference Examples 1 and 2 where the range of Dt satisfies the following formula (7), it is understood that the high adhesion-amount HOS property and the dust emission rate (Vd) can be balanced.

In the present invention, in the case of an image forming device of 36 sheets/min, assigning Vp=36 to formula (1) gives $$60 \leq Dt \leq 195{,}449/36-1{,}040$$

revealing that the toner dust emission (Dt) is $$a60 \leq Dt \leq 4{,}389 \quad (7)$$

In addition, when Examples 1 to 5 are compared with Comparative Examples 1 to 4, even in an electrostatic image developing toner of Reference Examples 1 and 2 where the hot offset resistance in graphic use involving an increase in the amount of electrostatic image developing toner attached to paper is enhanced while suppressing generation of dust at the time of fixing, in order to improve the low-temperature fixability at normal (low adhesion amount) high-speed printing while maintaining the storability, it is important to configure the toner to have, at 65.6 to 70.8° C., a peak or shoulder exhibiting a decay of the endothermic quantity in the second elevated temperature process in DSC to 80% or less of the endothermic quantity in the first elevated temperature process in DSC. In addition, in order to enhance the gloss at the time of high-speed printing, which is hard to achieve due to a short time of exposure to heat, while maintaining the hot offset resistance at the time of low-speed printing, which is hard to achieve due to heat applied for a long time, it is an essential requirement that in the dynamic viscoelasticity measurement at 140° C., the average value of tan δ in the range of an angular velocity of 20 to 100 rad/sec is from 1.62 to 2.20.

These findings reveal that only the toner for development of the present invention can provide an electrostatic image developing toner suitable for applications in a wide range from graphic use to normal printing use and moreover, from low-speed printing to high-speed printing.

While the invention has been described in detail and with reference to specific embodiments thereof, it will be apparent to one skilled in the art that various changes and modifications can be made therein without departing from the spirit and scope of the invention. This application is based on Japanese Patent Application (Patent Application No. 2013-058378) filed on Mar. 21, 2013, the contents of which are incorporated herein by way of reference.

The invention claimed is:

1. An electrostatic image developing toner comprising a binder resin, a colorant and a wax, wherein:

at least one peak or shoulder attributable to a melting point of the wax in the state of being contained in said electrostatic image developing toner is present at 55 to 90° C. in a second elevated temperature process in thermal analysis (DSC), a dust emission (Dt) of said electrostatic image developing toner satisfies the following formula (1):

$$60 \leq Dt \leq 8732$$

a peak or shoulder where an endothermic quantity in the second elevated temperature process in thermal analysis (DSC) decays to 80% or less of an endothermic quantity in a first elevated temperature process in thermal analysis (DSC) is present at 65.6 to 70.8° C., and an average value of tan δ in a range of an angular velocity of 20 to 100 rad/sec in a dynamic viscoelasticity measurement at 140° C. is from 1.62 to 2.20, in formula (1), Dt indicates a dust emission per minute (CPM) measured using measurement condition T, the at least one peak or shoulder attributable to the melting point of the wax in the state of being contained in said electrostatic image developing toner is measured using measurement method MpW, and the peak or shoulder where an endothermic quantity in the second elevated temperature process in thermal analysis (DSC) decays to 80% or less of the endothermic quantity in the first elevated temperature process in thermal analysis (DSC) is measured using measurement method RTT1.

2. The electrostatic image developing toner as claimed in claim 1, wherein the dust emission (Dt) of the electrostatic image developing toner satisfies the following formula (2):

$$60 \leq Dt \leq 4389 \quad (2).$$

3. The electrostatic image developing toner as claimed in claim 1, wherein the dust emission (Dt) of the electrostatic image developing toner satisfies the following formula (3):

$$60 \leq Dt \leq 5475 \quad (3).$$

4. The electrostatic image developing toner as claimed in claim 1, wherein the dust emission (Dt) of the electrostatic image developing toner satisfies the following formula (4):

$$60 \leq Dt \leq 64 \quad (4).$$

5. The electrostatic image developing toner as claimed in claim 1, wherein a peak or shoulder here an endothermic quantity in the second elevated temperature process in thermal analysis (DSC) decays to 80% or less of an endothermic quantity in the first elevated temperature process in thermal analysis (DSC) is present at 66.5 to 69.6° C.

6. The electrostatic image developing toner as claimed in claim 1, wherein the average value of tan δ in a range of an angular velocity of 20 to 100 rad/sec in a dynamic viscoelasticity measurement at 140° C. is from 1.82 to 2.13.

7. The electrostatic image developing toner as claimed in claim 1, wherein the plasticization initiating temperature determined by dynamic viscoelasticity measurement is from 73.5 to 80.5° C.

8. The electrostatic image developing toner as claimed in claim 7, wherein the plasticization initiating temperature determined by dynamic viscoelasticity measurement is from 74.8 to 79.2° C.

9. The electrostatic image developing toner as claimed in claim 1, which comprises two or more waxes, wherein one or more peaks or shoulders attributable to a melting point of a wax in the state of being contained in said electrostatic image developing toner are present in each of a range from 55 to 73° C. and a range from 77 to 90° C.

10. The electrostatic image developing toner as claimed in claim 1, wherein said electrostatic image developing toner satisfies the following requirements (a) to (c):

(a) said electrostatic image developing toner contains at least two kinds of waxes of a wax component X and a wax component Y, (b) a dust emission of said wax component Y is larger than a dust emission of said wax component X, and (c) a content of said wax component X is larger than a content of said wax component Y.

11. The electrostatic image developing toner as claimed in claim 10, wherein a ratio of said wax component Y in all wax components is from 0.1 mass % to less than 10 mass %.

12. The electrostatic image developing toner as claimed in claim 10, wherein said electrostatic image developing toner has a region in which an abundance radio of the wax component Y is higher than that of the wax component X, and said region in the outer wall side of said electrostatic image developing toner is larger than in the center side of said electrostatic image developing toner.

13. The electrostatic image developing toner as claimed in claim 10, wherein said electrostatic image developing toner has a shell-core structure, said wax contained in the shell material of said shell-core structure contains substantially only said wax component Y, and said wax contained in the core material of said shell-core structure contains substantially only said wax component X.

14. The electrostatic image developing toner as claimed in claim 1, wherein said electrostatic image developing toner satisfies the following requirements (a), (b) and (d):

(a) said electrostatic image developing toner contains at least two kinds of waxes of a wax component X and a wax component Y, (b) a dust emission of said wax component Y is larger than a dust emission of said wax component X, and (d) a dust emission of said wax component X is 50,000 CPM or less and a dust emission of said wax component Y is 100,000 CPM or more.

* * * * *